US011786961B2

(12) United States Patent
Biederman et al.

(10) Patent No.: US 11,786,961 B2
(45) Date of Patent: Oct. 17, 2023

(54) INVESTMENT MOLD SLURRY CURTAIN APPARATUS

(71) Applicant: METAL CASTING TECHNOLOGY, INC., Milford, NH (US)

(72) Inventors: Scott W. Biederman, New Boston, NH (US); Thomas Bonaventura, Lyndeborough, NH (US); Patrick E. Dodd, Manchester, NH (US); Joseph C. Michalik, Derry, NH (US)

(73) Assignee: Metal Casting Technology, Inc., Milford, NH (US)

( * ) Notice: Subject to any disclaimer, the term of this patent is extended or adjusted under 35 U.S.C. 154(b) by 184 days.

(21) Appl. No.: 15/291,256

(22) Filed: Oct. 12, 2016

(65) Prior Publication Data

US 2017/0100770 A1 Apr. 13, 2017

Related U.S. Application Data

(60) Provisional application No. 62/240,727, filed on Oct. 13, 2015.

(51) Int. Cl.
*B22C 9/04* (2006.01)
*B22C 7/02* (2006.01)
(Continued)

(52) U.S. Cl.
CPC ..... *B22C 9/04* (2013.01); *B22C 7/02* (2013.01); *B22C 13/085* (2013.01); *B22C 15/20* (2013.01); *B22C 23/02* (2013.01)

(58) Field of Classification Search
CPC ..... B22C 13/08; B22C 13/085; B22C 23/02
See application file for complete search history.

(56) References Cited

U.S. PATENT DOCUMENTS 2,948,935 A 8/1960 Carter et al.
3,341,354 A * 9/1967 Gordy ..... B05C 5/004 118/324
(Continued)

FOREIGN PATENT DOCUMENTS

CN 201253672 Y 6/2009
CN 102632196 A 8/2012
(Continued)

OTHER PUBLICATIONS

Machine Translation of JP H08-108249 A (published Apr. 30, 1996, cited in IDS filed Dec. 6, 2018). (Year: 1996).*
(Continued)

*Primary Examiner* — Kevin E Yoon
*Assistant Examiner* — Jacky Yuen
(74) *Attorney, Agent, or Firm* — BakerHostetler

(57) ABSTRACT

An investment mold slurry curtain apparatus includes a slurry curtain of a slurry fluid, the slurry curtain having a length and a thickness, the length substantially greater than the thickness. The apparatus also includes an outlet configured to dispense the slurry fluid and form the slurry curtain. The investment mold slurry curtain apparatus may include and be described as an investment mold slurry coating apparatus including a conduit configured to receive a flow of a slurry fluid and an outlet operatively coupled to the conduit, the outlet configured to dispense the flow of the slurry as a curtain of the slurry.

39 Claims, 23 Drawing Sheets

(51) Int. Cl.

| | |
|---|---|
| ***B22C 13/08*** | (2006.01) |
| ***B22C 15/20*** | (2006.01) |
| ***B22C 23/02*** | (2006.01) |

(56) References Cited

U.S. PATENT DOCUMENTS

| | | | | |
|---|---|---|---|---|
| 3,519,057 | A | 7/1970 | Benson et al. | |
| 3,860,476 | A | 1/1975 | Moore, Jr. | |
| 3,878,034 | A | 4/1975 | Bever et al. | |
| 3,903,950 | A * | 9/1975 | Lirones | B22C 9/04 164/518 |
| 3,915,606 | A * | 10/1975 | Straub | B05C 5/005 425/113 |
| 4,440,806 | A * | 4/1984 | Muri | B22C 9/04 118/308 |
| 4,651,801 | A | 3/1987 | Sasaki | |
| 4,998,581 | A | 3/1991 | Lane et al. | |
| 5,069,271 | A | 12/1991 | Chandley et al. | |
| 5,236,744 | A * | 8/1993 | Suga | B05C 5/008 118/DIG. 4 |
| 5,460,217 | A | 10/1995 | Sakurai et al. | |
| 5,746,272 | A | 5/1998 | Mastrorio et al. | |
| 6,749,006 | B1 | 6/2004 | Yang et al. | |
| 7,231,955 | B1 | 6/2007 | Bullied et al. | |
| 8,235,092 | B2 | 8/2012 | Scott | |
| 2004/0134634 | A1 | 7/2004 | Yang et al. | |
| 2008/0178799 | A1* | 7/2008 | Kohno | B05C 5/005 118/313 |
| 2008/0248321 | A1* | 10/2008 | Krumbacher | B05C 5/005 428/537.5 |
| 2010/0006252 | A1* | 1/2010 | Roby | B22C 7/02 164/15 |
| 2011/0114279 | A1 | 5/2011 | Scott | |

FOREIGN PATENT DOCUMENTS

| | | | | |
|---|---|---|---|---|
| CN | 102672103 | A | 9/2012 | |
| CN | 103111585 | A | 5/2013 | |
| CN | 104646638 | A * | 5/2015 | |
| DE | 10358220 | A1 | 7/2005 | |
| EP | 0286563 | A1 * | 10/1988 | B05C 5/005 |
| EP | 3302850 | B1 | 12/2020 | |
| GB | 1261562 | A | 1/1972 | |
| GB | 1327478 | A | 8/1973 | |
| JP | 61-137646 | A | 6/1986 | |
| JP | 62-214846 | A | 9/1987 | |
| JP | 10-109136 | A | 4/1988 | |
| JP | 63-194842 | A | 8/1988 | |
| JP | 4-35255 | B2 | 6/1992 | |
| JP | 8-108249 | A | 4/1996 | |
| JP | 3088912 | B2 | 9/2000 | |
| JP | 2002-120043 | A | 4/2002 | |
| SU | 1484382 | A1 | 6/1989 | |

OTHER PUBLICATIONS

Machine Translation of Ono (JP S61-137646A, published Jun. 25, 1986, cited in IDS filed Oct. 27, 2020). (Year: 1986).*

International Search Report and Written Opinion issued in Application No. PCT/US2016/056728, dated Jan. 23, 2017.

International Preliminary Report on Patentability issued in Application No. PCT/US2016/056728, dated Apr. 26, 2018.

Office Action issued in Korean Application No. 10-2018-7000860, dated Dec. 11, 2018.

Extended Search Report issued in European Application No. 16856142.1, dated Dec. 20, 2018.

Office Action issued in Japanese Application No. 2017-565925, dated Nov. 5, 2018.

* cited by examiner

INVESTMENT MOLD SLURRY CURTAIN APPARATUS

CROSS-REFERENCE TO RELATED APPLICATIONS

This application claims priority of U.S. application No. 62/240,727, filed on Oct. 13, 2015, the disclosure of which is incorporated by reference in its entirety.

FIELD OF THE INVENTION

The subject invention relates generally to an investment mold slurry curtain apparatus, and in an embodiment may be described as an investment mold slurry coating apparatus.

BACKGROUND

The investment casting industry requires the use of suitable investment casting molds. Preferably, these investment casting molds will accurately and precisely reflect the final features and dimensions of the desired cast part as closely as possible, thereby avoiding the need for additional machining or finishing operations to achieve the desired component or part. These investment casting molds, particularly countergravity investment casting molds, utilize pattern assemblies of the articles to be cast that are formed from a fugitive or removable material. These pattern assemblies are invested with a refractory particulate material to form a refractory shell.

Investment casting pattern assemblies, particularly those used for countergravity investment casting, have generally been formed by attaching one or more mold patterns of the article or articles to be formed to a central sprue pattern that extends along a sprue axis. The mold patterns are generally connected to the central sprue by a radially extending gate pattern or a plurality of gate patterns. Once a pattern assembly has been coated with a refractory shell, the fugitive material is removed to define a refractory mold assembly that includes a central sprue, a plurality of radially extending gates, and associated mold cavities that define passageways or conduits within the refractory mold for the purpose of feeding molten metal into the mold cavities, where it is solidified to form the desired cast articles.

Generally, refractory molds are made by orienting the pattern assembly with the sprue pattern oriented substantially vertically and dipping the pattern assembly of the fugitive material into a slurry bath of a refractory slurry material that includes a liquid, binder and refractory particles. The pattern assembly is then removed from the slurry bath producing a wet slurry coating on the outer surface of the pattern assembly. The wet slurry coating may then be coated with a layer of refractory stucco particles, such as by dipping the wet coating layer into a fluidized bed of stucco particles, and then dried to provide a dried layer of refractory particles from the slurry and refractory stucco particles. This process is generally repeated to form a plurality of dried layers of refractory particles and refractory stucco particles. The fugitive material is then removed from the refractory shell forming the refractory investment casting mold assembly. These refractory casting mold assemblies are then used for investment casting of various molten metals and alloys having a shape defined by the pattern assemblies of the fugitive materials. While this method is useful and has been used extensively in the past, it is a time consuming batch process. The conventional steps of dipping, stuccoing, and drying are done discontinuously as batch processes, generally using different equipments located in different rooms or portions of a facility, including a slurry bath, a stucco particle sander, and a drying room or oven. The method requires extensive handling of the pattern assemblies, including transfer to the various batch stations described for implementation of the steps, as well as repetition of the steps needed to produce a plurality of layers of refractory particles and refractory stucco particles sufficient to define a refractory mold. The method generally takes a minimum of several days to a week or more to produce a refractory mold assembly using the apparatus mentioned.

SUMMARY OF THE INVENTION

To overcome the shortcomings of the conventional investment casting mold making processes, improved apparatuses and methods for making refractory molds for investment casting are very desirable, particularly methods and apparatuses that reduce the time needed to produce a refractory mold assembly.

In one exemplary embodiment, an investment mold slurry curtain apparatus is disclosed. The slurry curtain apparatus includes a slurry curtain of a slurry fluid, the slurry curtain having a length and a thickness, the length substantially greater than the thickness. The apparatus also includes an outlet configured to dispense the slurry fluid and form the slurry curtain.

In another exemplary embodiment, the investment mold slurry curtain apparatus may include and be described as an investment mold slurry coating apparatus. The investment moldy slurry coating apparatus includes a conduit configured to receive a flow of a slurry fluid and an outlet operatively couple to the conduit, the outlet configured to dispense the flow of the slurry as a curtain of the slurry.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
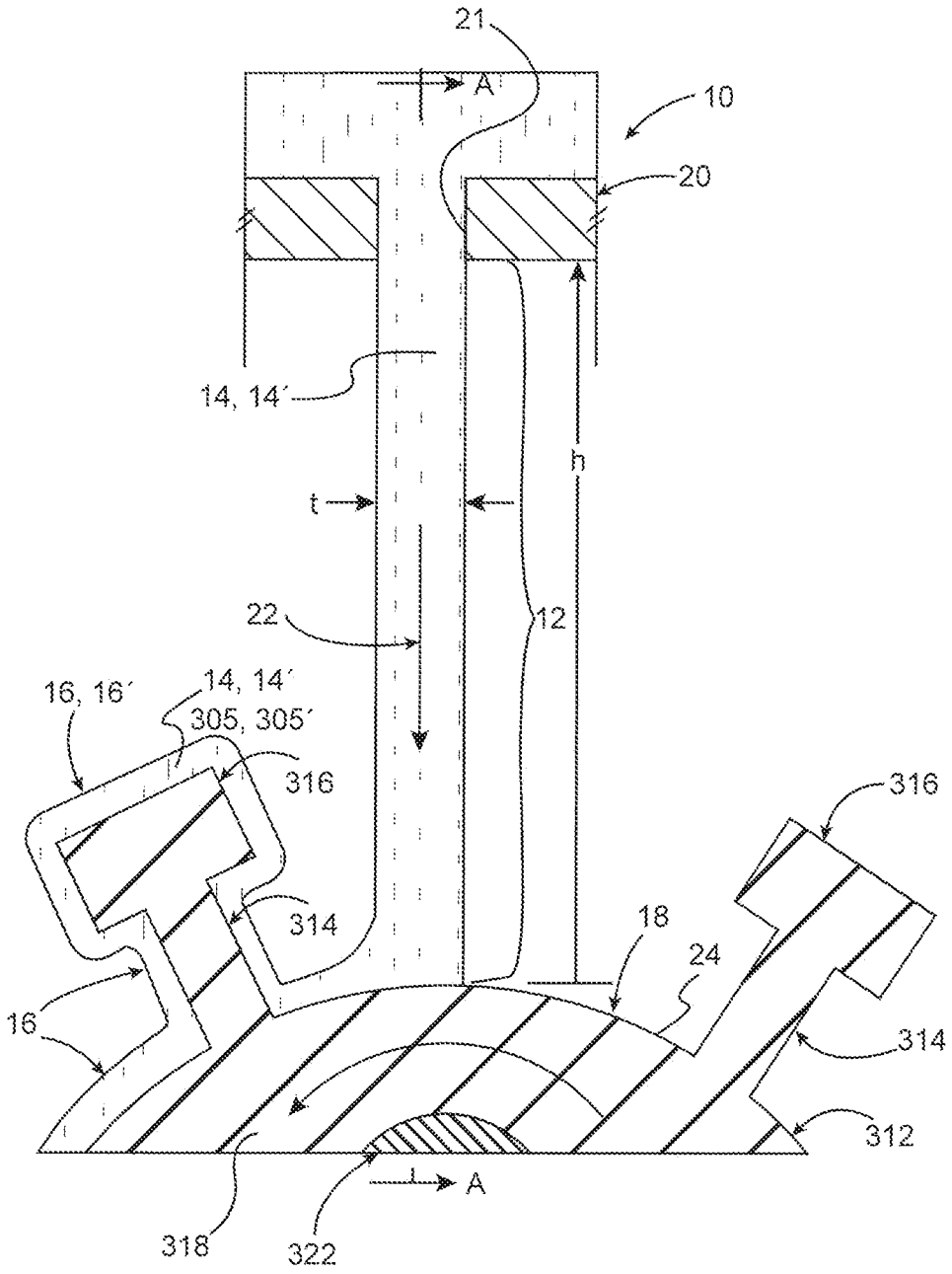
FIG. 1 is a cross-sectional view of an embodiment of a slurry curtain apparatus 10 as disclosed herein.
Figure 1A:
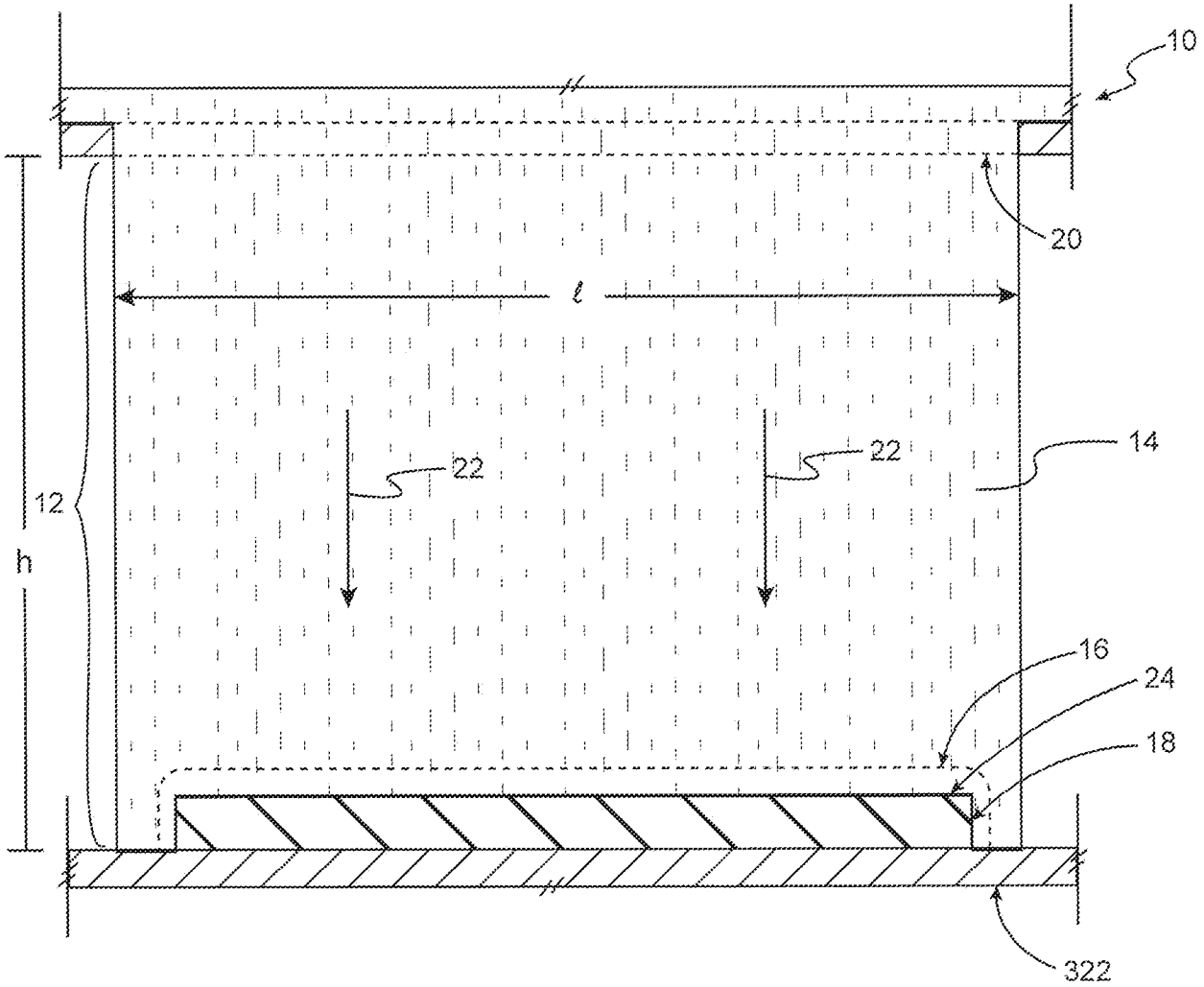
FIG. 1A is a cross-sectional view of the embodiment of FIG. 1 taken along section A-A.
Figure 2:
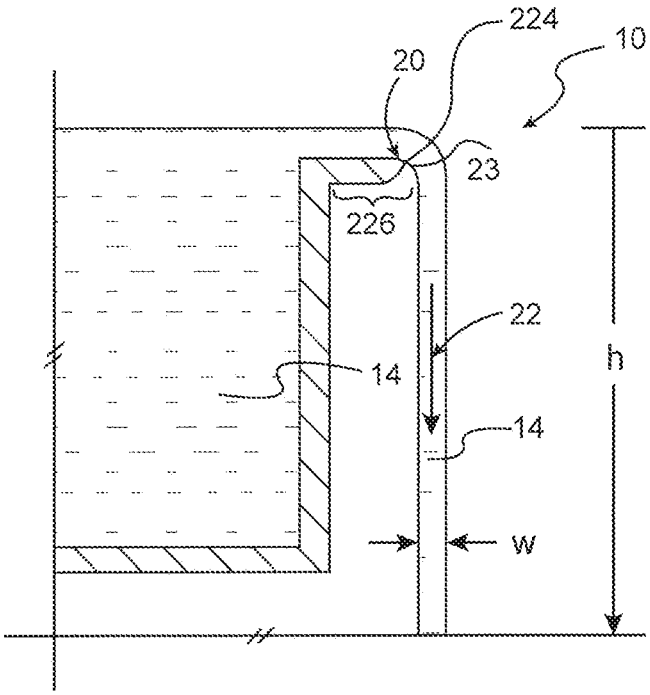
FIG. 2 is a cross-sectional view of another embodiment of a slurry curtain apparatus 10 as disclosed herein.
Figure 3:
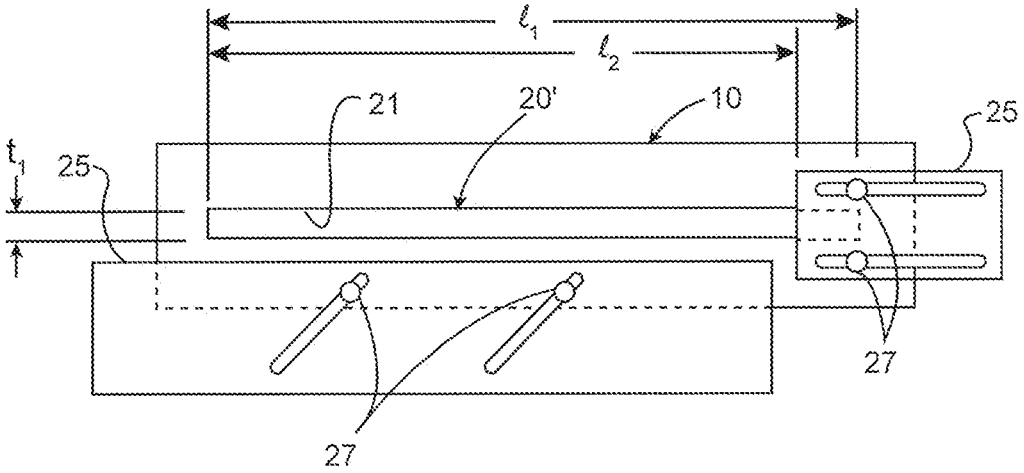
FIG. 3 is a bottom view of another embodiment of a slurry curtain apparatus 10 as disclosed herein.
Figure 4:
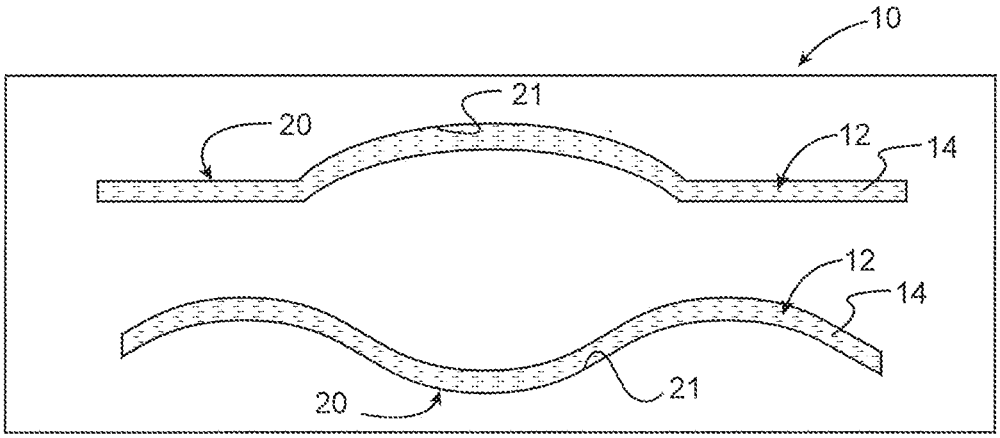
FIG. 4 is a bottom view of yet another embodiment of a slurry curtain apparatus 10 as disclosed herein showing a partial section of a slurry curtain.

Referring to the figures, including FIGS. 1-38, a method and apparatuses for making a refractory investment casting mold assembly are described. These apparatuses include an investment mold slurry curtain apparatus 10 as shown in FIGS. 1, 1A and 2. In one embodiment, the investment mold slurry curtain apparatus 10 is included in an investment mold slurry coating apparatus 100 as shown in, for example, FIGS. 7-16. In another embodiment, the investment mold slurry curtain apparatus 10 is included in an investment mold slurry coating manifold apparatus 200 as shown in FIGS. 17A-22. The investment mold slurry curtain apparatus 10 in the embodiments described is very advantageous because it enables application of a wet slurry coating of refractory particles onto a fugitive pattern assembly in a new way that is very different from dipping using conventional slurry baths as described above. The investment mold slurry curtain apparatus 10 is particularly advantageous for a number of reasons described herein, and particularly because the apparatus can readily be integrated into an apparatus or system that provides continuous manufacture of refractory investment mold assemblies.

These apparatuses also include an investment mold making apparatus 300 that includes an investment mold slurry curtain apparatus 10 integrated together with other devices necessary to manufacture refractory investment casting mold assemblies as shown in FIGS. 25-34B. The integration of these devices advantageously provides an apparatus or system that enables the continuous or semi-continuous manufacture of refractory investment casting mold assemblies, greatly reducing the manufacturing time needed to produce these assemblies and the associated manufacturing cost, as well as improving the quality and repeatability of the assemblies produced. As is readily understood by those of ordinary skill in the art, the ability to reduce the cost and cycle time needed to manufacture the refractory mold assemblies directly reduces the cost of the investment castings made using these molds, both with regard to the mold costs, as well as increased throughput of finished castings.

Figure 35:
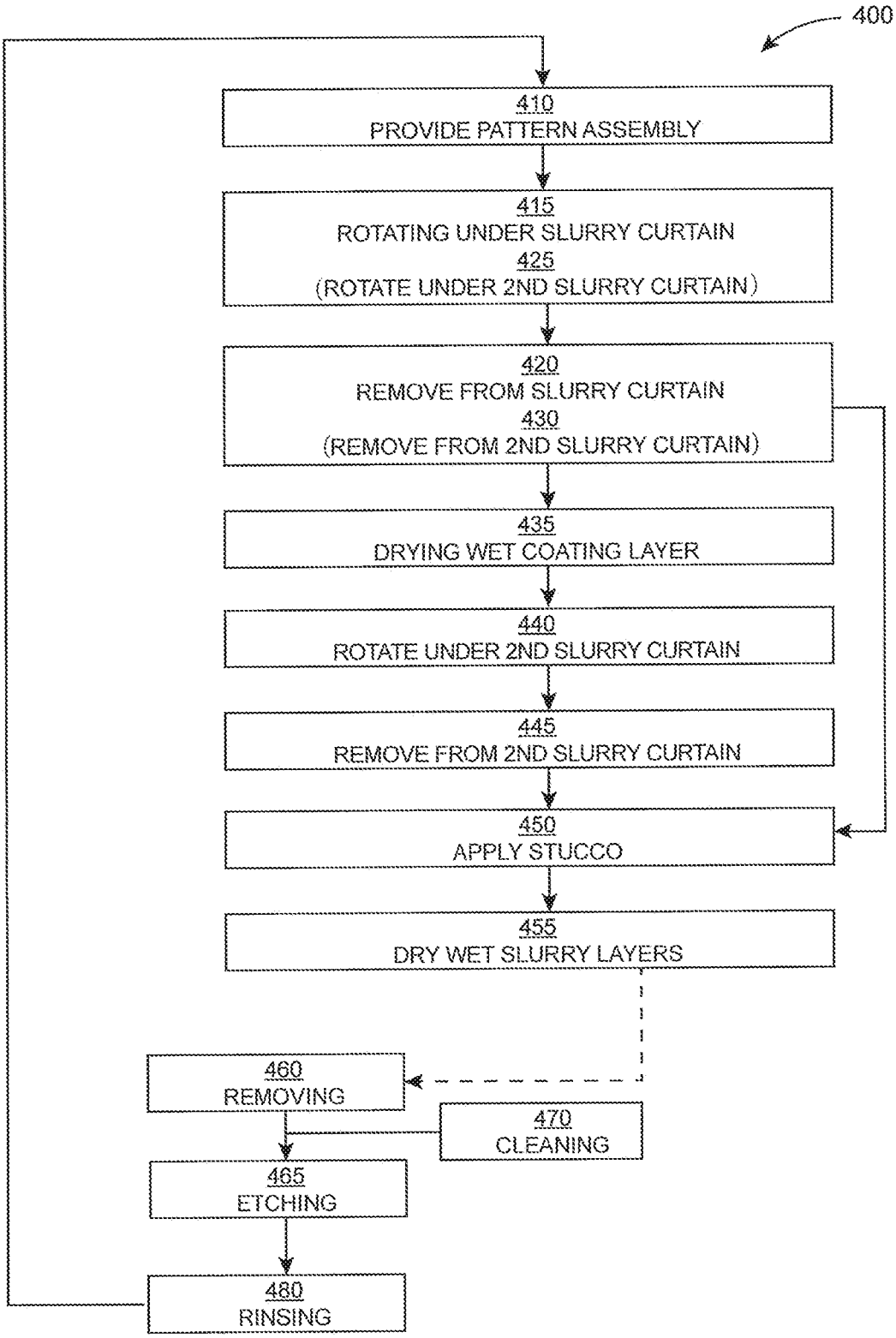
FIG. 35 is a flowchart of a method of making a refractory mold as disclosed herein.

The investment mold slurry curtain apparatus 10 and investment mold making apparatus 300 enable and can be used to practice a method 400 of making refractory shell mold assemblies as shown in FIG. 35. The apparatuses 10, 100, 200, and 300 provide for rotatable and/or substantially horizontal orientation of the longitudinal or sprue axis of the pattern assembly during the coating process and incorporation of a slurry curtain, such as an axially extending slurry curtain, to apply the slurry coating rather than dip coating. The use of the rotatable and/or substantially horizontal orientation of the pattern assembly together with the slurry curtain enables the use of various conveyor devices 80 and factory automation devices and implementation of a continuous, or semi-continuous or partially continuous, method 400 of making refractory shell mold assemblies 600. The continuous method 400 is very advantageous because it greatly reduces the time required to build a refractory shell mold assembly 600 and the associated cost of the assembly. The method 400 also advantageously offers new methods of handling and storing the coated pattern assemblies in their rotatable horizontal orientation both during and in-between the various elements of the refractory shell mold assembly process. For example, after applying the slurry coating, the wet coated pattern assemblies can continue to be rotated at a predetermined rotational rate or speed, which may be a constant speed or a variable speed or a combination thereof, as they drain and move through the subsequent elements of the method 400 to ensure the uniformity of the resultant coating. The horizontal orientation also enables flexible stacking and storage of the coated pattern assemblies as they progress through the elements of the method 400 or afterward in all manner of stacking and storage devices or equipment, including without limitation, vertically oriented racks, horizontally oriented racks, serpentine or other circuitous conveyors, and horizontal or vertical carousels that can easily be integrated into a conveyor device or system. Having generally described the invention and some of the associated advantages, a detailed description follows below.

Investment Mold Slurry Curtain Apparatus

Referring to FIGS. 1 and 1A, an investment mold slurry curtain apparatus 10 includes a slurry curtain 12 of a slurry fluid 14. Investment shell molds are made by applying a series of ceramic coatings to pattern assemblies or pattern clusters. Each coating may include a coating layer 16. The coating layer 16 may be formed by applying the slurry curtain 12 via the slurry fluid 14. The slurry fluid 14 includes a refractory slurry fluid suitable for providing a wet coating layer 16 of refractory particles on a fugitive or removable mold pattern assembly 18. The refractory slurry fluid 14 may include any suitable constituents for making the coating. In one embodiment, refractory slurry fluid 14 includes a plurality of refractory particles, a binder, and a liquid or fluid to make the slurry, and in other embodiments, the slurry fluid 14 may also include at least one additive, or a plurality of additives, to control the slurry characteristics, such as the wetting of the refractory particles, the wetting of the fugitive pattern assembly, the entrapment of gases or foaming. Any finely divided refractory particles suitable for forming a refractory mold may be employed provided they do not have an undesirable reaction with the other slurry constituents, including zirconia, fused zirconia, alumina, fused alumina, mullite, fused mullite, yttria, silica, fused silica, aluminosilicates, kaolins clays, calcined kaolin clays, mica, carbon, and combinations thereof. The refractory particles may have any suitable particle size and/or particle form or morphology, including spherical, equiaxial, acicular, angular, fibrous, flake, granular (e.g. regular or irregular shaped particles measurable using standard mesh sizes), dendritic, elongated, platelet, or hollow particles (e.g. hollow spheres). The particles may have an aspect ratio (ratio of longest dimension to shortest dimension) of about 1 to about 20, and more preferably about 1 to about 5. The particle sizes may include unimodal, bimodal or multimodal distribution of average particle sizes in order to vary the packing density of the refractory particles in the slurry coating layers. In one embodiment, exemplary particle sizes include less than 100 mesh to greater than 600 mesh. Any suitable binder material may be used, including various binder solution, such as ethyl silicate or colloidal silica sol. Any suitable carrier liquid or fluid may be employed, including water or various aqueous solutions, such that the slurry fluid 14 is an aqueous slurry fluid. Various slurry additives may also be employed to control the slurry characteristics, including an organic film former, a wetting agent or surfactant, and a defoaming agent.

The slurry fluid 14 may include the wetting agent to promote wetting of the pattern or prior slurry coats. Wetting agents such as sodium alkyl sulfates, sodium alkyl aryl sulfonates, or octyl-phenoxy polyethoxy ethanol may be used. In some aspects, the defoaming agent may be included to suppress foam formation and to permit air bubbles to escape. The defoaming agent may include aqueous silicone emulsions and liquid fatty alcohols such as n-octyl alcohol. Nucleating agents, or grain refiners, which are refractory cobalt compounds such as aluminates, silicates, and oxides may be added to the slurry fluid 14.

The slurry fluid 14 may have any viscosity suitable for forming a slurry coating layer 16 on a fugitive pattern assembly 18. The slurry fluid 14 may be prepared by adding refractory power to binder liquid, using agitation to break up agglomerates, remove any air entrainment. Stirring is continued until viscosity falls to its final level before the slurry fluid 14 is put to use. Stirring may be continued in production to keep the powder from setting out of suspension. Rotating tanks with baffles or propeller mixers may be contemplated for the stirring.

In one embodiment, the viscosity may include a range at room temperature (75-85° F.) of No. 4 Zahn cup of 7 to 35 seconds, and more particularly 10 to 32 seconds. In one embodiment, the slurry fluid 14 comprises a suspension of the fluid constituents in the fluid, and in another embodiment a stable suspension to provide a predetermined stability or shelf life. In one embodiment, the suspension comprises a stable colloidal suspension. Suitable slurry fluids 14 may include conventional slurry fluids, such as those described in U.S. Pat. Nos. 2,948,935 (Carter), 3,860,476 (Moore), 3,878,034 (Beyer), and 5,069,271 (Chandley), which are herein incorporated by reference in their entirety.

Generally, more than one slurry fluid 14 is used to make a refractory mold assembly, and coatings deposited from the different slurry fluids 14 are sequenced in a predetermined order to obtain the desired properties of the refractory mold assembly, including the surface finish of the inner surface of the mold, mold strength, heat transfer characteristics, gas permeability (gas permeable or gas impermeable) and the like, as explained further below.

As used herein, the term slurry curtain 12 is used to denote a slurry flow 22 that has been suitably shaped or formed into the form of a curtain. As used herein, the term curtain includes shapes in the form of a curtain or a waterfall or a shower or wave or similar shape that forms the slurry flow 22 into a form that has a length that is substantially greater than its thickness or width. The slurry curtain 12 and slurry flow 22 may define a continuous shape or discontinuous shape, including a series or pattern of slurry flows 22 that together define a shape at the surface 24 of the fugitive or removable mold pattern assembly 18 that is configured to provide the desired wet coating layer 16 over the surface 24. In one embodiment, the slurry curtain 12 has a shape and size that provides a continuous wet coating layer 16 over all or substantially all of the surface 24 as the fugitive mold pattern assembly 18 is rotated under the curtain. In other embodiments, the slurry curtain 12 has a shape and size that provides a continuous wet coating layer 16 over a predetermined portion of the surface 24 as the fugitive mold pattern assembly 18 is rotated under the curtain. In the various embodiments, the slurry curtain 12 and slurry flow 22 may be configured with great flexibility to provide wet coating layer 16 over all or any portion or portions of the surface 24 as the fugitive mold pattern assembly 18 is rotated under the curtain.

In one embodiment, the slurry curtain 12 has a length (l) and a thickness (t) as shown in FIG. 1 and FIG. 1A with the length substantially greater than the thickness. The slurry curtain 12 is configured to shape the slurry flow so that it is configured to cover all or a portion of the overall axial length or height of the pattern assembly, generally approximately the length or height of the sprue pattern. The investment mold slurry curtain apparatus 10 also includes an outlet 20. The outlet 20 is configured to dispense the slurry fluid 14 and slurry flow 22 and form the slurry curtain 12, including forming the slurry curtain into a predetermined shape. The outlet 20 may have any suitable shape or configuration suitable to direct the slurry flow 22 of the slurry fluid 14 into the shape of a curtain. In one embodiment, the outlet 20 may comprise an enclosed orifice 21 (FIGS. 1 and 1A) or plurality of enclosed orifices in a manifold, conduit, tank or similar device for receiving, accumulating or directing the slurry flow 22 of the slurry fluid 14 that has an orifice shape suitable to direct the slurry flow of the slurry fluid into the shape of slurry curtain 12 as described herein. In another embodiment, the outlet 20 may include an edge 23 (FIG. 2), or a plurality of edges, of a manifold, conduit, tank or similar device for receiving, accumulating or directing a flow of the slurry fluid that has an edge shape suitable to direct the slurry flow 22 of the slurry fluid 14 over the edge into a slurry curtain 12 as described herein.

In one embodiment, the outlet 20 has an outlet shape 20', and the outlet shape is adjustable or changeable so that the shape of the slurry curtain 12 produced by the outlet 20' is adjustable or changeable, such as, for example, by the use of moveable plates 25 or shutters (FIG. 3) that can be loosed/fixed using threaded fasteners 27. In one aspect, the outlet shape 20' may be adjustable while the slurry curtain 12 is being dispensed. For example, the outlet 20 may be adjustable to provide a range of slurry curtain thicknesses along the length, or the length may be adjustable over a range of lengths, or the outlet 20 may be adjustable so that both the thickness and length of the slurry curtain 12 may be adjustable. In one embodiment, the shape of the outlet 20 may be adjusted manually, such as part of the set-up of the shape of the outlet 20, or alternately, while the slurry fluid 14 and slurry flow 22 is flowing through the outlet 20. In another embodiment, the outlet 20 may be adjusted automatically using an electronic controller and electromechanical actuators, such as part of the set-up of the shape of the outlet 20, or alternately while the slurry fluid 14 is flowing through the outlet 20.

Figure 5:
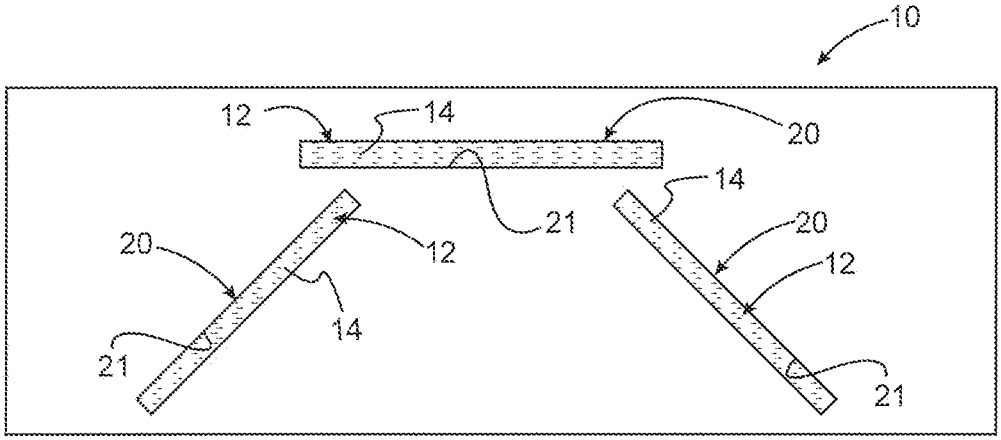
FIG. 5 is a bottom view of still another embodiment of a slurry curtain apparatus 10 as disclosed herein showing a partial section of a slurry curtain.

In one embodiment, the outlet 20 has an outlet shape that provides a flow of the slurry fluid 14 such that the slurry curtain 12 comprises a flat plane (FIGS. 1, 1A, and 2). In another embodiment, the outlet 20 has an outlet shape that provides a flow of the slurry fluid 14 such that the slurry curtain 12 comprises a curved plane. The slurry curtains 12 may have a single shape, such as a flat plane or a curved plane (FIG. 4), or may combine a plurality of flat plane and curved plane portions or segments (FIG. 4) to accommodate the various shapes of the pattern assembly. The outlet 20 may comprise a plurality of outlets 20 that together may define one slurry curtain 12 or a plurality of slurry curtains 12 (FIG. 5).

Figure 6:
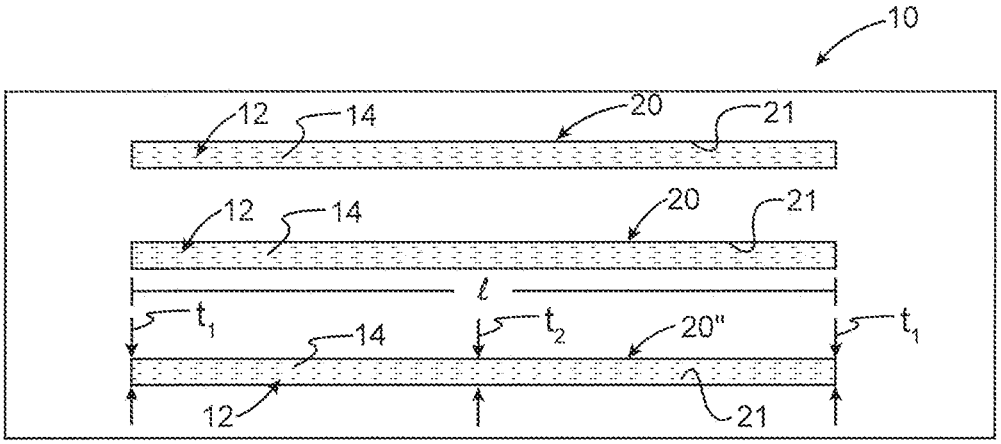
FIG. 6 is a bottom view of a further embodiment of a slurry curtain apparatus 10 as disclosed herein showing a partial section of a slurry curtain.

The slurry curtain 12 has a length (l) and a thickness (t) as shown in FIGS. 1, 1A with the length substantially greater than the thickness. In this regard, the meaning of substantially greater than includes greater than, and in one embodiment may be defined as being 5 times greater or more. In another embodiment, the length of the slurry curtain 12 is about 5 to about 1000 times the thickness, and in another embodiment, the length of the slurry curtain is about 20 to about 500 times the thickness. The slurry curtain 12 may have any suitable thickness, and in one embodiment is greater than about 0.040 inches, and in another embodiment may range from about 0.040 inches to about 0.50 inches, and more particularly from about 0.040 inches to about 0.10 inches. In one embodiment, the thickness of the slurry curtain 12 is constant along the length of the curtain. In one embodiment, the thickness of the slurry curtain 12 varies along the length of the curtain (FIG. 6). In some aspect, the thickness of the slurry curtain 12 may be constant in the plane and/or curved plane portions along the length of the slurry curtain 12. In another aspect, the thickness of the slurry curtain 12 may be variably adjusted in the plane and/or curved plane portions along the length of the slurry curtain 12 to accommodate the various shapes of the pattern assembly 18.

In one embodiment, the slurry curtain 12 comprises a single slurry curtain 12 (FIGS. 1, 1A, and 2) that is configured to cover the entire length of the pattern assembly 18, or only a predetermined portion of the pattern assembly 18, as the case may be. In another embodiment, the slurry curtain 12 comprises a plurality of discrete slurry curtains 12 (FIGS. 4, 5 and 6) that together are configured to cover the entire length of the pattern assembly 18, or only a predetermined portion of the pattern assembly 18, as the case may be. Discrete slurry curtains 12 may be configured in any predetermined pattern in order to provide the desired coating coverage of the pattern assembly 18, including the patterns shown in FIG. 6.

Investment Mold Slurry Coating Apparatus

Figure 7:
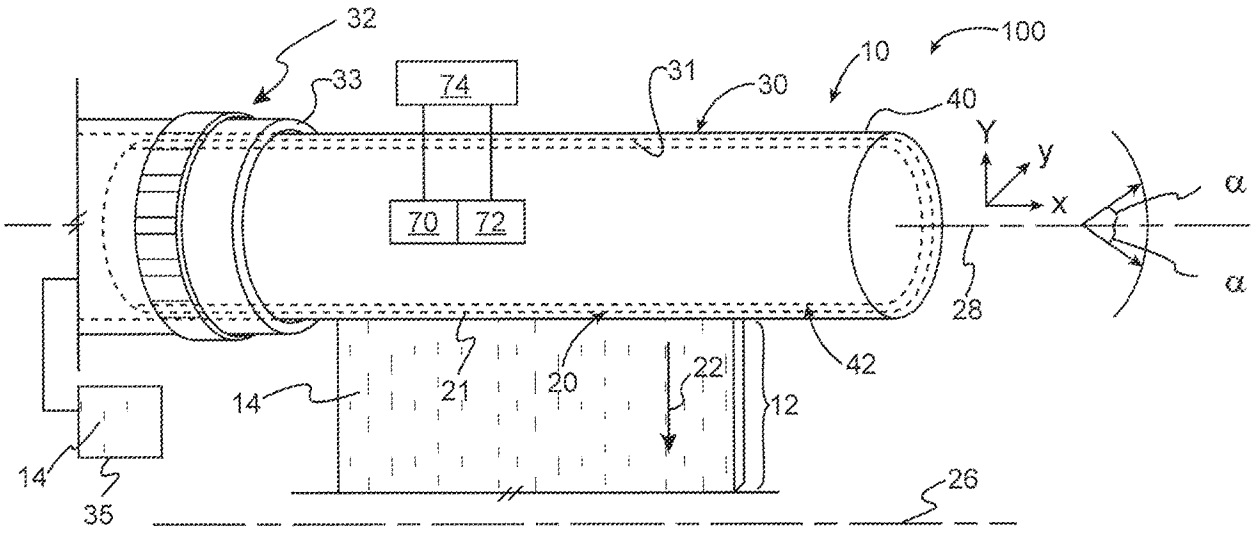
FIG. 7 is a schematic illustration of an embodiment of slurry coating apparatus 100 and slurry curtain as disclosed herein.
Figure 8B:
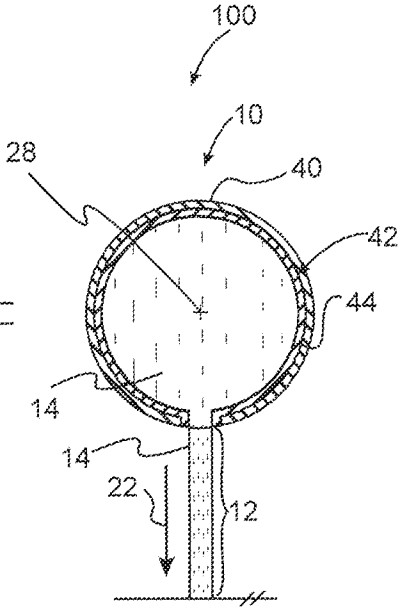
FIG. 8B is a cross-sectional view of the embodiment of FIG. 8 taken along section B-B.
Figure 8:
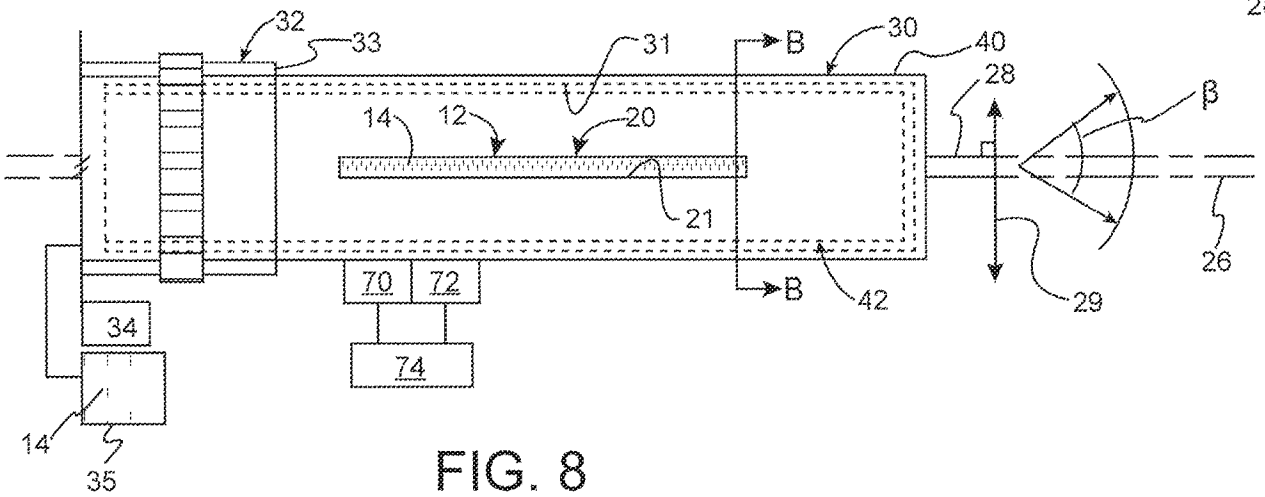
FIG. 8 is a bottom view of the embodiment of FIG. 7.
Figure 13A:
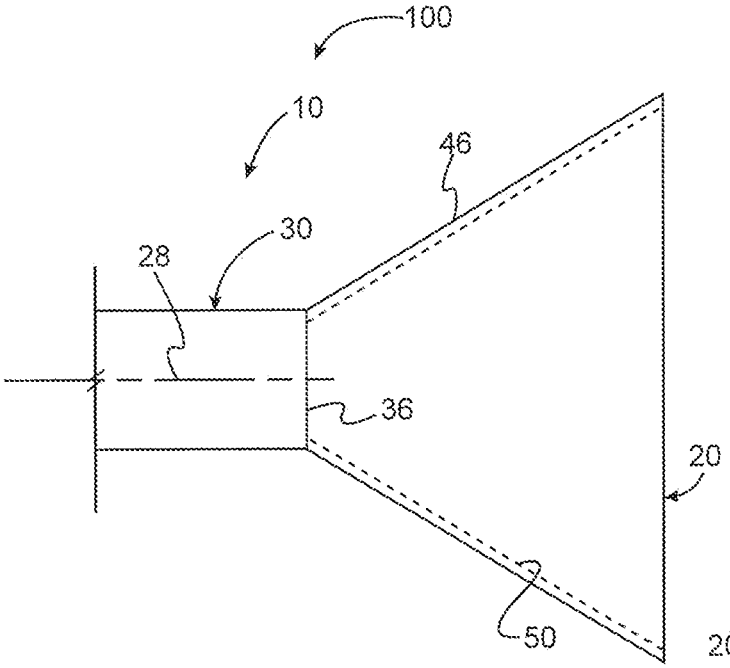
FIGS. 13A, 13B, and 13C are top, front, and side views, respectively, of an embodiment of slurry coating apparatus 100 and conduit 30 with an end nozzle 46 as described herein.
Figure 13B:
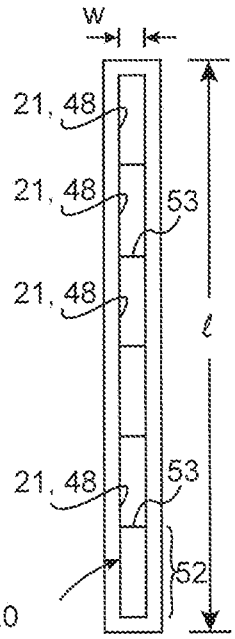
Figure 13C:
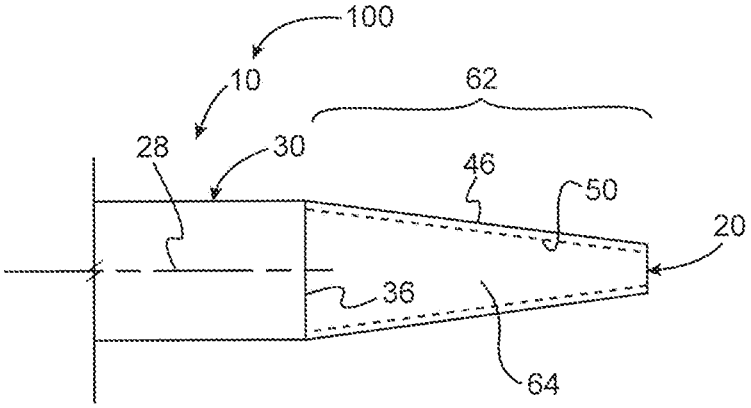
Figure 14A:
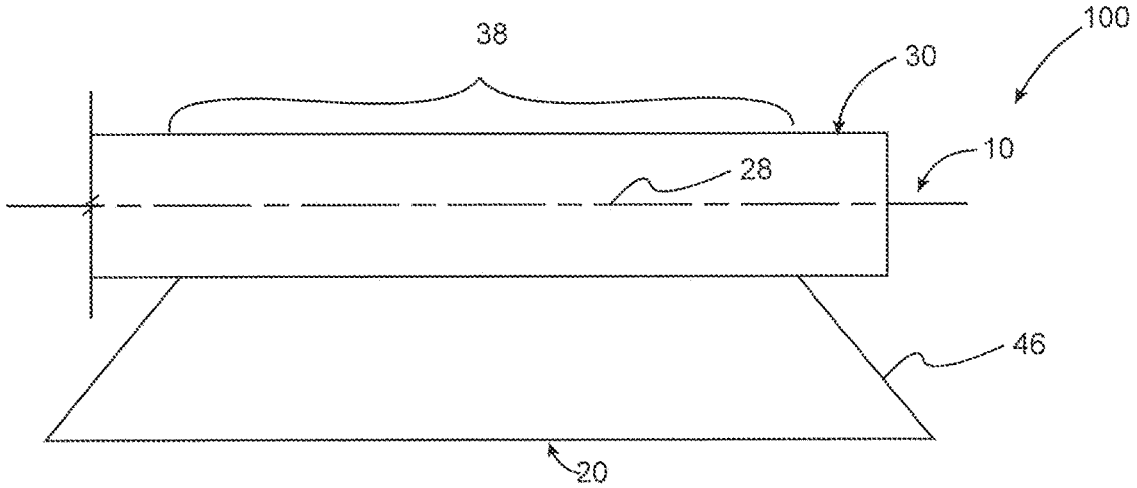
FIGS. 14A and 14B are front and bottom views, respectively, of an embodiment of slurry coating apparatus 100 and conduit 30 with an nozzle 46 along the length as described herein.

In another embodiment, an investment mold slurry coating apparatus 100 includes a conduit 30 configured to receive the slurry flow 22 of the slurry fluid 14 and an outlet 20 operatively coupled to the conduit 30 as illustrated in FIGS. 7, 8, and 8B. In one aspect, the investment mold slurry curtain apparatus 10 may include or be operatively connected to the investment mold slurry coating apparatus 100. In this embodiment, the investment mold slurry coating apparatus 100 combines the conduit 30 and outlet 20 and the outlet is configured to dispense the slurry flow 22 of the slurry fluid 14 as slurry curtain 12, as described herein. In this embodiment, a conduit system 32, which is generally used to convey the slurry fluid 14 from a tank, vat, mixer, or similar device 34 that may be used to prepare the slurry fluid from its constituents or store the slurry fluid 14 once it has been prepared, or a combination thereof, or any other suitable source 35 of slurry fluid 14, is used to convey the slurry flow 22 to the conduit 30 that includes the outlet 20 for dispensing the flow of slurry fluid 14 as slurry curtain 12. In one embodiment, the conduit 30 advantageously may be used to directly dispense the slurry fluid 14 from the outlet 20 without the need for a device or devices to accumulate slurry fluid 14 adjacent to the outlet. In addition, the outlet 20 may be incorporated into any suitable portion of the conduit 30, including at an end 36 as shown in FIG. 13A and FIG. 13C or along the length 38 of the conduit as shown in FIG. 14A.

The conduit 30 may have a size or shape, including cross-sectional shape. In one embodiment, the conduit 30 may comprise a length of a pipe or tube 40. The pipe or tube 40 may have any suitable cross-sectional shape, including various circular, rectangular, and rounded rectangular cross-sectional shapes, including square and rounded square cross-sectional shapes. The conduit 30 may be curved or bent along the longitudinal axis. In one embodiment, the conduit 30 may have a circular cross-section or square cross-section with a diameter or side length in a range of about 0.25 in. to about 12 in., and more particularly about 1 in. to about 3 in. The conduit 30 may be formed from any suitable material, including various plastics, metals, or composite materials, including fiber-reinforced composite materials, such as various fiberglass or carbon composites. Suitable metal conduits include copper, aluminum, steel, stainless steel, and iron pipe or tubing. Suitable plastic conduits include those formed from any suitable engineering thermoplastic or thermoset resins, including acrylonitrile butadiene styrene, polyvinyl chloride, chlorinated polyvinyl chloride, polyester, polyethylene, and cross-linked polyethylene, polypropylene, polybutylene, polyamide, epoxy, and phenolic resins, which may be filled with any suitable fillers or strengthening fibers. Composite conduits include resins of the types described above that are reinforced by glass, metal, or carbon fibers in various forms, including various wound, wrapped, and woven forms. The conduit 30 may be rigid or flexible. The conduit 30 may also be lined on an inner surface 31 with a liner 42. The liner 42 and liner material 44 may be selected to provide at least one of increased chemical resistance, increased abrasion resistance, or a reduced coefficient of friction with regard to the slurry fluid 14 as compared with the material of the conduit. Suitable liner materials may include various metals or metal carbides, oxides, and nitrides, or combinations thereof, or diamond like carbon (DLC) films or coatings having a hardness or abrasion resistance that is greater than the material of the conduit 30, including those materials used as hard-facing materials in the oil and gas services, such as hard particle-metal matrix composites. The liner material 44 may also include various polymer materials to reduce the coefficient of friction with regard to the slurry fluid 14, including various fluoropolymers such as polytetrafluoroethylene (PTFE). The liner material 44 may be applied in any suitable manner, including by heat treatment or as a coating or film deposited on the inner surface 31 of the conduit 30.

Figure 9:
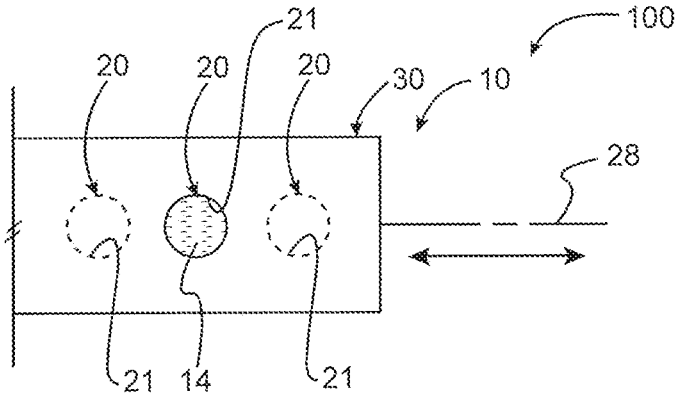
FIG. 9 is a bottom view of another embodiment of slurry coating apparatus 100 and slurry curtain as disclosed herein.
Figure 10:
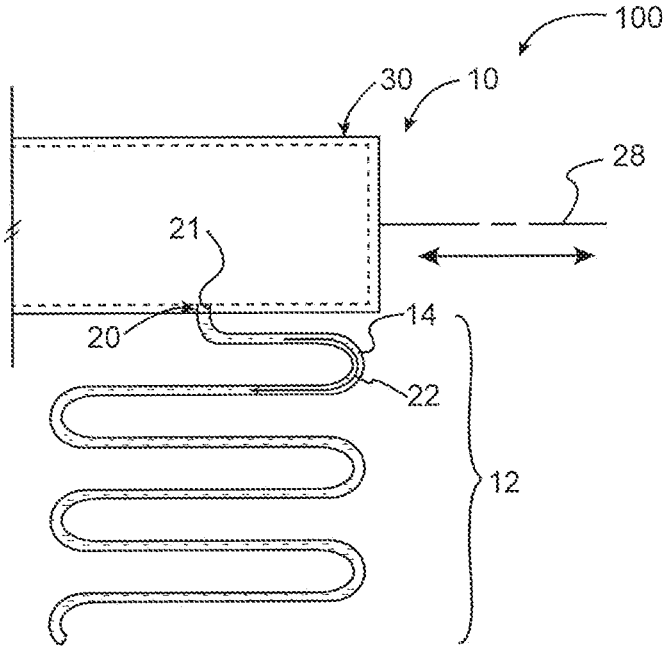
FIG. 10 is a front view of the embodiment of FIG. 9.
Figure 30:
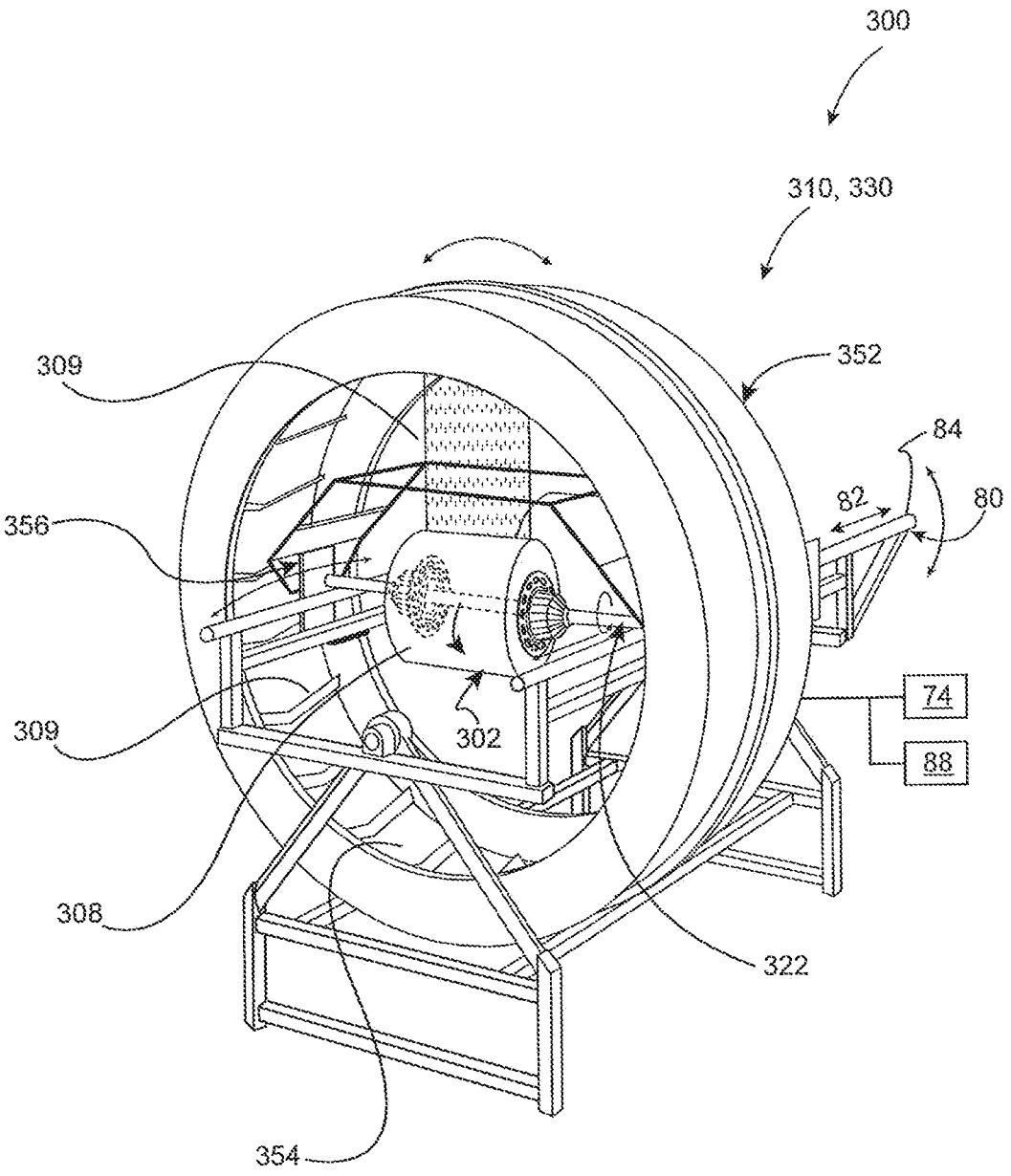
FIG. 30 is a perspective view of an embodiment of a stucco coating station as described herein.

The conduit 30 may be attached to the conduit system 32 with any suitable connection or coupling, including flexible or movable or adjustable couplings, such as by various conduits that allow movement of the conduit 30 relative to the conduit system 32. Flexible couplings 33 may, for example, include all manner of flexible hoses suitable to transport slurry fluid 14 and movable or adjustable fixtures, including movable or adjustable 3-axis fixtures or tables. The couplings 33 may also be movable or adjustable to enable translation or movement of conduit 30 along three mutually orthogonal directions or axes (e.g. x-y-z), or radial or pivoting movement about one end of the conduit 30, or a combination thereof. These couplings 33 enable adjustment of the conduit 30, outlet 20, and the slurry curtain 12 in any desired direction or angular orientation, particularly in a direction along the length or a longitudinal central axis of the curtain, relative to the fugitive pattern assembly 18 to be coated, and particularly relative to the longitudinal or sprue axis 26 of the fugitive pattern assembly. In one embodiment, the conduit 30, outlet 20, and the slurry curtain 12 may be positioned so that a longitudinal conduit axis 28 is substantially parallel, including parallel, to or co-planar with the sprue axis 26. In this embodiment, the conduit 30, outlet 20 and slurry curtain 12 are moveable about at least one axis of three mutually orthogonal axes by translation along the at least one axis. In this way, the conduit 30, outlet 20 and slurry curtain 12 can be flexibly positioned relative to the part to be coated. This includes movement to control the fore/aft position of the slurry curtain 12 relative to the fugitive pattern assembly 18 as it impacts the assembly; the side to side movement and positioning of the conduit 30, outlet 20 and slurry curtain 12 relative to the opposing ends of the fugitive pattern assembly 18, particularly the sprue portion of the pattern assembly, to allow centering or other adjustment of the slurry curtain 12 over the fugitive pattern assembly 18; as well movement to control the distance between the outlet 20 and the surface of the fugitive pattern assembly 18 and the height of the slurry curtain 12. In another embodiment, the conduit 30, outlet 20, and the slurry curtain 12 may be pivoted and positioned so that a longitudinal conduit axis 28 is not substantially parallel, including not parallel, to the sprue axis 26, such that the conduit 30, outlet 20, and slurry curtain 12 are disposed at an angle ($\alpha$) relative to the sprue axis 26. The angle may be any suitable angle, including an angle of about 0 to about 90 degrees in either direction, and more particularly about 1 to about 90 degrees in either direction, and even more particularly about 10 to about 80 degrees in either direction (e.g upward/downward). Angular pivoting movement may be combined with movement along orthogonal axes to provide great flexibility in how the slurry curtain 12 is positioned relative to the fugitive pattern assembly 18. This may be described in an embodiment as the outlet 20 and slurry curtain 12 being moveable about at least one axis of three mutually orthogonal axes by translation along the at least one axis, rotation about the at least one axis, or a combination thereof. The flexible coupling 33 may also enable rotation of the conduit 30 and outlet 20 about the conduit axis 28 to affect the radial location or position at which the slurry curtain exits the outlet 20. The angle ($\beta$) may be any suitable angle, including an angle of about 0 to about 180 degrees, and more particularly about 10 to about 170 degrees, and even more particularly about 45 to about 135 degrees. This enables the conduit 30, conduit axis 28, and slurry curtain 12 to be angled horizontally fore or forward or aft or rearward, or to be directed at any acute angle fore or aft, with reference to the sprue axis 26 or a direction of motion 29 of the assembly 302 in cases where the assembly is moved through the slurry station that includes conduit 30 (or any of apparatuses 10, 100, 200). The couplings 33, including flexible or movable or adjustable couplings, may be manually adjustable by a human operator, or may be automatically adjustable by employing various electromechanical linear actuators 70 or rotary actuators 72, or a combination thereof, that are operatively coupled to an electronic controller 74, such as a programmable microcontroller or computer. The programmable microcontroller or computer may include one or more computing systems that include any appropriate type of general purpose microprocessor, digital signal processor, microcontroller, dedicated hardware, transceiver (communicating over a communication channel as defined herein), or the like. The computing systems may further include or be connected to the random access memory (RAM), the read-only memory (ROM), a storage device, the network interface and the like. The computing systems may execute sequences of computer program instructions to perform various processes. The computer program instructions may be loaded into the RAM for execution by the processor from the ROM, from a communication channel (wired or wireless), from the storage device and/or the like. The storage device may include any appropriate type of storage provided to store any type of information that the control device may need to perform the processing. In the case of automated control of the adjustment or movement of the conduit 30, outlet 20 and slurry curtain 12, the adjustment or movement may be used as part of an initial setup prior to applying the wet coating layer and fixed during application of the layer. Alternately, the automated control of the adjustment or movement of the conduit 30, outlet 20 and slurry curtain 12 may also be employed to move the slurry curtain 12 while applying the wet coating layer. In one embodiment, the outlet 20 may comprise a single circular outlet that produces a substantially circular, including circular stream, of the slurry fluid 14 as slurry flow 22 and the conduit 30 and outlet 20 may be rapidly translated or shuttled back and forth along the conduit axis 28 such that the movement of the circular stream provides a partial or quasi slurry curtain 12 having a length that is substantially greater than the diameter of the stream (FIGS. 9-10). In this embodiment, the outlet 20 has an outlet opening 48, the conduit 30 is movable, and slurry flow 22 of the slurry fluid 14 through the outlet opening 48 and movement of the conduit 30 provides the slurry curtain 12. In addition to the movement or adjustment of the conduit 30, outlet 20 and slurry curtain 12 as described above, the fugitive pattern assembly 18 may also be movably positioned relative to the conduit 30, outlet 20 and slurry curtain 12 as described herein, including rotation, translation and angulation under the slurry curtain 12. In one embodiment, the conduit 30, outlet 20, and slurry curtain 12 are operatively coupled to an investment mold assembly conveyor 80. In an embodiment, the investment mold assembly conveyor 80 is configured to rotatably convey a refractory shell mold assembly and/or investment mold assembly 600 including the fugitive pattern assembly 18 under the slurry curtain 12 in a predetermined direction 82 (FIG. 30). In an embodiment, the predetermined direction 82 is substantially orthogonal to a plane defined by the slurry curtain 12. In another aspect, the predetermined direction 82 may have an angle equal to or less than 90 degrees or may be slanted to the plane defined by the slurry curtain 12. In one embodiment, the refractory shell mold assembly and/or the investment mold assembly 600 is rotatably disposed along a mold axis, such as sprue axis 26, and the mold axis is disposed substantially horizontally, including horizontally. As used herein, horizontally mean parallel to the surface of the earth, including the horizon, at that location.

Figure 12:
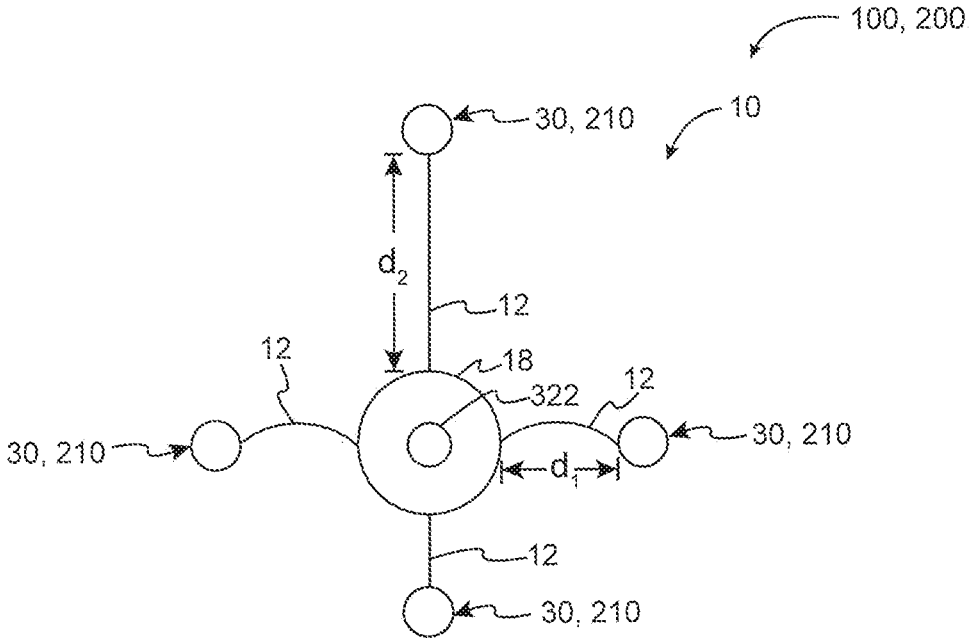
FIG. 12 is a schematic illustration of an embodiment of slurry coating apparatus 100 and conduits 30 spaced circumferentially about a removable mold pattern assembly.

The conduit 30 may be positioned as described herein circumferentially with reference to and relative to the fugitive pattern assembly 18 and sprue axis 26 at any predetermined circumferential location (e.g. from 0 to 360 degrees about the assembly) and predetermined radial spacing or distance (e.g. $d_1$ and $d_2$, where $d_2>d_1$) from the assembly (FIG. 12). For example, the conduit 30 may be positioned vertically above the fugitive pattern assembly 18 at a predetermined radial spacing or distance such that the slurry curtain 12 is directed downwardly at the fugitive pattern assembly 18 (e.g. at 0 degrees). Alternately, the conduit 30 may be positioned vertically below the fugitive pattern assembly 18 at a predetermined radial spacing or distance such that the slurry curtain 12 is directed upwardly at the fugitive pattern assembly 18 (e.g. at 180 degrees using the same circumferential point of reference as the previous example). In other embodiments, the conduit 30 may be positioned at any other predetermined circumferential position.

Figure 14B:
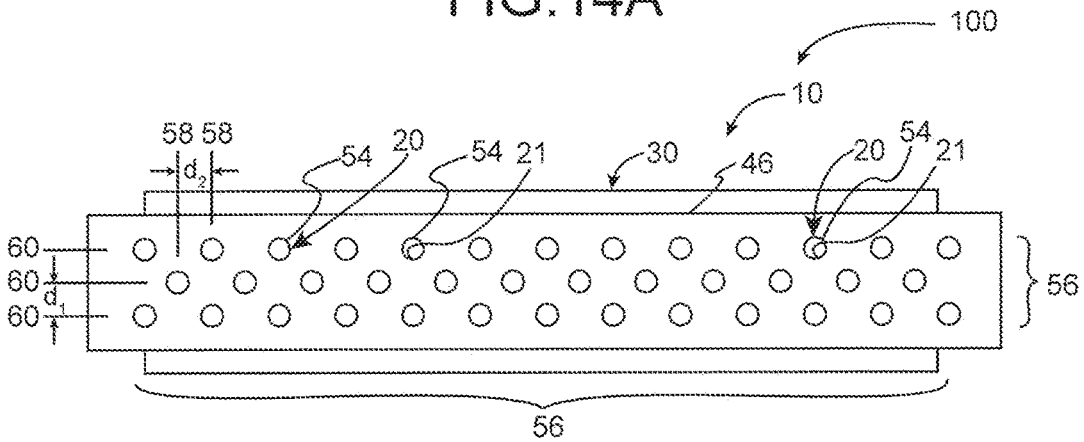

The conduit 30 includes an outlet 20 that may be incorporated into any suitable portion of the conduit 30, including at an end 36 or along the length 38 of the conduit. In one embodiment, the outlet 20 comprise a nozzle 46 disposed at an end of the conduit, wherein the nozzle 46 defines an outlet opening 48 that is configured to produce the slurry curtain 12 (FIGS. 13A-13C). The nozzle 46 may be formed from or have an interior surface that is lined with a material 50 selected to provide at least one of increased chemical resistance, increased abrasion resistance, or a reduced coefficient of friction, which may be the same materials as described above for liner material 44. The outlet opening 48 may include a plurality of openings 48. The opening 48 or openings 48 may have any suitable opening configuration that is configured to produce slurry curtain 12 as the slurry flow 22 exits the opening 48. In one embodiment, the outlet opening 48 of the nozzle 46 may be configured by being shaped to provide the slurry curtain 12, including as a slot 52 or a plurality of adjacent slots 52, which have a length that is substantially greater than a width. The slot or slots 52 may include any suitable configuration, including various rectangular and curved planar slot configurations, or a combination thereof. In one embodiment, the outlet opening 48 of the nozzle 46 may be configured by being shaped to provide the slurry curtain 12, including as a plurality of adjacent holes 54, which define a hole pattern 56 that has a length that is substantially greater than the width (FIGS. 14A-14B). The holes 54 may include any suitable pattern configuration, including various rectangular and curved planar pattern configurations, or a combination thereof. In one embodiment, the holes 54 may be arranged in a hole pattern 56 comprising a plurality of rows 58 and columns 60. In another embodiment, the hole pattern 56 may include a plurality of rows 58 and columns 60, wherein the holes of adjacent rows 58 and/or columns 60 are offset with respect to one another by a predetermined offset distance $d_1$ and $d_2$, where $d_1$ and $d_2$ may be the same or different.

In another embodiment, the nozzle 46 may include a transition section 62 that extends between the conduit 30 and the outlet 20 (FIG. 13C). The transition section 62 may include a transition chamber 64 that is configured to shape the slurry flow 22 prior to reaching the outlet 20 to enhance the slurry flow 22 within the slurry curtain 12. The transition chamber 64 may, for example, promote uniformity of the slurry flow 22 at the outlet 20 and within slurry curtain 12, which may in turn promote uniformity of the thickness (t) of the wet coating layer 16 as it is being applied to the mold pattern assembly 18. The transition section 62 and transition chamber 64 may have any suitable shape and size. Uniformity of the thickness of the wet coating layer 16 is very advantageous as it relates directly to the thickness of the plurality of the dried coating layers that ultimately constitute the mold wall of the refractory molds described herein. Uniformity of the mold wall thickness is advantageous as it directly or indirectly affects the heating and cooling of the mold wall in preparation for and during casting of articles within the refractory molds, and the resultant microstructure and properties of the cast articles.

Figure 15:
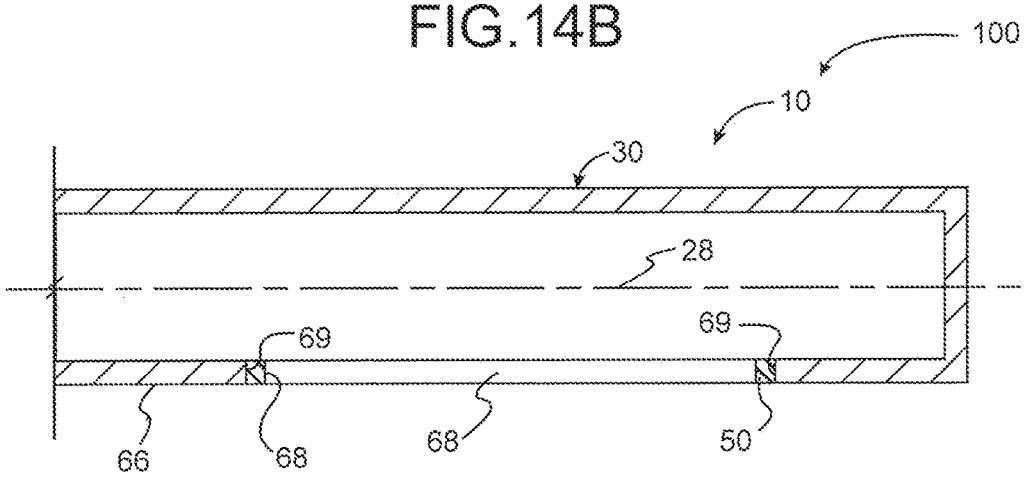
FIG. 15 is a cross-sectional view of another embodiment of slurry coating apparatus 100 along the length of conduit 30 with an insert 68 as disclosed herein.
Figure 16:
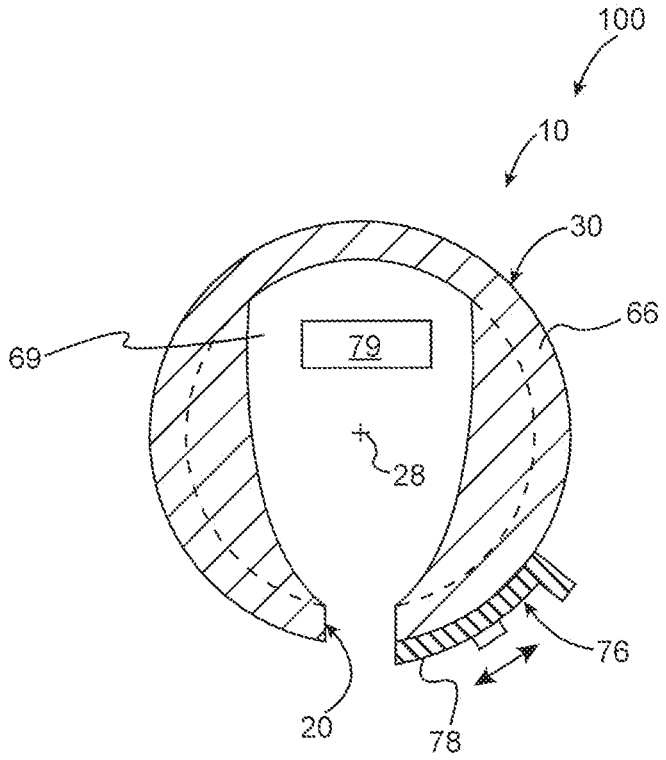
FIG. 16 is a lateral cross-sectional view of another embodiment of slurry coating apparatus 100 and conduit 30 with an chamber 69 as disclosed herein.

In certain embodiments (e.g. FIG. 11), the outlet 20 comprises an integral portion of the conduit 30 and is disposed along the length 38 of the conduit 30. The outlet 20 includes an outlet opening 48 that is configured to produce the slurry curtain 12. The outlet 20 may simply include an opening or a plurality of openings 48 in a wall 66 of the conduit 30. Alternately, the opening 48 may be defined by an insert 68 disposed in the wall 66 of the conduit 30 (FIG. 15). The insert 68 is disposed in an insert opening 69 that is configured to receive the insert. In one embodiment, the insert 68 may be permanently affixed or attached to the conduit 30. Alternately, the insert 68 may be configured such that it is selectively insertable into and removable from the insert opening 69. The insert 68 may be formed from the same material as conduit 30. Alternately, the insert 68 may be formed from or have an interior surface that is lined with a material 50 selected to provide at least one of increased chemical resistance, increased abrasion resistance, or a reduced coefficient of friction, which may be the same materials as described above for liner material 44. In one aspect, the insert material has greater abrasion resistance to the slurry than the manifold material. The outlet opening 48 may include a plurality of openings 48. The opening or orifice 48 or openings or orifices 48 may have any suitable opening configuration that is configured to produce slurry curtain 12 as the slurry flow 22 exits the opening. In one embodiment, the outlet opening 48 of the insert 68 may be configured by being shaped to provide the slurry curtain 12, including as a slot 52 or a plurality of adjacent slots 52 (FIG. 13B), which have a length that is substantially greater than a width. In one embodiment, a slot 52 may include a plurality of spaced strengthening or reinforcing ribs 53 extending across and bridging the slot 52 and thereby defining a plurality of adjacent slots 52. The ribs 53 may be utilized, for example, to maintain the width of the slot along its length and prevent distortion of the slot width by the fluid pressure of slurry flow 22, and thereby maintain the shape and consistency of the width of the slurry curtain 22 along its length. The slot or slots 52 may include any suitable configuration, including various rectangular and curved planar slot configurations, or a combination thereof. In one embodiment, the outlet opening 48 of the nozzle 46 may be configured by being shaped to provide the slurry curtain 12, including as a plurality of adjacent holes 54, which define a hole pattern 56 that has a length that is substantially greater than the width. The holes 54 may include any suitable pattern configuration, including various rectangular and curved planar pattern configurations, or a combination thereof. In one embodiment, the holes 54 may be arranged in a hole pattern 56 including a plurality of rows 58 and columns 60. In another embodiment, the hole pattern 56 may include a plurality of rows 58 and columns 60, wherein the holes of adjacent rows 58 and/or columns 60 are offset with respect to one another by a predetermined offset distance $d_1$ and $d_2$, where $d_1$ and $d_2$ may be the same or different. The size and shape of the outlet opening 48 whether integral with the conduit or defined by the insert 68 may be fixed, or may be adjustable. In the case of fixed openings 48 in the conduit 30 or an insert 68 that defines opening 48, the size and shape may be adjusted by incorporation of a separate adjustment mechanism 76, such as a movable shutter 78 (FIG. 16), including a shutter that is movably disposed on the conduit 30 to control the length or the width of the opening, or a combination thereof. In the case of an insert 68, a portion of the insert 68 may be adjustable to define the size and shape of the opening 48, including the length or the width, or a combination thereof. In one embodiment, the adjustment mechanism 76 may also be configured to selectively open or close the outlet 20. Alternately, a valve mechanism 79 (FIG. 16) may be disposed in or on conduit 30 proximate outlet 20 to selectively open or close the outlet 20.

The conduit 30 may include a conduit chamber 69 in the portion of the conduit adjacent to the outlet 20 and/or insert 68 that is configured to shape the slurry flow 22 prior to reaching the outlet 20 to enhance the slurry flow 22 within the slurry curtain 12. The conduit chamber 69 may, for example, be shaped (e.g. narrowed or restricted, or in some embodiments broadened) to promote uniformity or enhance the flow rate of the slurry flow 22 at the outlet 20 and within slurry curtain 12, which may in turn promote uniformity of the thickness (t) of the wet coating layer 16 as it is being applied to the mold pattern assembly 18. The conduit chamber 69 may have any suitable shape and size. Uniformity of the thickness of the wet coating layer 16 is very advantageous as explained herein.

In one embodiment, the conduit system 32 and conduit 30 may be configured to deliver the slurry flow 22 of slurry fluid 14 to the outlet 20 such that it is configured to dispense the slurry curtain 12 as a gravity slurry curtain. In other words, the slurry flow 22 may be provided through the conduit system 32 and conduit 30 where it exits the outlet 20 as a slurry curtain by the force of gravity. The conduit system 32 and conduit 30, as well as outlet 20, including outlet opening 48 or openings 48 may be selected to deliver slurry fluid 14 by gravity at a predetermined flow rate. The predetermined flow rate may be any suitable predetermined flow rate to achieve the desired slurry curtain 12 characteristics, or to provide the desired amount of material at the surface 24 of the fugitive pattern assembly 18, or in the case of second or subsequent wet coating layers 16, a previously deposited coating layer that has been deposited on the fugitive pattern assembly 18. The predetermined flow rate may also be a function of the size of the fugitive pattern assembly 18, including the surface area thereof. In one embodiment, the predetermined flow rate may be at least about 0.5 gallons/minute, including a range of about 0.5 to about 20 gallons/minute, and more particularly about 1 to about 5 gallons/minute. In one embodiment, the predetermined flow rate may be selected to achieve a predetermined coating layer thickness of the wet coating layer 16 being deposited or disposed on the fugitive pattern assembly 18. The predetermined flow rate should be high enough to provide sufficient slurry fluid 14 at the surface to achieve the predetermined coating layer thickness but not so high as to prevent the establishment of the wet coating layer 16 or disrupt or erode previously deposited portions of the wet coating layer 16, such as, for example, as the fugitive mold pattern assembly 18 is rotated under the slurry curtain 12 and previously deposited portions of the wet coating layer 16 are rotated under the slurry curtain 12.

In another embodiment, the conduit system 32 and conduit 30 may be configured to deliver the slurry flow 22 as a pressurized flow of slurry fluid 14 to the outlet 20 such that it is configured to dispense the slurry curtain 12 as a pressurized slurry curtain 12. In other words, the slurry flow 22 may be provided through the conduit system 32 and conduit 30 where it exits the outlet 20 as a slurry curtain 12 under pressure. The pressurized flow of slurry fluid 14 may be produced by using a suitable slurry pump 37 to pump the slurry fluid 14 through the conduit system 32 and conduit 30 (e.g. FIG. 11). When the slurry flow 22 comprises a pressurized slurry flow, any suitable fluid pressure may be utilized to achieve a predetermined flow rate of the slurry flow 22 from the outlet 20. In one embodiment, the fluid pressure may be in a range of 0.5 to 50 psig, and more particularly 1 to 25 psig.

Figure 11:
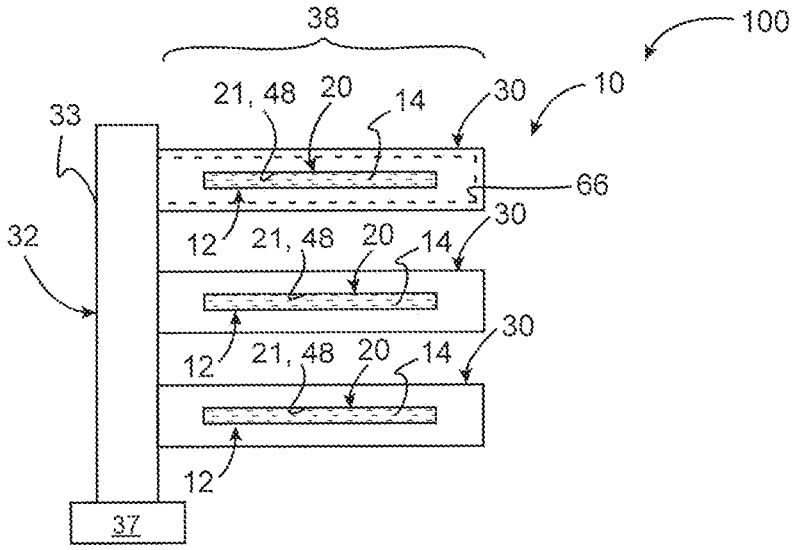
FIG. 11 is a front view of another embodiment of slurry coating apparatus 100 including a plurality of conduits and slurry curtain as disclosed herein.

In one embodiment, the conduit 30 comprises a plurality of conduits 30 that are operatively connected to the conduit system 32 for fluid communication of the slurry flow 22 and slurry fluid 14, and the outlet 20 includes a plurality of outlets 20 corresponding to the conduits 30 that are configured to receive a corresponding plurality of slurry flows 22 of the slurry fluid 14 to dispense the flows of the slurry as corresponding slurry curtains 12 (FIG. 11). The plurality of conduits 30 may all be coupled with couplings 33 as described herein such that they may be fixed or movable relative to one another either during setup prior to depositing the respective wet coating layers 16 or during the deposition of the respective wet coating layers 16. The conduits 30 may be configured and used to incorporate a plurality of slurry curtains 12 within a single slurry coating station as described herein. Alternately, the conduits 30 may be used to incorporate a plurality of slurry curtains 12 into a plurality of slurry coating stations, including providing one or a plurality of slurry curtains 12 into a plurality of slurry coating stations. Coating with the investment mold slurry coating apparatus 100 may be carried out in air, vacuum and/or controlled environment.

Investment Mold Slurry Coating Manifold Apparatus

Figure 17A:
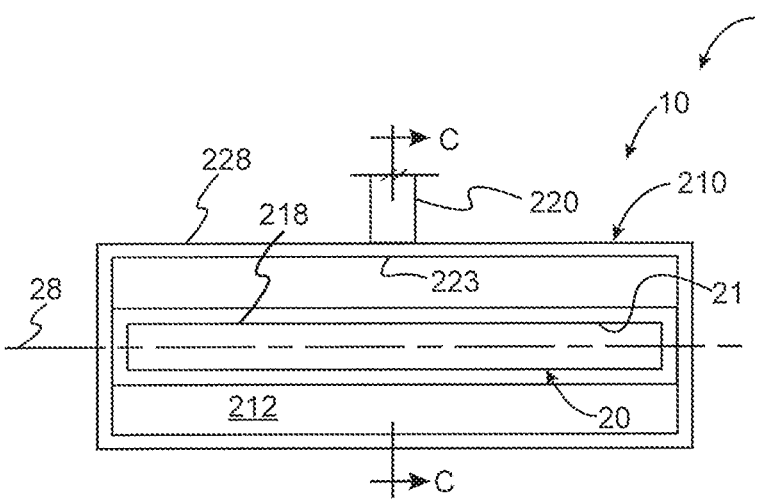
FIG. 17A-17C are a top, side, and cross-sectional view along section C-C, respectively, of an embodiment of slurry coating manifold apparatus 200 as disclosed herein.
Figure 17B:
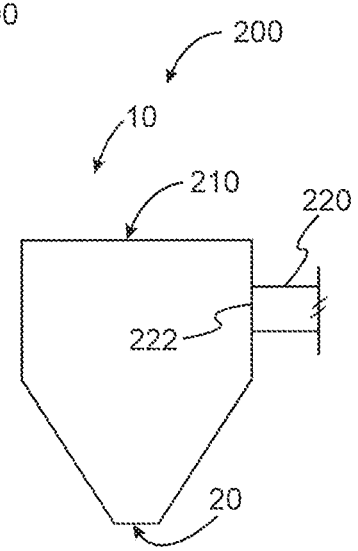
Figure 17C:
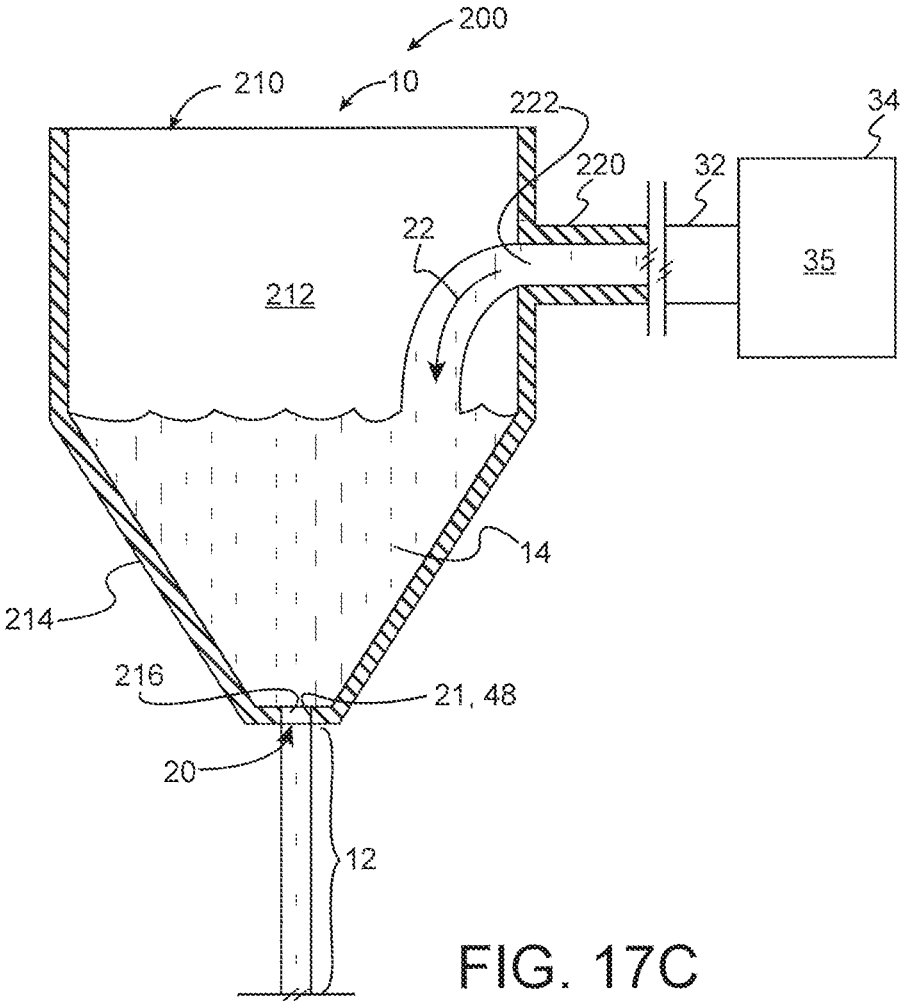

In another embodiment of a slurry coating apparatus, an investment mold slurry coating manifold apparatus 200 includes a slurry manifold 210 having a slurry chamber 212 configured to receive the slurry flow 22 of the slurry fluid 14 as shown in FIGS. 17A-17C. In one aspect, the investment mold slurry coating manifold apparatus 200 includes or is operatively connected to an investment mold slurry curtain apparatus 10 and/or an investment mold slurry coating apparatus 100. The apparatus 200 also includes an inlet conduit 220 disposed on the slurry manifold 210, which has an inlet opening 223 into the slurry chamber 212. The inlet conduit 220 is configured to provide the slurry flow 22 into the slurry chamber 212. The apparatus 200 also includes an outlet 20 that is configured to dispense a slurry curtain 12, as described herein.

Figure 18A:
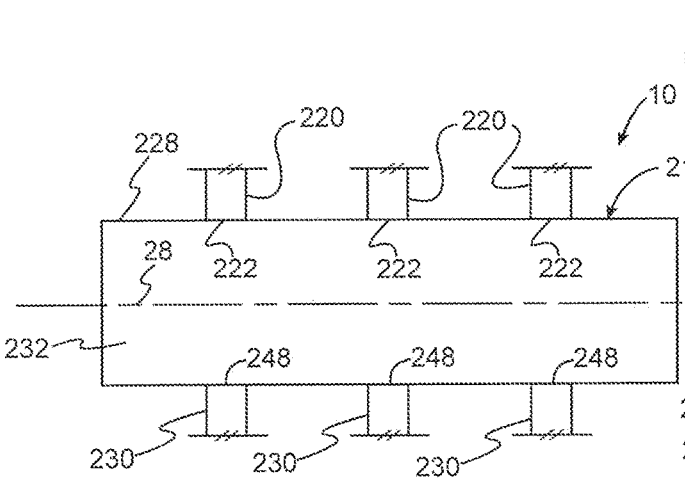
FIG. 18A-18B are a top and side view of another embodiment of slurry coating manifold apparatus 200 as disclosed herein.
Figure 18B:
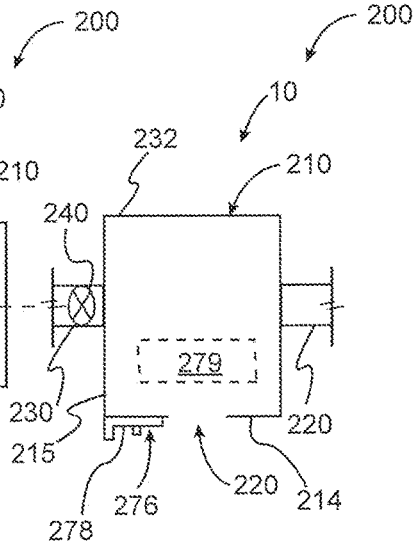

In one embodiment, the investment mold slurry coating manifold apparatus 200 may be similar to investment mold slurry coating apparatus 100, such as where the slurry manifold 210 includes a conduit 30 with a single inlet conduit 220 to provide the slurry fluid 14 (FIGS. 17A-17C). In other embodiments, the investment mold slurry coating manifold apparatus 200 includes a plurality of inlet conduits 220 to supply a plurality of slurry fluids 14 or other fluids or a plurality of outlet conduits 230, or both (FIGS. 18A, 18B). In addition, the slurry manifold 210 may be configured (e.g. by adjusting the flow rate) other than as a conduit 30 that generally dispenses the slurry flow 22 received such that it may accumulate a portion of slurry fluid 14 and maintain slurry flow 22 through the outlet 20 even if the supply or flow of slurry fluid 14 through the inlet conduit 220 to the manifold is interrupted momentarily or for a short period of time.

In one embodiment, an investment mold slurry coating manifold apparatus 200 includes a slurry manifold 210 configured to receive the slurry flow 22 of the slurry fluid 14 and an outlet 20 operatively coupled to the manifold 210 as illustrated in FIGS. 17A-17C. In this embodiment, the investment mold slurry coating manifold apparatus 200 combines the slurry manifold 210, inlet conduit 220, and outlet 20 and the outlet 20 is configured to dispense the slurry flow 22 of the slurry fluid 14 as slurry curtain 12, as described herein. In this embodiment, a conduit system 32, which is generally used to convey the slurry fluid 14 from a tank, vat, mixer, or similar device that may be used to prepare the slurry fluid from its constituents or store the slurry fluid 14 once it has been prepared, or a combination thereof, or any other suitable source 35 of slurry fluid 14, is used to convey the slurry flow 22 to the inlet conduit 220 into the slurry manifold 210 that includes the outlet 20 for dispensing the flow of slurry fluid 14 as slurry curtain 12. In one embodiment, the slurry manifold 210 advantageously may be used to accumulate slurry fluid 14 so that it can be dispensed from the outlet 20. The outlet 20 may be incorporated into any suitable portion of the slurry manifold 210. In one embodiment, the outlet 20 may be disposed on the bottom 214 of the slurry manifold 210 and include an outlet opening 248 that has an opening shape 218 configured to provide the shapes of the slurry curtain 12 described herein. In the case of outlet 20 disposed in the bottom 214, the bottom may be a flat bottom. The bottom 214 may also be tapered downwardly to promote the slurry flow 22 through the outlet 20 and prevent the possibility of accumulation of non-flowing, still or stagnant slurry fluid 14 adjacent to the outlet 20 as shown in FIGS. 17A-17C. In other embodiments, the outlet 20 may be disposed along a side opening 222 or a top edge 224 of the slurry manifold 210 where it has an outlet lip or edge 226 configured to provide the shapes of the slurry curtain 12 described herein. The outlet edge 226 may protrude outwardly away from the side opening 222 or top edge 224 a predetermined distance sufficient to allow the slurry flow 22 to cascade freely as slurry curtain 12 and prevent the slurry curtain 12 from running down the side 222 of the slurry manifold 210.

Figure 19:
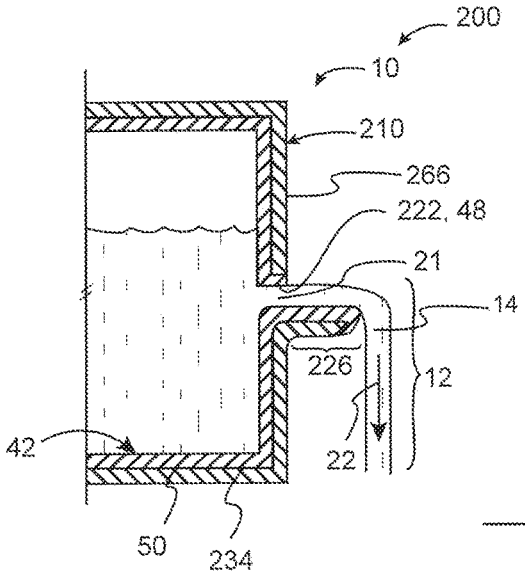
FIG. 19 is a partial cross-sectional view of another embodiment of slurry coating manifold apparatus 200 and side opening 222 as disclosed herein.

The slurry manifold 210 may have size or shape, including cross-sectional shape. In one embodiment, the slurry manifold 210 may comprise an elongated enclosure 228 (e.g. FIG. 18A), including an elongated box, tube or trough having a width and a length that is substantially greater than the width. The length may be any suitable length, including a length sufficient to include the desired outlet 20. The elongated enclosure 228 may have any suitable cross-sectional shape, including various semi-circular, rectangular, and rounded rectangular cross-sectional shapes, including square and rounded square cross-sectional shapes. In one embodiment, the elongated enclosure 228 may have a top side 232 that is open like a trough (FIG. 17A). In other embodiments the top side 232 may be closed, or partially closed (FIG. 18B). Closed or partially close top sides 232 are advantageous in that they reduce the possibility of extraneous or contaminant materials from being introduced into the slurry chamber 212 and slurry fluid 14. The slurry manifold 210 have a circular cross-section or square cross-section with any suitable diameter, including a width of about 0.25 in. to about 12 in., and more particularly about 1 in. to about 3 in. The slurry manifold 210 may be formed from any suitable material, including the materials described herein for use with conduit 30. The slurry manifold 210 may be rigid or flexible. The slurry manifold 210 may also be lined on an inner surface 234 with a liner 42 as described herein as shown in FIG. 19.

The slurry manifold 210 and inlet conduit 220 may be attached to the conduit system 32 with any suitable connection or coupling, including flexible or movable or adjustable couplings, such as by various conduits that allow movement of the conduit 30 relative to the conduit system. The inlet conduit 220 may comprise this coupling. Flexible couplings may, for example, include all manner of flexible hoses suitable to transport slurry fluid 14 and movable or adjustable fixtures, including movable or adjustable 3-axis fixtures or tables. The couplings may also be movable or adjustable to enable translation or movement along three mutually orthogonal directions or axes (e.g. x-y-z), or radial or pivoting movement about one end of the conduit 30, or a combination thereof. These couplings enable adjustment of the slurry manifold 210, outlet 20, and the slurry curtain 12 in any desired direction or angular orientation, particularly in a direction along the length or a longitudinal central conduit axis 28 of the manifold, relative to the fugitive pattern assembly 18 to be coated, and particularly relative to the longitudinal or sprue axis 26 of the fugitive pattern assembly. The slurry manifold 210, outlet 20, and the slurry curtain 12 may be positioned, moved, pivoted, rotated and otherwise adjusted in the same manner described above with regard to the conduit 30, including incorporation of automated control. In one embodiment, the outlet 20 may comprise a single circular outlet that produces a substantially circular, including circular stream, of the slurry fluid 14 as slurry flow 22 and the slurry manifold 210 and outlet 20 may be rapidly translated or shuttled back and forth along the conduit axis 28 such that the movement of the circular stream provides a partial or quasi slurry curtain 12 as described above for conduit 30. In addition to the movement or adjustment of the slurry manifold 210, outlet 20 and slurry curtain 12 as described above, the fugitive pattern assembly 18 may also be movably positioned relative to the slurry manifold 210, outlet 20 and slurry curtain 12 as described herein, including rotation, translation and angulation under the slurry curtain 12. In one embodiment, the slurry manifold 210, outlet 20, and slurry curtain 12 are operatively coupled to an investment mold assembly conveyor 80. In an embodiment, the investment mold assembly conveyor 80 is configured to rotatably convey a refractory shell mold assembly and/or an investment mold assembly 600 including the fugitive pattern assembly 18 under the slurry curtain 12 in a predetermined direction 82. In an embodiment, the predetermined direction 82 is substantially orthogonal to a plane defined by the slurry curtain 12. In one embodiment, the refractory shell mold assembly and/or the investment mold assembly 600 is rotatably disposed along a mold axis, such as sprue axis 26, and the mold axis is disposed substantially horizontally, including horizontally. As used herein, horizontally mean parallel to the surface of the earth, including the horizon, at that location.

The slurry manifold 210 may also be positioned as described herein circumferentially with reference to and relative to the fugitive pattern assembly 18 and sprue axis 26 at any predetermined circumferential location (e.g. from 0 to 360 degrees about the assembly) and predetermined radial spacing or distance from the assembly, as shown in FIG. 12. For example, the slurry manifold 210 may be positioned vertically above the fugitive pattern assembly 18 at a predetermined radial spacing or distance such that the slurry curtain 12 is directed downwardly at the fugitive pattern assembly 18 (e.g. at 0 degrees). Alternately, the slurry manifold 210 may be positioned vertically below the fugitive pattern assembly 18 at a predetermined radial spacing or distance such that the slurry curtain 12 is directed upwardly at the fugitive pattern assembly (e.g. at 180 degrees using the same circumferential point of reference as the previous example). In other embodiments, the slurry manifold 210 may be positioned at any other predetermined circumferential position.

Figure 20:
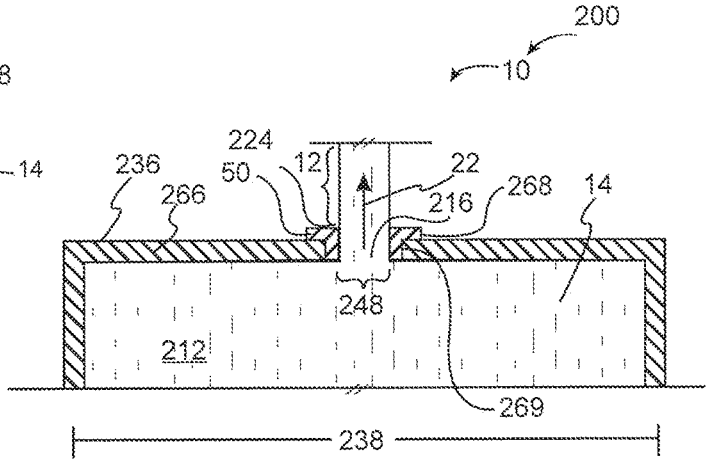
FIG. 20 is a partial cross-sectional view of another embodiment of slurry coating manifold apparatus 200 and top opening 216 as disclosed herein.

In certain embodiments, the outlet 20 and an outlet opening 248 may be incorporated directly into the slurry manifold 210 as described above on the bottom 214, as a side opening 222, or a top edge 224. In an embodiment where the slurry manifold 210 and slurry flow 22 are pressurized, the outlet opening 248 may alternately also be incorporated in the top 236 of the slurry manifold 210, such that the slurry curtain 12 is projected upwardly toward the fugitive pattern assembly 18 (FIG. 20). In these embodiments, the outlet 20 comprises an integral portion of the slurry manifold 210 and is disposed along the length 238 of the slurry manifold 210. The outlet 20 includes an outlet opening 248 that is configured to produce the slurry curtain 12. The outlet 20 may simply include an opening 216 or a plurality of openings 216 in the respective wall 266 of the slurry manifold 210. Alternately, the opening 216 may be defined by an insert 268 disposed in the wall 266 of the slurry manifold 210. The insert 268 is disposed in an insert opening 269 that is configured to receive the insert. In one embodiment, the insert 268 may be permanently affixed or attached to the slurry manifold 210. Alternately, the insert 268 may be configured such that it is selectively insertable into and removable from the insert opening 269. The insert 268 may be formed from the same material as slurry manifold 210. Alternately, the insert 268 may be formed from or have an interior surface that is lined with a material 50 selected to provide at least one of increased chemical resistance, increased abrasion resistance, or a reduced coefficient of friction, which may be the same materials as described above for liner material 44. The outlet opening 248 may include a plurality of openings 248. The opening or orifice 248 or openings or orifices 248 may have any suitable opening configuration that is configured to produce slurry curtain 12 as the slurry flow 22 exits the opening. In one embodiment, the outlet opening 248, whether in the wall 266 or the insert 268 may be configured by being shaped to provide the slurry curtain 12 in the same way as described above regarding opening 48 in wall 66 or insert 68, including as a slot 52 or a plurality of adjacent slots 52, which have a length that is substantially greater than a width. The slot or slots 52 may include any suitable configuration, including various rectangular, arcuate, and curved planar slot configurations, or a combination thereof. In one embodiment, the outlet opening 248 may be configured by being shaped to provide the slurry curtain 12, including as a plurality of adjacent holes 54, which define a hole pattern 56 that has a length that is substantially greater than the width. The holes 54 may include any suitable pattern configuration, including various rectangular and curved planar pattern configurations, or a combination thereof. In one embodiment, the holes 54 may be arranged in a hole pattern 56 comprising a plurality of rows 58 and columns 60. In another embodiment, the hole pattern 56 may include a plurality of rows 58 and columns 60, wherein the holes of adjacent rows 58 and/or columns 60 are offset with respect to one another by a predetermined offset distance $d_1$ and $d_2$, where $d_1$ and $d_2$ may be the same or different. The size and shape of the outlet opening 248 whether integral with the slurry manifold 210 or defined by the insert 268 may be fixed, or may be adjustable. In the case of fixed openings 248 in the slurry manifold 210 or an insert 268 that defines opening 248, the size and shape may be adjusted by incorporation of a separate adjustment mechanism 276, such as a movable shutter 278, including a shutter that is movably disposed on the slurry manifold 210 to control the length or the width of the opening, or a combination thereof. In the case of an insert 268, a portion of the insert may be adjustable to define the size and shape of the opening 248, including the length or the width, or a combination thereof. In one embodiment, the adjustment mechanism 276 may also be configured to selectively open or close the outlet 20. Alternately, a valve mechanism 279 may be disposed in slurry manifold 210 proximate outlet 20 to selectively open or close the outlet 20 (FIG. 18B).

In certain other embodiments, the outlet 20 of slurry manifold 210 may be incorporated into or disposed on one or more outlet conduits 230 that are operably attached to the wall 266 on one or more of the bottom 214, side 215, or an enclosed top side 232, or a combination thereof in flow communication so as to receive slurry flow 22. The outlet conduits 230 may incorporate outlet 20 in the same manner as described above with regard to conduit 30 including incorporation into any suitable portion of the conduit 30, including at an end 36 or along the length 38 of the conduit. The outlet conduits 230 may be configured and used to incorporate a plurality of slurry curtains 12 within a single slurry coating station as described herein. Alternately, the outlet conduits 230 may be used to incorporate a plurality of slurry curtains 12 into a plurality of slurry coating stations, including providing one or a plurality of slurry curtains 12 into a plurality of slurry coating stations. In the case of the plurality of outlet conduits 230 and conduits 30, the outlet conduits and/or conduits may be fixed or movable. Movable outlet conduits 230 and/or conduits 230 may be used to flexibly position the associated plurality of outlets 20 and slurry curtains 12 with regard to the mold pattern assembly 302.

In one embodiment, the conduit system 32 and slurry manifold 210, including any outlet conduits 230, may be configured to deliver the slurry flow 22 of slurry fluid 14 to the outlet 20 such that it is configured to dispense the slurry curtain 12 as a gravity slurry curtain (FIGS. 17A-17C). In other words, the slurry flow 22 may be provided through the conduit system 32 and slurry manifold 210, including any outlet conduit 230, where it exits the outlet 20 as a slurry curtain by the force of gravity. The conduit system 32 and slurry manifold 210, as well as outlet 20, including outlet opening 248 or openings 248 may be selected to deliver slurry fluid 14 by gravity at a predetermined flow rate. The predetermined flow rate may be any suitable predetermined flow rate to achieve the desired slurry curtain 12 characteristics, or to provide the desired amount of material at the surface 24 of the fugitive pattern assembly 18, or in the case of second or subsequent wet coating layers 16, a previously deposited coating layer that has been deposited on the fugitive pattern assembly 18. The predetermined flow rate may also be a function of the size of the fugitive pattern assembly 18, including the surface area thereof. In one embodiment, the predetermined flow rate may be at least about 0.5 gallons/minute, including a range of about 0.5 to about 20 gallons/minute, and more particularly about 1 to about 5 gallons/minute. Where a plurality of outlet conduits 230 are employed, the predetermined flow rate in each conduit may be controlled individually, such as by the use of a selectively openable and closable valves 240 operably disposed in flow communication in the respective outlet conduits, and the predetermined flow rates through the respective outlet conduits may be different. In one embodiment, the predetermined flow rate may be selected to achieve a predetermined coating layer thickness of the wet coating layer 16 being deposited or disposed on the fugitive pattern assembly 18. The predetermined flow rate should be high enough to provide sufficient slurry fluid 14 at the surface to achieve the predetermined coating layer thickness but not so high as to prevent the establishment of the wet coating layer 16 or disrupt or erode previously deposited portions of the wet coating layer 16, such as, for example, as the fugitive mold pattern assembly 18 is rotated under the slurry curtain 12 and previously deposited portions of the wet coating layer 16 are rotated under the slurry curtain 12.

In another embodiment, the conduit system 32 and slurry manifold 210, including any outlet conduits 230, may be configured to deliver the slurry flow 22 as a pressurized flow of slurry fluid 14 to the outlet 20 such that it is configured to dispense the slurry curtain 12 as a pressurized slurry curtain (FIG. 20). In other words, the slurry flow 22 may be provided through the conduit system 32 and slurry manifold 210, including any outlet conduits 230, where it exits the outlet 20 as a slurry curtain 12 under pressure. The pressurized flow of slurry fluid 14 may be produced by using a suitable slurry pump to pump the slurry fluid through the conduit system 32 and slurry manifold 210. When the slurry flow 22 comprises a pressurized slurry flow, any suitable fluid pressure may be utilized to achieve a predetermined flow rate of the slurry flow 22 from the outlet 20. In one embodiment, the fluid pressure comprises 0.5 to 50 psig, and more particularly 1 to 25 psig. Where a plurality of outlet conduits 230 are employed, the predetermined flow rate and fluid pressure in each conduit may be controlled individually, such as by the use of a selectively openable and closable valves 240 operably disposed in flow communication in the respective outlet conduits, and the predetermined flow rates and fluid pressures through the respective outlet conduits may be different.

In one embodiment, the slurry manifold 210 comprises a plurality of slurry manifolds that are operatively connected to the conduit system 32 for fluid communication of the slurry flow 22 and slurry fluid 14 and the outlet 20 comprises a plurality of outlets 20 corresponding to the manifolds that are configured to receive a corresponding plurality of slurry flows 22 of the slurry fluid 14 to dispense the flows of the slurry as corresponding slurry curtains 12. The plurality of slurry manifold 210 may all be coupled with couplings as described herein such that they may be fixed or movable relative to one another either during setup prior to depositing the respective wet coating layers 16 or during the deposition of the respective wet coating layers 16.

In one embodiment, slurry manifold 210 comprises a plurality of slurry manifolds 210 having a corresponding plurality of slurry chambers 212. In one embodiment, the plurality of slurry manifolds 210 may be configured together to provide a plurality of slurry curtains 12 in a single slurry coating station. The slurry manifolds 210 may be arranged to provide serial (FIG. 22) or parallel (FIG. 21) flow communication of the slurry fluid 14 and slurry flow 22. In a serial arrangement, a first slurry manifold 210 is in flow communication with the conduit network 32 and the other slurry manifolds 210 are sequentially in flow communication through their inlet conduits 220 with the first slurry manifold 210. Alternately, in a parallel arrangement, all of the slurry manifolds 210 are in flow communication through their inlet conduits 220 with the conduit system 32 to a source of slurry fluid 14.

Figure 21:
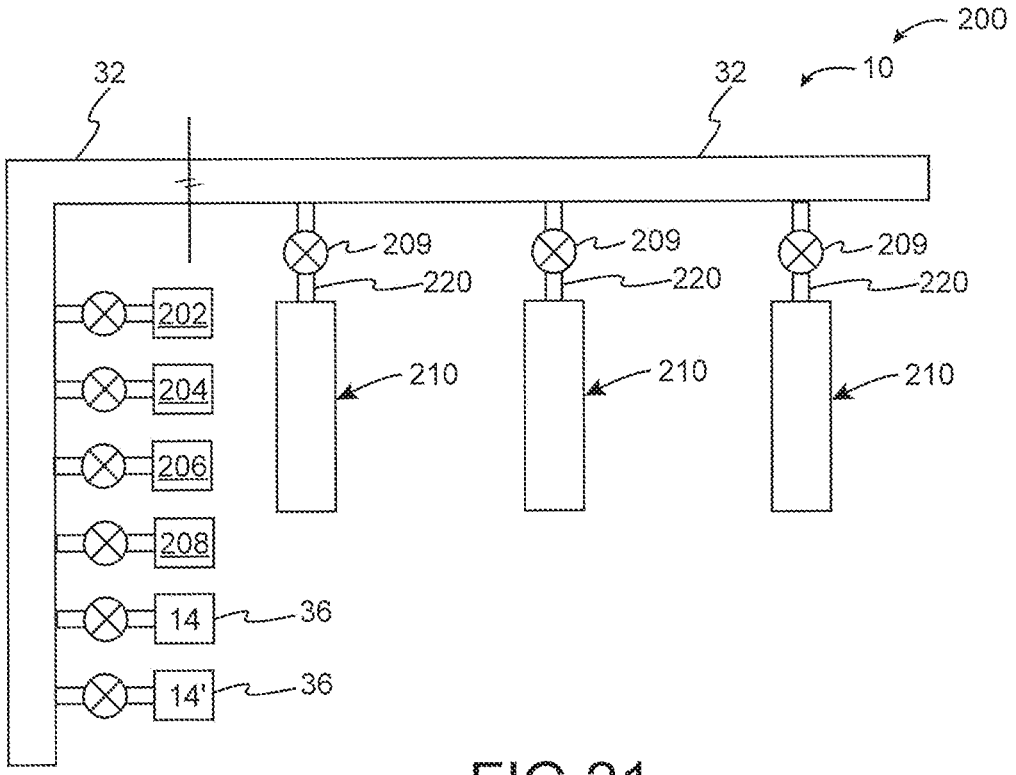
FIG. 21 is a top view of another embodiment of slurry coating manifold apparatus 200 and parallel connection of manifolds as disclosed herein.
Figure 22:
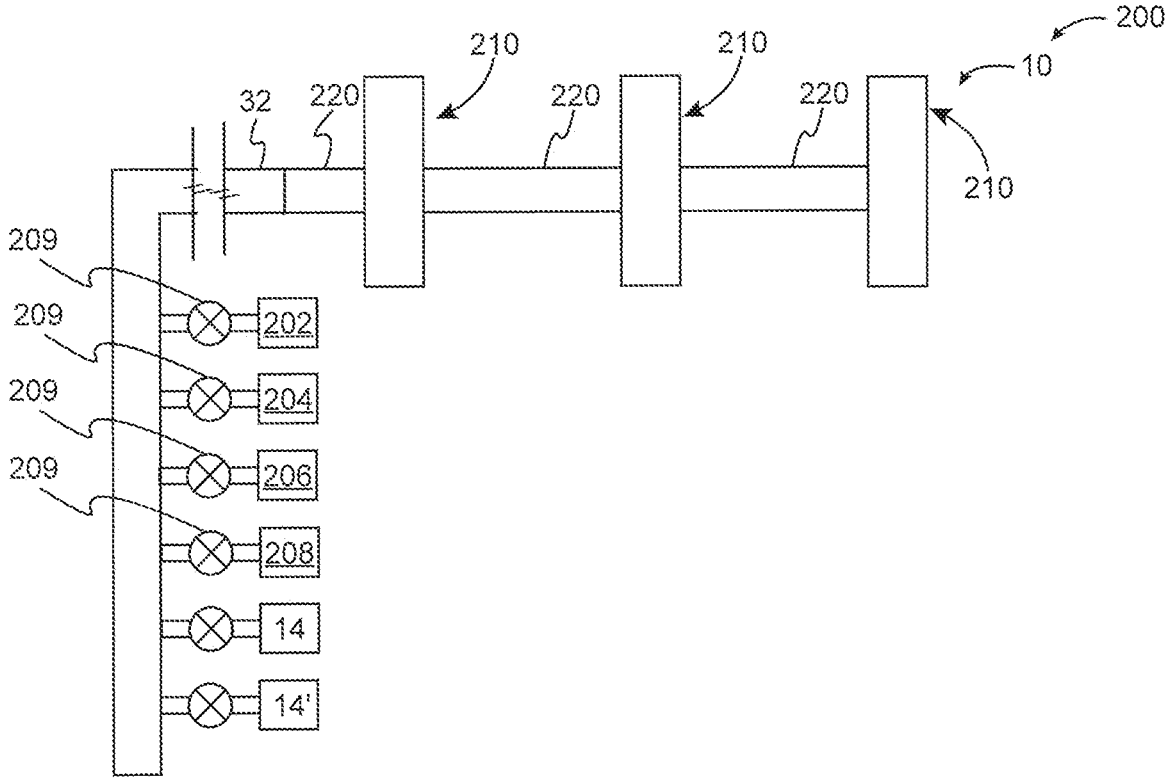
FIG. 22 is a top view of another embodiment of slurry coating manifold apparatus 200 and serial connection of manifolds as disclosed herein.
Figure 23:
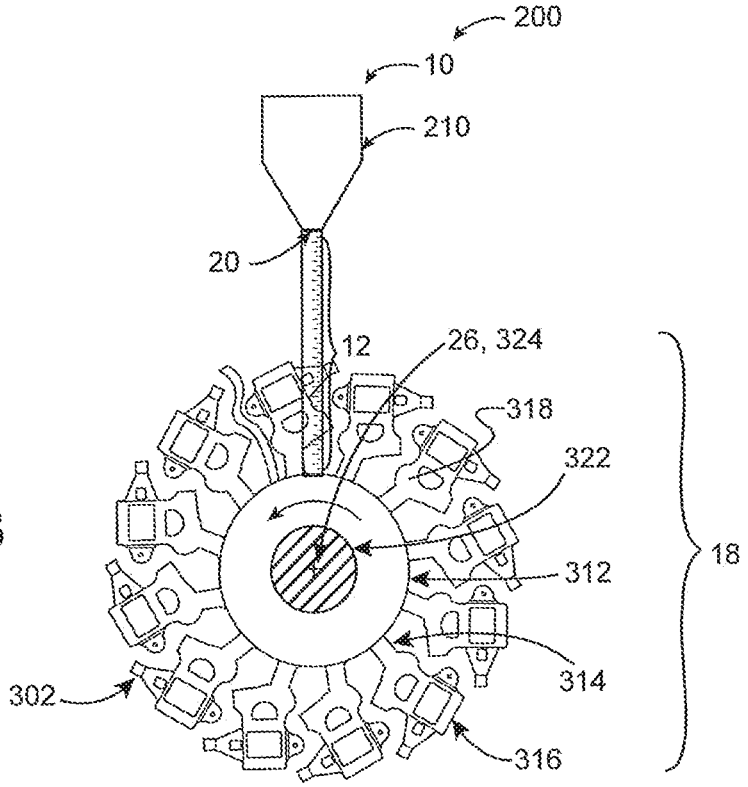
FIG. 23 is a schematic cross-sectional view of an embodiment of an investment mold pattern assembly 302 as described herein.
Figure 24:
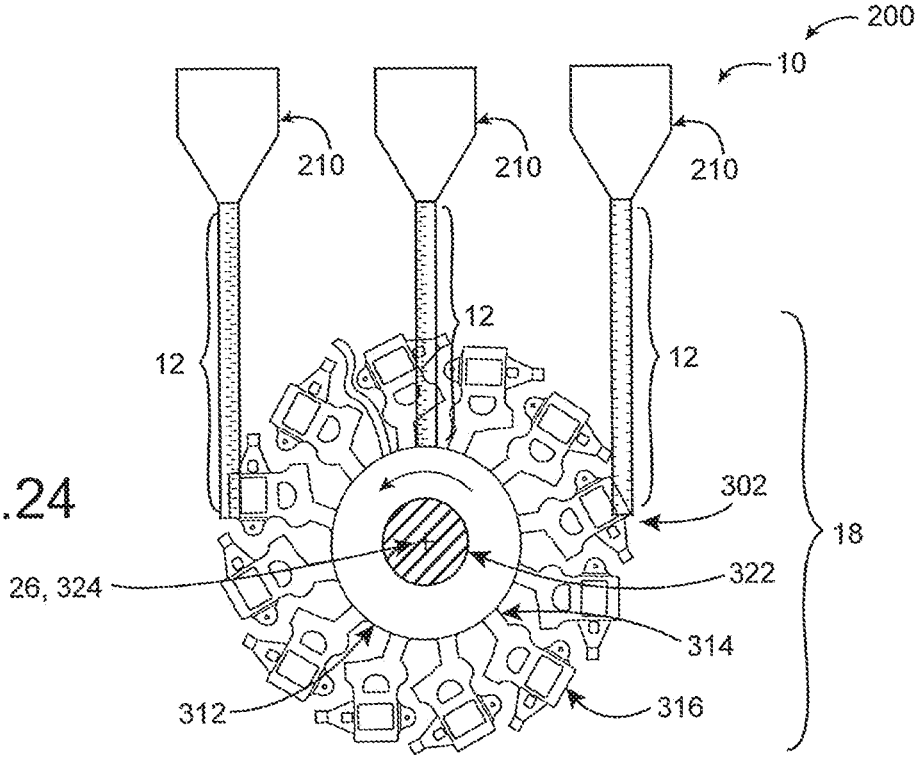
FIG. 24 is a schematic cross-sectional view of an embodiment of an investment mold pattern assembly 302 as described herein.

Investment mold slurry coating manifold apparatus 200 also includes inlet conduit 220. Inlet conduit 220 is operably connected to and in fluid communication with a source of slurry fluid 14. In certain embodiments, inlet conduit 220 is operably connected to and in fluid flow communication with conduit system 32 on one end and on the other end slurry manifold 210 to provide the source of slurry fluid 14. The inlet conduit 220 may be configured through the conduit system 32 to receive a plurality of flows of a plurality of fluids, including slurry fluid 14. This may include fluid communication to respective sources of the plurality of fluids through conventional means, including a network of conduits and valves that are in fluid flow communication in one embodiment to a single inlet conduit 220 as shown in FIG. 22, for example. In another embodiment, the plurality of fluids are in fluid flow communication through conventional means, including a network 32 of conduits and valves 209, to a plurality of inlet conduits 220 as shown in FIG. 21, for example. In one embodiment, the plurality of inlet conduits 220 is configured to provide at least one flow of the slurry 14, at least one slurry fluid 14' different than the slurry fluid 14 (e.g. a second slurry fluid 14' having a composition of the constituents (e.g. refractory particles) that is different than the slurry fluid 14), water 202, a cleaning solution 204, an etchant 206, or an etchant rinse 208. Water 202 may be used, for example, to clean the slurry manifold 210 to remove slurry fluid 14 following use, particularly prior to using the slurry manifold to deposit a coating layer of a slurry fluid 14' different than the slurry fluid 14. A slurry fluid 14' different than the slurry fluid 14 is desirable as it is frequently desirable to vary the composition of the plurality of dried slurry layers comprising mold wall. A cleaning solution 204 may be employed for any suitable purpose, including cleaning the fugitive pattern assembly 18 prior to applying the first coating layer, or any subsequent coating layer. Cleaning solution 204 may include a detergent, and more particularly may include a solution of water and a detergent, and may also include cleaning additives, such as surfactants and anti-foam additives. An etchant 206, such as an acid or alkali etchant, may be employed for any suitable purpose, including to treat the surface of the fugitive pattern assembly 18 after cleaning with a cleaning solution and prior to applying the first coating layer in order to alter the surface to chemically and/or physically enhance the adherence of the coating layer to the surface, or alternately, to treat the surface of any subsequent coating layer to chemically and/or physically enhance the adherence of the coating layer to the surface. An etchant rinse 208, such as an alkali, acid, or neutral pH rinse, may be employed for any suitable purpose, including to treat the surface of the fugitive pattern assembly 18 after treatment with the etchant 206 and prior to applying the first coating layer or any subsequent coating layer in order to physically remove and/or chemically neutralize the etchant 206. In these embodiments of investment mold slurry coating manifold apparatus 200 and slurry manifold 210, the manifold may be used to perform slurry coating of fugitive pattern assembly 18 with slurry fluid 14 and other functions including coating the fugitive pattern assembly (or a previously deposited layer of slurry or stucco particles) with at least one slurry fluid 14' (or a plurality of different slurry fluids (e.g. 14'. 14", 14'"), or application of water 202, a cleaning solution 204, an etchant 206, or an etchant rinse 208 for the purposes described above.

Figure 36:
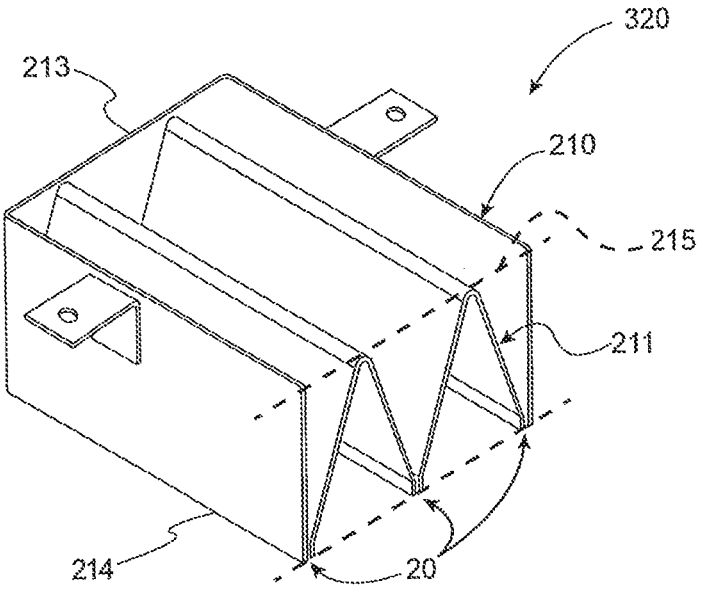
FIG. 36 is a perspective view of an embodiment of a slurry coating station 320 and slurry manifold 210 as disclosed herein.

An embodiment of a slurry manifold 210 having three outlets 20 is shown in FIG. 36. The slurry manifold 210 has a series of corrugated inner walls 211. The corrugated inner walls 211 terminate their tapered slope at the outlets 20. This is advantageous because it leaves no place for slurry to accumulate on the interior 213 of the slurry manifold 210. FIG. 36 is illustrated with an end wall 215 removed to aid illustration. In an embodiment, end wall 215 is present and opposes end wall 213.

Slurry manifold may also optionally be vibrated during operation to aid in removing entrapped gases from the slurry fluid 14 and slurry flow 22.

Investment Mold Making Apparatus

Figure 25D:
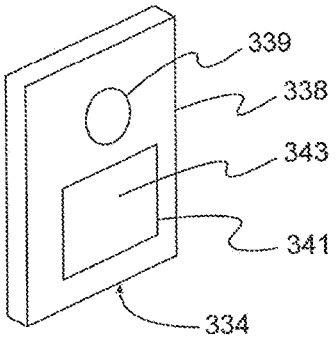
FIG. 25D is an enlargement of a portion of region D of FIG. 25.
Figure 25:
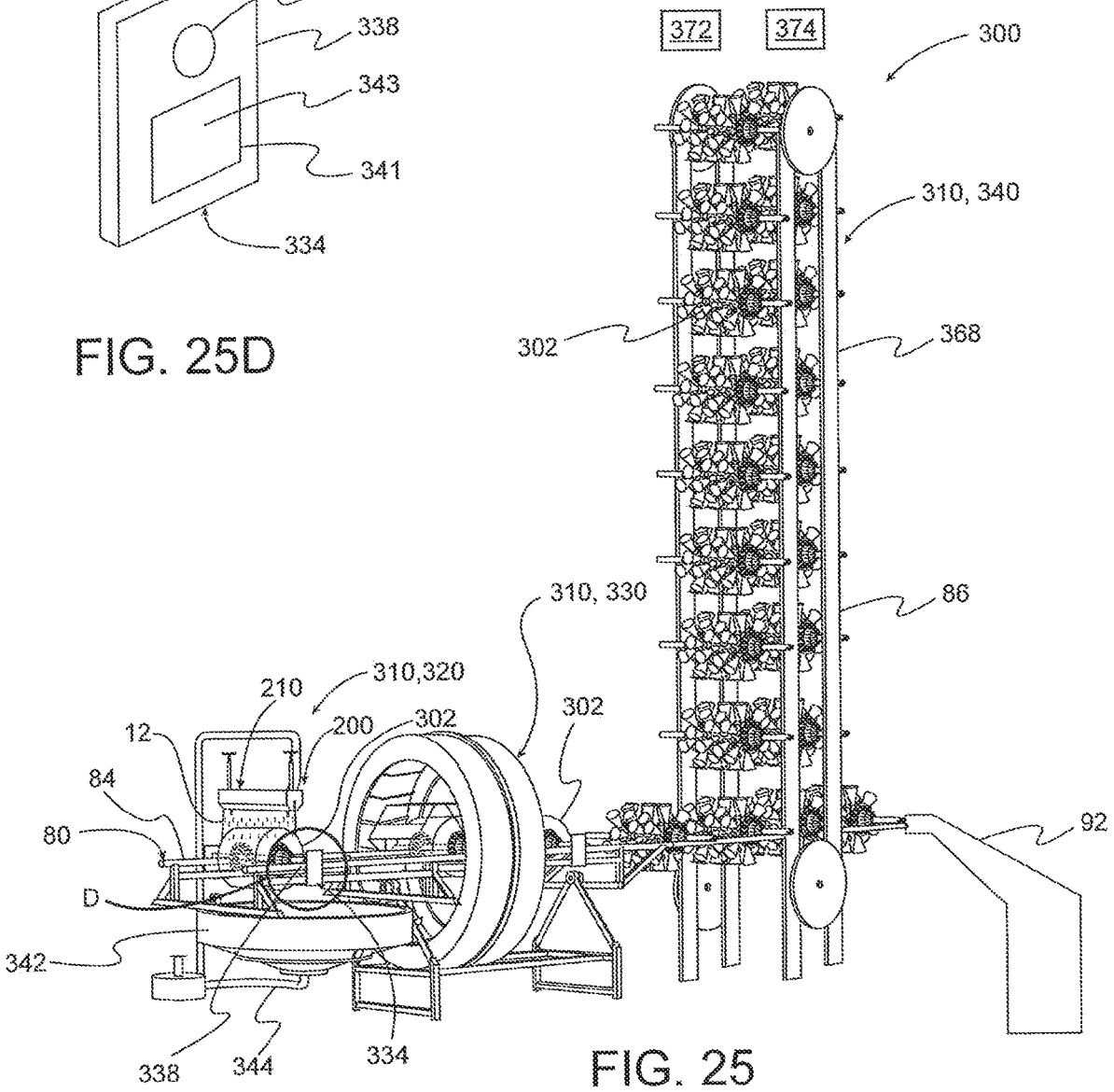
FIG. 25 is a perspective view of an embodiment of an investment mold making apparatus 300 as described herein.
Figure 26:
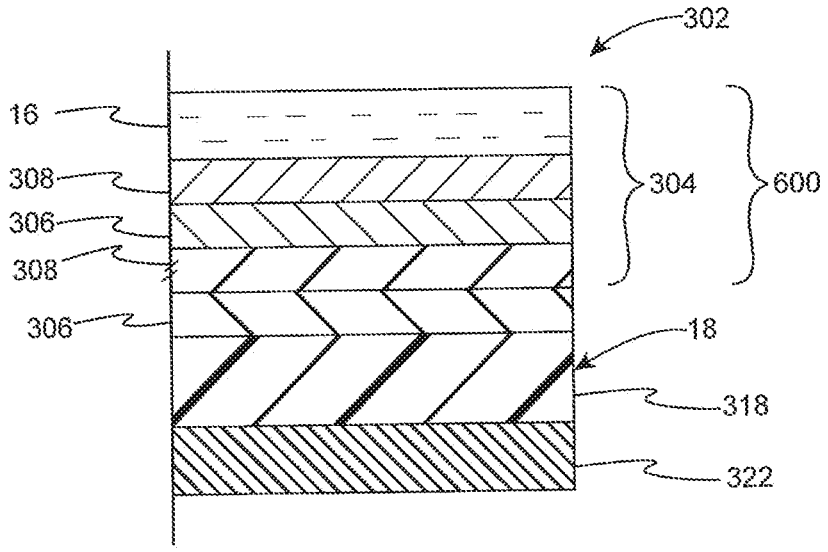
FIG. 26 is a cross-sectional view of an embodiment of a shell mold build and accumulated coating layers therein.
Figure 27:
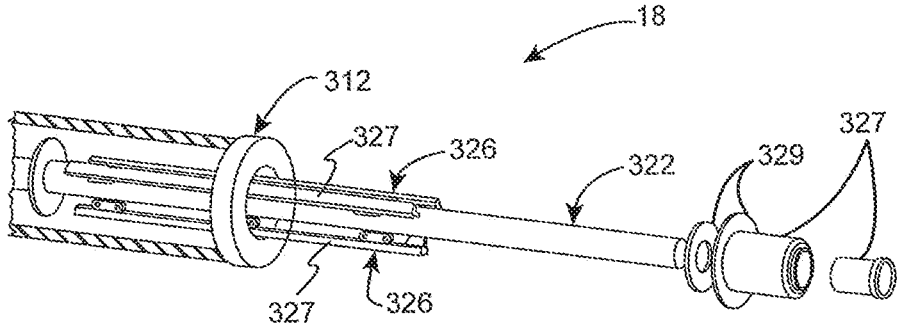
FIG. 27 is a perspective view of an embodiment of a mandrel as disclosed herein.
Figure 28:
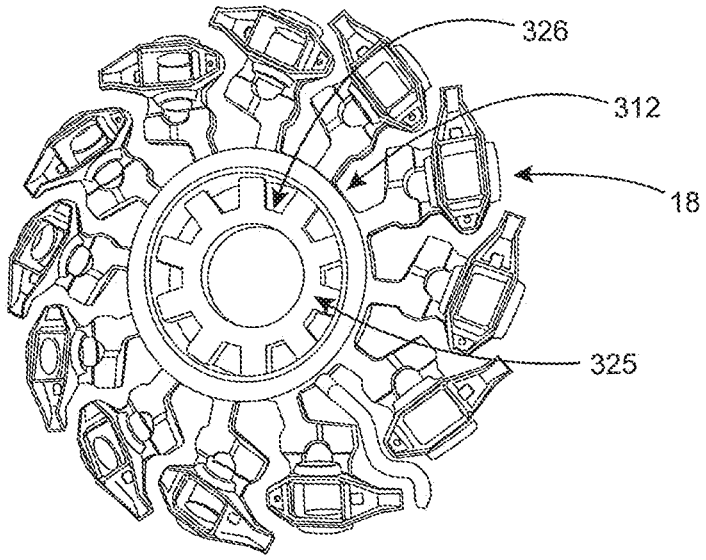
FIG. 28 is a perspective view of an embodiment of a mandrel support member as disclosed herein.

In one embodiment, as shown in FIG. 25, an investment mold making apparatus 300 that may be used to build a refractory shell mold assembly comprising a plurality of slurry coating layers and refractory stucco layers is described. The investment mold making apparatus 300 includes a conveyor 80, particularly a moveable conveyor. The conveyor 80 is configured to convey an investment mold pattern assembly 302 that includes a fugitive mold pattern assembly 18 and any accumulated coating layers 304, including wet slurry coating layers 16 or dried slurry coating layers 306 or stucco coating layers 308, between a plurality of stations 310 or work stations that are used to apply or treat the accumulated coating layers 304, as described herein and illustrated, for example, in FIG. 26. The investment mold pattern assembly 302 may also include a mandrel 322 as described herein and illustrated in FIGS. 23 and 24. The removable mold pattern assembly 18 is formed from a removable or fugitive pattern material 318 and includes a longitudinal sprue axis 26, an axially-extending central sprue 312, at least one gate 314 extending radially outwardly from the central sprue to at least one mold pattern 316. Any suitable investment casting fugitive pattern material 318 may be used, including any material that is configured for removal from the refractory mold assembly, and may include a wax, polymer, metal, ceramic, clay, wood or inorganic material, or a combination thereof, more particularly wax or an expanded polymer foam, such as expanded polystyrene foam. In an embodiment, the removable mold pattern assembly 18 includes the axially-extending central sprue 312 and a plurality of gates 314 extending radially outwardly from the central sprue to a plurality of mold patterns 316, including a corresponding plurality of patterns. In one embodiment, the removable mold pattern assembly 18 is constructed using an axially-extending sprue 312 pattern comprising a solid central sprue pattern. In other embodiments, the removable mold pattern assembly 18 is constructed using an axially-extending sprue 312 pattern comprising a hollow central sprue pattern as described in co-pending U.S. patent application Ser. No. 13/804,676 filed on Mar. 14, 2013, which is hereby incorporated herein by reference in its entirety. In one embodiment, the radially-extending gates and patterns may be spaced substantially uniformly, including uniformly, about the periphery (e.g. circumference of a cylindrical sprue) of the central sprue in a plane that is orthogonal to the sprue axis 26. The apparatus 300 and method 400 are very well-suited for use with a removable mold pattern assembly 18 that has the gates 314 and mold patterns 316 uniformly disposed and spaced about the surface of the sprue 312 pattern and sprue axis 26, including axisymmetric disposition about the sprue axis 26. This is particularly advantageous because the removable mold pattern assemblies 18 are rotated throughout much of the method 400 and uniform disposition of the gates 314 and mold patterns 316 provides enhanced rotational balance of the assembly and aids rotation.

Figure 29:
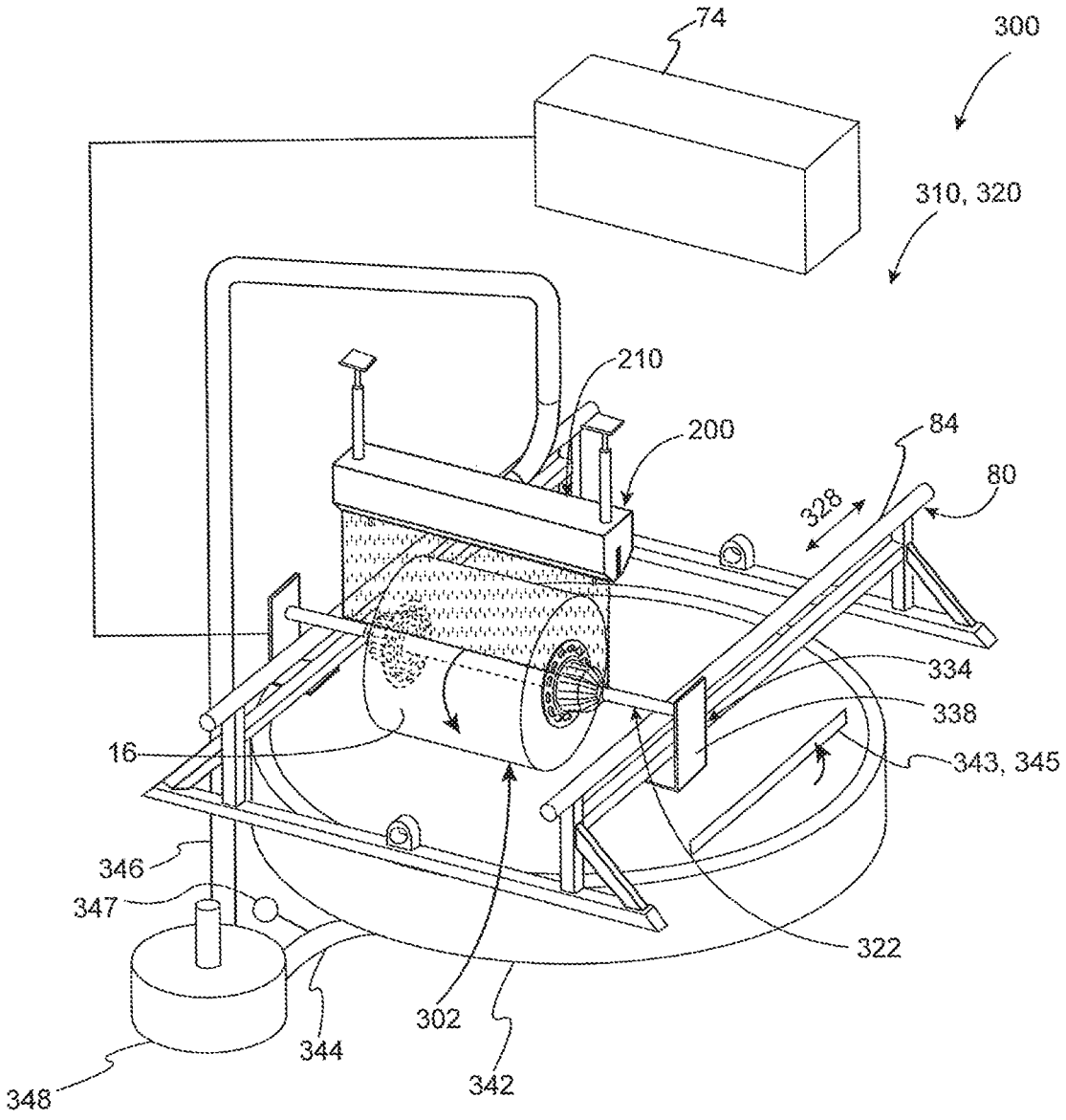
FIG. 29 is a perspective view of an embodiment of a slurry coating station as described herein.

The removable mold pattern assembly 18 is disposed on a mandrel 322. In an embodiment, the mandrel 322 has a longitudinal mandrel axis 324 that is disposed substantially parallel, including parallel, to the sprue axis 26, and more particularly the mandrel axis 324 and sprue axis 26 may be coincident. The mandrel 322 may be formed of any suitable material, including various metals, ceramics, polymers, and composites thereof, including any metals that are resistant to corrosion in the various fluids utilized during the elements of method 400 as described herein, such as various grades of stainless steel. The mandrel 322 may have any predetermined cross-sectional shape. In one embodiment, mandrel 322 comprises a solid or hollow cylindrical shaft. The mandrel 322 may also include laterally (FIG. 28), such as a cog 325, and/or longitudinally (FIG. 27) extending support members 326, such as arms 327, which are configured to extend between the mandrel 322 and sprue 312 pattern to support, including stiffen, the mandrel 322 and investment mold pattern assembly 302 disposed thereon. The mandrel 322 and any support members 326 are configured to rotatably support the removable mold pattern assembly 18 during practice of the method 400, including slurry coating under slurry curtain 12. The mandrel 322 may also include clamping 327 and sealing members 329 to clamp the removable mold pattern assembly 18 to the mandrel 322. The mandrel 322 may be configured to provide a longitudinal stiffness sufficient to support the weight of the investment mold pattern assembly 302 as it is invested on the removable mold pattern assembly 18 by method 400 with substantially no bowing or deflection along the sprue axis 26 in order to provide substantially crack-free, including crack-free, finished molds. Bowing or deflection can result in dimensional variance of the mold and/or cracking of the mold wall, which in turn can results in defects in the castings made using the mold. In one embodiment, the mandrel 322 and mold pattern assembly 18 are rotatably disposed substantially horizontally on the conveyor 80. In another embodiment, the mandrel axis 324 is disposed substantially orthogonal to the conveyor axis 328 and the predetermined direction of motion 82 of the conveyor 80 (FIG. 29). In one embodiment, the mandrel 322 and mold pattern assembly 18 are rotatably disposed substantially horizontally on the conveyor 80 and are substantially orthogonal to the conveyor axis 328 and the predetermined direction of motion 82 of the conveyor 80.

The conveyor 80 may include any conveying device 84 suitable for rotatably conveying or moving the mandrel 322 and mold pattern assembly 18 between work stations 310. Any suitable conveying device 84 or conveying mechanism may be used to move the mandrel 322 and mold pattern assembly 18 between stations 310. Suitable conveying devices 84 include belt-based conveyors, roller-based conveyors, rail-based conveyors including monorail conveyors, chain-based conveyors, or other conveyor mechanisms that extend between and mechanically interconnect adjacent stations 310 and provide a means or mechanism for movement of the mandrel 322 and mold pattern assembly 18 from one station 310 to the next in accordance with method 400. Conveying device 84 may have any suitable shape or form or mechanical structure that enables movement or conveyance of rotatable mandrel 322 and mold pattern assembly 18 between stations 310. Suitable conveying devices 84 also include all manner of modular conveying devices 86, such as movable racks, cassettes, turntables, carousels, or other devices that may be used to collect, or accumulate, or house one or more rotatable mandrel 322 and mold pattern assembly 18 for movement between stations 310. Any of the conveying devices 84 may be configured for manual movement of rotatable mandrel 322 and pattern assembly 18 between stations. Alternately, conveyor 80 and conveying device 84 may be configured for machine indexed movement, wherein ejection of one rotatable mandrel 322 and pattern assembly 18 from a station by a machine causes associate movement or indexing of a series of adjacent accumulated rotatable mandrels 322 and pattern assemblies 18 toward an adjacent station. Alternately, conveyor 80 and conveying device 84 may be configured so that movement of one or more rotatable mandrel 322 and pattern assembly 18 between stations 310 is automated and monitored and/or controlled by a suitable microcontroller 74 or computer. As a further alternate, conveyor 80 and conveying device 84 may include a robot 92, or a plurality of robots 92, that is configured to rotatably provide rotatable mandrel 322 and pattern assembly 18 to a single station 310, or to rotatably move them between a plurality of stations 310 (i.e. provide for their rotation while they are moved into a station 310 or between stations 310). The various conveyors 84 and conveying devices 86 described herein may be used together in any combination. Coating, draining, and stuccoing of clusters may be carried out manually, robotically, or mechanically. When robots 92 are introduced, they may be communicatively connected to the microcontroller 74 for continuous operation in conjunction with the conveyors 84.

The conveyor 80 may also include a fixture 334 that is configured to rotatably support the investment mold pattern assembly 302, including the rotatable mandrel 322 and pattern assembly 18 as shown in FIGS. 25 and 25D. For example, the fixture 334 may include an axially-extending base or opposing supports 338, or both that are configured to rotatably support the mandrel 322, such as by suitable bearing 339, bushing, or similar support structure. The fixture 334 may also include a rotatable drive mechanism 341, such as one or more rotatable gears or belts, or a rotatable electric drive motor 343. The motive source to rotate the rotatable drive mechanism 341 may be provided through the conveyor 84 and/or conveying device 86, or separately, such as through a conductive connection to a source of electrical power, or through a mechanical connection to a motive source, such as a drive belt, chain, or gear, or a combination thereof.

The investment mold making apparatus 300 also includes a slurry coating station 320 as shown for example, in FIGS. 25 and 29. The slurry coating station 320 is configured to include a slurry curtain 12 comprising an aqueous slurry fluid 14 as described herein. The slurry coating station 320 is configured to receive the investment mold pattern assembly 302, such as by its movement along and via conveyor 80. The conveyor 80 is configured to position and rotate the removable mold pattern assembly 18 under the slurry curtain 12 to provide a wet slurry coating layer 16 by depositing the slurry fluid 14 as a layer over the surface of the assembly. The wet slurry coating layer 16 deposited may have any suitable thickness by controlling the characteristics of the slurry fluid 14, including the amount of solids, particularly the refractory particles and binder, the viscosity of the slurry fluid 14, and the rate of rotation of the removable mold pattern assembly 18. In one embodiment, the thickness ranges from about 0.10 to about 1.20 mm, and more particularly about 0.2 to about 1.00 mm. In one embodiment, the thickness is substantially uniform, including uniform, over the entirety of the surface of the removable mold pattern assembly 18. The slurry coating station 320 may be configured to include the slurry curtain 12 using any of the slurry coating apparatuses described herein including apparatus 10, apparatus 100, or apparatus 200, or combination thereof. The slurry coating station 320 may also include a collection tank 342 configured to receive the excess portion of the slurry fluid 14 from slurry curtain 12 that is not deposited onto the investment mold pattern assembly 302, including removable mold pattern assembly 18. The collection tank 342 may also include a stirring mechanism 343 or mixing mechanism 345, or a combination thereof, in order to maintain the slurry fluid 14 as a suspension (FIG. 29). Any suitable stirring mechanism 343 or mixing mechanism 345 may be employed. In one embodiment, the collection tank 342 may include an outlet conduit 344 that is operably connected to and in fluid communication with the slurry fluid source 35 through a conduit 346 or conduits so that the excess slurry fluid 14 may be recirculated back to the slurry fluid source 35 for reuse in method 400 in a closed-loop fashion in order to improve the efficiency and cost-effectiveness of the wet slurry coating layer 16 deposition process. The conduit 346 may also be operably connected to and include communication with an appropriate valve 347 or valves and or pump 348 to control the return of the excess slurry fluid 14 to the slurry fluid source 35. The valve 347 and/or pump 348 may be controlled manually, or alternately they may be controlled automatically by electronic controller 74. The conveyor 80 may be operably coupled to slurry coating station 320 and employed as described herein to move investment mold pattern assemblies 302 into and out of the slurry coating station 320. The investment mold making apparatus 300 may also include a plurality of slurry coating stations 320 in combination with a plurality of other stations 310 as described herein.

Figure 37:
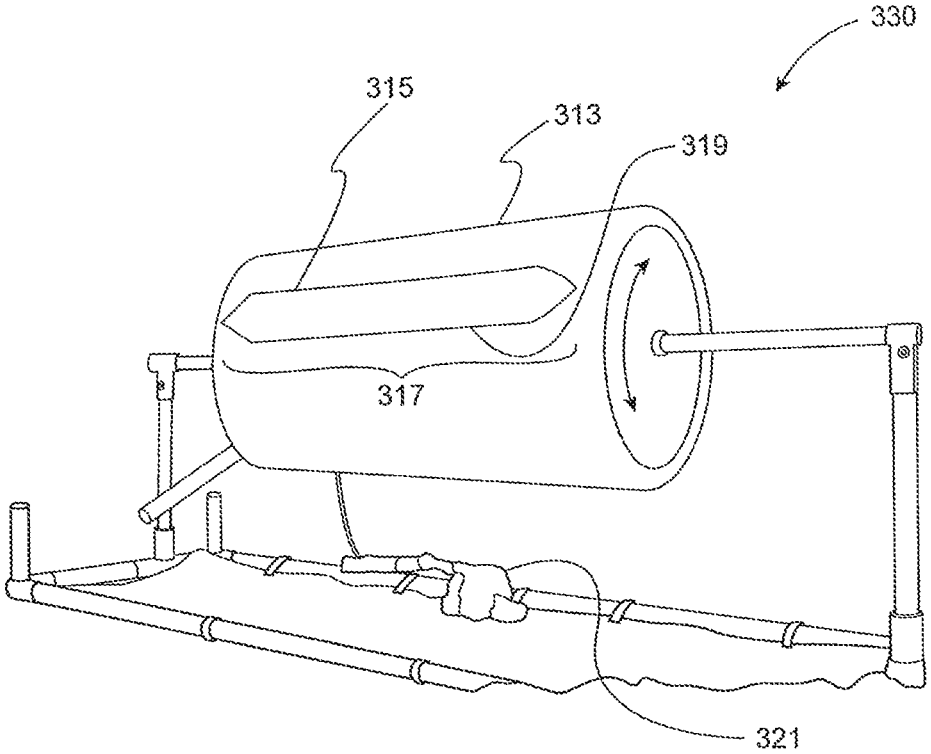
FIG. 37 is a schematic illustration of an embodiment of a stucco coating station 330 and slurry manifold as disclosed herein.

The investment mold making apparatus 300 also includes a stucco coating station 330. The stucco coating station 330 is configured to receive the investment mold pattern assembly 302, such as by its movement along and via conveyor 80 that is operably associated with the station, such as by passing through the station and under a particle flow of the stucco particles 309 or through a fluidized bed of stucco particles 309 (FIG. 30). In certain embodiments, the conveyor 80 may be operably attached to stucco coating station 330, and in other embodiments may be unattached but operably associated with the stucco coating station as described herein. The stucco coating station 330 is configured to apply stucco particles 309 to the surface of investment mold pattern assembly 302 in any suitable manner using any suitable mechanism for presenting dispersed stucco particles 309 to the surface, including by gravity or as a pressurized flow in a carrier gas. In one aspect, the investment mold pattern assembly 302 may be rotationally operable around a flow direction of the slurry curtain 12. The stucco coating station 330 includes a plurality of dispersed dry, coarse stucco particles 309 comprising a refractory material. The dry stucco particles 309 may include any of the refractory particles and refractory materials described herein for use in slurry fluid 14. The stucco particles 309 may include the same refractory material as those used to make wet slurry coating layer 16, or may include a different refractory material. The stucco particles 309 may be any suitable predetermined particle size. In one embodiment, the stucco particles 309 may have an average particle size that is greater than that of the refractory particles used in slurry fluid 14, and in other embodiments will have an average particle size that is substantially greater than that of the refractory particles used in slurry fluid 14. In one embodiment, the stucco particles 309 may have an average particle size of 10 to 150 mesh, and more particularly 20 to 100 mesh. The stucco particles 309 may have any suitable particle shape, including the particle shapes described herein for the refractory particles used in slurry fluid 14. The stucco coating station 330 is configured to receive the investment mold pattern assembly 302 and dispense the stucco particles 309 as a stucco coating layer 308 onto the surface of the wet slurry coating layer 16. The stucco coating station 330 may have any suitable configuration for dispensing the stucco particles 309 onto the wet slurry coating layer 16. In one embodiment, the stucco coating station 330 comprises a rotary sander 352 that rotates the stucco particles 309 circumferentially within a circumferential housing 354 to a top portion thereof such that the stucco particles 309 are elevated and allowed to cascade down as a shower or rain of particles through the central portion 356 of the rotary sander 352. The stucco coating station 330, such as rotary sander 352, controls may be adjusted and operated manually by a human operator, or may be controlled by an electronic controller 74, such as a programmable microcontroller 88 or computer. The conveyor 80 may be configured to position and rotate the investment mold pattern assembly 302, including mold pattern assembly 18, within the shower or rain of dispersed dry stucco particles 309 to dispose a stucco coating layer 308 of dry stucco particles 309 on the wet slurry coating layer 16. In one embodiment, the conveyor 80 may pass through the central portion 356 of the rotary sander 352. The stucco coating layer 308 may have any suitable layer thickness. In one embodiment, the thickness of the stucco coating layer 308 is about 0.10 to 1.20 mm, and more particularly about 0.2 to 1.00 mm. Excess stucco coating particles 309 may be collected at the bottom portion of the rotary sander 352 where they may be circumferentially recirculated back to the top portion where they are dispersed as described above. The rotary sander 352 and conveyor 80 may be configured to provide angulation and movement of the mold pattern assembly 302 within the sander as shown, for example, in FIGS. 33A and 33B which shows a pivot rail that may be employed in sander 352 as well as any other stations 310 including slurry coating station 320, as well as FIGS. 34A and 34B. In another embodiment, the stucco coating station 330 may include a stucco particle curtain 358 by employing a stucco conduit or stucco manifold 362 analogous to the conduit 30 or slurry manifold 210 described herein, such as by creating a fluidized bed of the particles in the conduit or manifold chamber and allowing them to cascade down through an appropriate outlet 366 analogous to outlet 20 as described herein. The conveyor 80 may be operably coupled to stucco coating station 330 and employed as described herein to move investment mold pattern assemblies 302 into and out of the stucco coating station 330. The investment mold making apparatus 300 may also include a plurality of stucco coating stations 330 in combination with a plurality of other stations 310 as described herein. Another embodiment of a stucco coating station 330 is shown in FIG. 37. In this embodiment, the stucco coating station 330 comprises a rotatable and/or vibratable bin 313 having an opening 315, such as a slot 317. The bin can be rotated so that stucco particles 309 disposed within the bin spill over the edge 319 of the slot 317 while the bin 313 is vibrated, such as by an electric motor 321.

Figure 38:
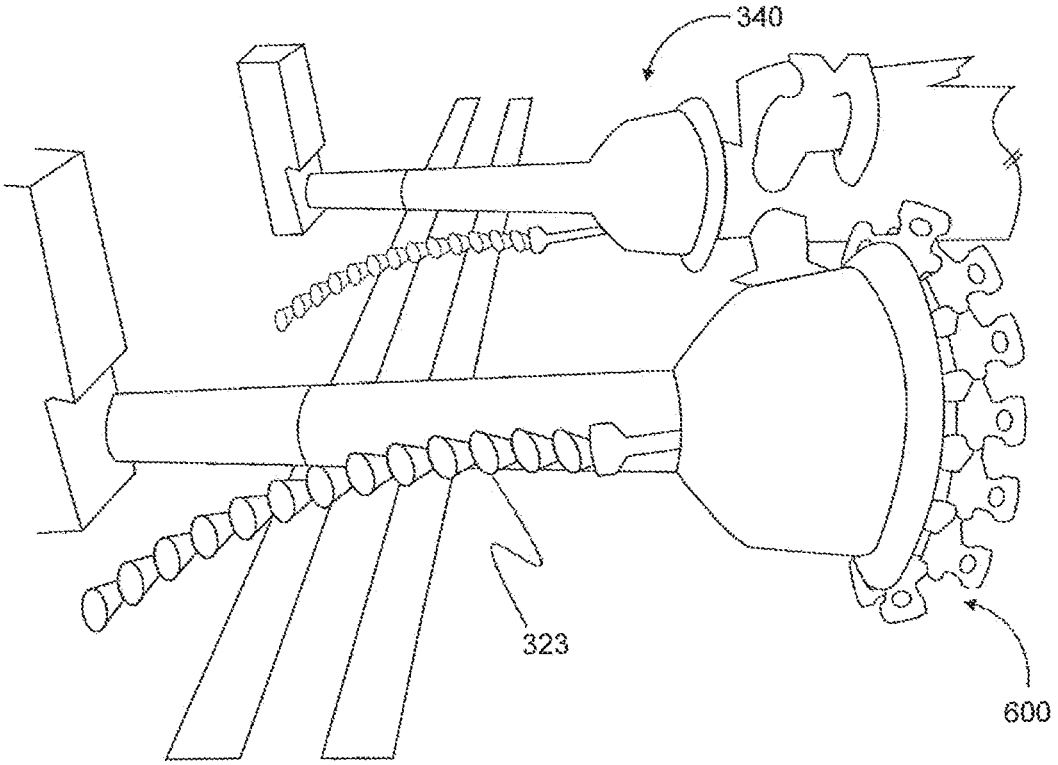
FIG. 38 is a schematic illustration of an embodiment of a drying station 340 and drying jets as disclosed herein.

The investment mold making apparatus 300 also includes a drying station 340. The drying station 340 is configured to remove the carrier liquid or fluid of the slurry fluid 14, such as water, from the wet coating layers 16 that are deposited on the investment mold pattern assembly 302. The conveyor 80 is configured to convey investment mold pattern assembly 302, including the removable pattern assembly 18, from the slurry coating station 320 or the stucco coating station 330 to the drying station 340 and position and rotate the mold pattern assembly within the drying station 340. The drying station 340 is configured to dry the wet slurry coating layer 16 and provide a dried slurry coating layer 306. The drying station 340 may include any suitable drying apparatus 368 or drying equipment. The drying apparatus 368 or equipment may include heaters 372, dehumidifiers 374, or a combination thereof. Any suitable heaters 372 may be employed, including all manner of infrared lamps, electrical resistance heaters, microwave heaters, natural or other gas combustion-based heaters, oil-fired heaters, solar-powered heaters, or any combination thereof, to heat the investment mold pattern assembly 302. Any suitable dehumidifier 374 may be used to control the humidity of the atmosphere surrounding and proximate the investment mold pattern assembly 302. The drying station 340 is used to provide drying of wet slurry coating layer 16 and removal of the carrier fluid, as well as any chemical or physical changes in the binder, needed to achieve dried slurry coating layer 306. In certain embodiments, the drying station 340 includes an enclosure 376, which has an entrance opening 377 and/or exit opening 378. The entrance opening 377 and/or exit opening 378 may be configured so that they are permanently open and temperature and humidity in the enclosure 376 are maintained with the permanent openings. Alternately, the entrance opening 377 and/or exit opening 378 may be selectively openable and closable with a closure mechanism such as a moveable door or curtain. Drying station 340 may be used to achieve any suitable predetermined temperature and/or predetermined humidity of investment mold pattern assembly 302. In one embodiment, the temperature may be controlled in a range of 70 to 85° F., and more particularly 75 to 85° F., and even more particularly 80 to 85° F. The humidity may be controlled to any predetermined humidity level, including a relative humidity (RH) level less than 35% RH, and more particularly 0 to 30% RH, and more particularly 10 to 30% RH. The temperature and humidity controls may be adjusted and operated manually by a human operator, or may be controlled by an electronic controller 74, such as a programmable microcontroller or computer. The airflow may also be controlled to any suitable level, including about 1400 to 1600 CFM, and more particularly about 1500 CFM. The conveyor 80 may be operably coupled to drying station 340 and employed as described herein to move investment mold pattern assemblies 302 into and out of drying station 340. The drying station 340 may also be operably connected using conveyor 80 to a storage station 350 that is configured to provide temperature and humidity controlled storage of partially completed or fully completed investment mold pattern assemblies 302 using suitable drying apparatus 368 or equipment to maintain the predetermined temperature and/or predetermined humidity described herein. The investment mold making apparatus 300 may also include a plurality of drying stations 340 and/or storage stations 350 in combination with a plurality of other stations 310 as described herein. In one embodiment, as shown in FIG. 38, the drying station may include a plurality of air nozzles 323 that are connected to a source of air, including humidity controlled air and positioned to blow air on the investment mold pattern assemblies 302, particularly horizontally parallel to the surface of the sprue pattern to blow air into areas with tight spacing between adjacent pattern elements to enhance the rate of drying and avoid defects associated with localized diminished or slow drying.

Figure 31:
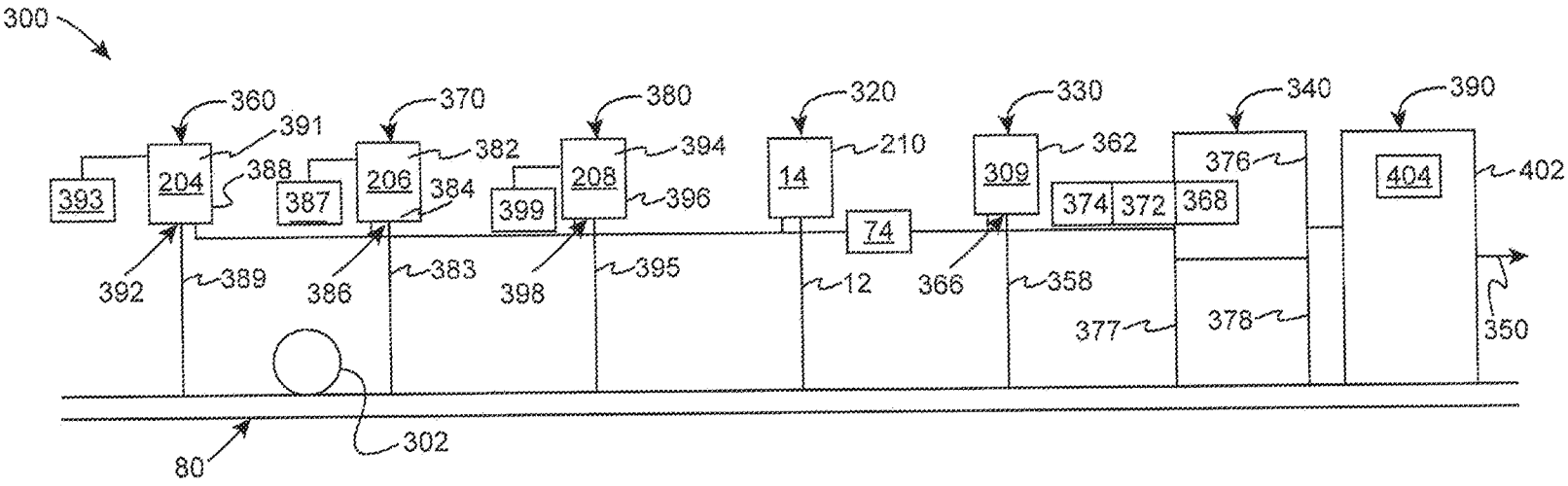
FIG. 31 is a schematic illustration of an embodiment of an investment mold making apparatus 300 as described herein.

The investment mold making apparatus 300 may also optionally or alternately further include various stations (FIG. 31). In one embodiment, the investment mold making apparatus 300 may include a cleaning station 360, the cleaning station including a cleaning solution 204, and the conveyor 80 is configured to position and rotate the investment mold pattern assembly 302, including the mold pattern assembly 18, in the cleaning solution 204. The cleaning station 360 is configured to dispense a cleaning solution 204, such as those described herein, onto the surface of the investment mold pattern assembly 302, including the surface of the removable mold pattern assembly 18, to prepare the surface as described herein. In one embodiment, the cleaning station 360 may be the first station. In one embodiment, the conveyor 80 is configured to convey investment mold pattern assembly 302, including the removable pattern assembly 18, from the storage station 350 to the cleaning station 360 and position and rotate the mold pattern assembly within the cleaning station. The cleaning station 360 and cleaning solution 204 are configured to clean the surface of the removable mold pattern assembly 18, or alternately to clean the surface of a dried slurry coating layer 306, or alternately to clean the surface of a stucco coating layer 308. The cleaning station 360 may include any suitable cleaning solution dispensing apparatus 388 or etchant dispensing equipment. The cleaning solution dispensing apparatus 388 may include any suitable cleaning solution dispensing equipment. In one embodiment, the cleaning station 360 may include a cleaning solution curtain 389 by employing an cleaning solution conduit or cleaning solution manifold 391 analogous to the conduit 30 or slurry manifold 210 described herein, such as by allowing a liquid cleaning solution or fluid to cascade down through an appropriate cleaning solution outlet 392 analogous to outlet 20 as described herein. The cleaning station 360 may be used to prepare the surfaces described above to receive a wet slurry coating layer 16, such as by removing contaminants and debris from the surface to which it is applied. Cleaning solution station 360 may be used to achieve any suitable surface physical state or surface chemistry of the surfaces described above. The cleaning solution station 360 may be configured to provide a predetermined amount or flow rate of the cleaning solution 204 with suitable valves or flow controls. The cleaning station 360 may also include a cleaning solution heater 393 to control the temperature of the cleaning solution 204. The flow and temperature controls may be adjusted and operated manually by a human operator, or may be controlled by an electronic controller 74, such as a programmable microcontroller or computer. The conveyor 80 may be operably coupled to cleaning station 360 and employed as described herein to move investment mold pattern assemblies 302, including removable pattern assemblies 18, into and out of cleaning station 360. The cleaning station 360 may also be operably connected using conveyor 80 to an etchant station 370 as described herein. The investment mold making apparatus 300 may also include a plurality of cleaning stations 360 in combination with a plurality of other stations 310 as described herein.

The investment mold making apparatus 300 may also optionally or alternately further include an etchant station 370, the etchant station including an etchant 206, and the conveyor 80 is configured to position and rotate the investment mold pattern assembly 302, including the mold pattern assembly 18, in the etchant 206. The etchant station 370 is configured to dispense an etchant 206, such as those described herein, onto the surface of the investment mold pattern assembly 302, including the surface of the removable mold pattern assembly, to prepare the surface as described herein. In one embodiment, the cleaning station 360 may be the first station and the etchant station 370 may be used after the cleaning station 360 to further prepare the surface of the removable mold pattern assembly 18 to receive the wet coating layer 16 of slurry fluid 14. In one embodiment, the conveyor 80 is configured to convey investment mold pattern assembly 302, including the removable pattern assembly 18, from the storage station 350 or the cleaning station 360, to the etchant station 370 and position and rotate the mold pattern assembly within the etchant station. The etchant station 370 and etchant 206 are configured to etch or alter the surface or surface chemistry of the surface of the removable mold pattern 18, or alternately to etch or alter the surface or surface chemistry of a dried slurry coating layer 306, or alternately to etch or alter the surface or surface chemistry of the surface of a stucco coating layer 308. The etchant station 370 may include any suitable etchant dispensing apparatus 382 or etchant dispensing equipment. The etchant dispensing apparatus 382 may include any suitable etchant dispensing equipment. In one embodiment, the etchant station 370 may include an etchant curtain 383 by employing an etchant conduit or etchant manifold 384 analogous to the conduit 30 or slurry manifold 210 described herein, such as by allowing a liquid etchant to cascade down through an appropriate etchant outlet 386 analogous to outlet 20 as described herein. The etchant station 370 may be used to prepare the surfaces described above to receive a wet slurry coating layer 16, such as by removing a surface layer of the surface material to alter the surface morphology or physical state, or by altering the surface chemistry, such as by adding or removing surface functional groups, including organic or inorganic functional groups. The etchant station 370 may be used to achieve any suitable surface physical state or surface chemistry of the surfaces described above. The etchant station 370 may be configured to provide a predetermined amount or flow rate of the etchant 206 with suitable valves or flow controls. The etchant station 370 may also include an etchant heater 387 to control the temperature of the etchant 206. The flow and temperature controls may be adjusted and operated manually by a human operator, or may be controlled by an electronic controller 74, such as a programmable microcontroller or computer. The conveyor 80 may be operably coupled to etchant station 370 and employed as described herein to move investment mold pattern assemblies 302, including removable pattern assemblies 18, into and out of etchant station 370. The etchant station 370 may also be operably connected using conveyor 80 to a rinse station 380 as described herein. The investment mold making apparatus 300 may also include a plurality of etchant stations 370 in combination with a plurality of other stations 310 as described herein.

The investment mold making apparatus 300 may also optionally or alternately further include an etchant rinsing station 380, the rinsing station including an etchant rinse 208, and the conveyor 80 is configured to position and rotate the investment mold pattern assembly 302, including the mold pattern assembly 18, in the etchant rinse 208. The etchant rinsing station 380 is configured to dispense an etchant rinse 208, such as those described herein, onto the surface of the investment mold pattern assembly 302, including the surface of the removable mold pattern assembly, to remove or neutralize the etchant and prepare the surface as described herein. In one embodiment, the etchant rinsing station 380 may be used after the etchant station 370 and prior to the slurry coating station 320 to further prepare the surface of the removable mold pattern assembly 18 to receive the wet coating layer 16 of slurry fluid 14. In one embodiment, the conveyor 80 is configured to convey investment mold pattern assembly 302, including the removable pattern assembly 18, from the etchant station 370 to the etchant rinsing station 380 and position and rotate the mold pattern assembly within the etchant rinsing station. The etchant rinsing station 380 and etchant rinse 208 are configured to remove or neutralize the etchant 206 from the surface of the removable mold pattern 18, or alternately from the surface of the coating layer 306, or alternately from the surface of the stucco coating layer 308. The etchant rinsing station 380 may include any suitable etchant rinsing apparatus 394 or etchant dispensing equipment. The etchant dispensing apparatus 394 may include any suitable etchant dispensing equipment. In one embodiment, the etchant rinsing station 380 may include an etchant curtain 395 by employing an etchant conduitor etchant manifold 396 analogous to the conduit 30 or slurry manifold 210 described herein, such as by allowing a liquid etchant rinse to cascade down through an appropriate etchant rinse outlet 398 analogous to outlet 20 as described herein. The etchant rinsing station 380 may be used to prepare the surfaces described above to receive a wet slurry coating layer 16, by removing or neutralizing the etchant 206. Etchant rinsing station 380 may be used to achieve any suitable surface physical state or surface chemistry of the surfaces described above. The etchant rinsing station 380 may be configured to provide a predetermined amount or flow rate of the etchant rinse 208 with suitable valves or flow controls. The etchant rinsing station 380 may also include an etchant heater 399 to control the temperature of the etchant rinse 208. The flow and temperature controls may be adjusted and operated manually by a human operator, or may be controlled by an electronic controller 74, such as a programmable microcontroller or computer. The conveyor 80 may be operably coupled to etchant rinsing station 380 and employed as described herein to move investment mold pattern assemblies 302, including removable pattern assemblies 18, into and out of etchant rinsing station 380. The etchant rinsing station 380 may also be operably connected using conveyor 80 to a slurry coating station 320 as described herein. The investment mold making apparatus 300 may also include a plurality of etchant rinsing stations 380 in combination with a plurality of other stations 310 as described herein.

The investment mold making apparatus 300 may also optionally or alternately further include a pattern removal station 390. Pattern removal is the operation that subjects the shell mold to high stress. The pattern removal station 390 is configured to remove the removable mold pattern assembly 18 from the dried refractory mold assembly 600. The conveyor 80 is configured to convey the completed investment mold pattern assembly 302, including the removable pattern assembly 18 and dried refractory mold assembly 600, to pattern removal station 390. The pattern removal station 390 is configured to remove the fugitive pattern material 318, including by heating the material sufficiently to cause it to be removable from the dried refractory mold assembly 600. Any suitable removal mechanism may be employed for fugitive pattern material 318, including physical processes such as melting, or chemical processes such as pyrolysis. The pattern removal station 390 may include any suitable removal apparatus 402, including a heater 404. Any suitable heater 404 may be employed, including all manner of steam autoclaves, microwave oven, infrared lamps, electrical resistance heaters, natural or other gas combustion-based heaters, or oil-fired heaters, or any combination thereof, to heat the investment mold pattern assembly 302 and dried refractory mold assembly 600. The pattern removal station 390 is used to provide sintering of dried refractory mold assembly 600. Pattern removal station 390 may be used to achieve any suitable predetermined temperature of investment mold pattern assembly 302. In one embodiment, the removable pattern material 318 comprises wax and the temperature may be controlled in a range of 120 to 190° C., and more particularly 120 to 175° C. The temperature may be adjusted and operated manually by a human operator, or may be controlled by an electronic controller 74, such as a programmable microcontroller or computer. The conveyor 80 may be operably coupled to pattern removal station 390 and employed as described herein to move investment mold pattern assemblies 302 into and sintered dried refractory mold assembly 600 out of pattern removal station 390. The pattern removal station 390 may also be operably connected using conveyor 80 to a storage station 350 that is configured to provide temperature and humidity controlled storage of sintered dried refractory mold assembly 600 using suitable drying apparatus 368 or equipment to maintain the predetermined temperature and/or predetermined humidity described herein. The investment mold making apparatus 300 may also include a plurality of pattern removal station 390 in combination with a plurality of other stations 310 as described herein.

The investment mold making apparatus 300 may include stations 310 and may be used in any combination of stations and desired sequence to make a refractory shell mold assembly/investment shell mold assembly 600. In one embodiment, the investment mold making apparatus 300 comprises a slurry coating station 320, stucco station 330, and drying station 340, and the an investment mold pattern assembly 302, including a mold pattern assembly 18 of a removable material 318 is sequenced through the apparatus to apply a slurry and/or stucco coating layer, dried, and then the sequence is repeated to apply subsequent slurry and/or stucco coating layers and build the precursor refractory shell mold assembly/investment shell mold assembly 600 on the investment mold pattern assembly 302, including the mold pattern assembly 18. In another embodiment, the investment mold making apparatus 300 comprises a cleaning station, 360, etchant station 370, etchant rinse station 380, slurry coating station 320, stucco station 330, drying station 340, and an investment mold pattern assembly 302, including a mold pattern assembly 18 of a removable material 318 is sequenced through the cleaning station 360, etching station 370, and etchant rinsing station 380, to clean, etch, and rinse the mold pattern assembly 18. The assembly 18 is then sequenced through slurry coating station 320, stucco coating station 330, and drying station 340 to apply a slurry and/or stucco coating layer and dry the layer(s), and then the sequence using the slurry coating station 320, stucco coating station 330, and drying station 340 is repeated to apply subsequent slurry and/or stucco coating layers and build the precursor refractory shell mold assembly/investment shell mold assembly 600 on the investment mold pattern assembly 302, including the mold pattern assembly 18.

Figure 32:
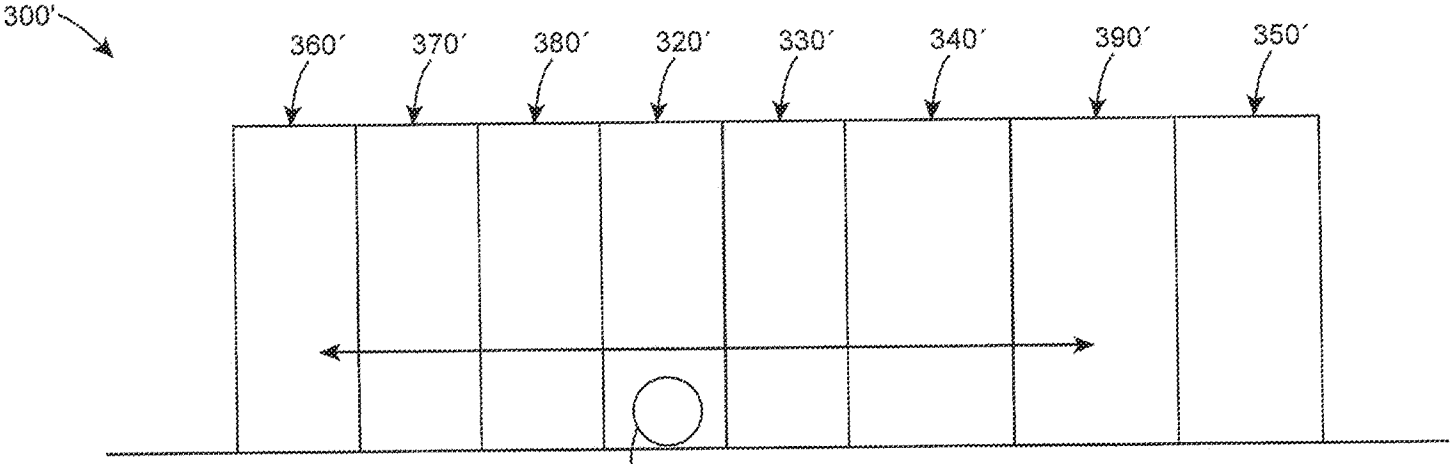
FIG. 32 is a schematic illustration of an embodiment of an alternate investment mold making apparatus 300' as described herein.
Figure 33A:
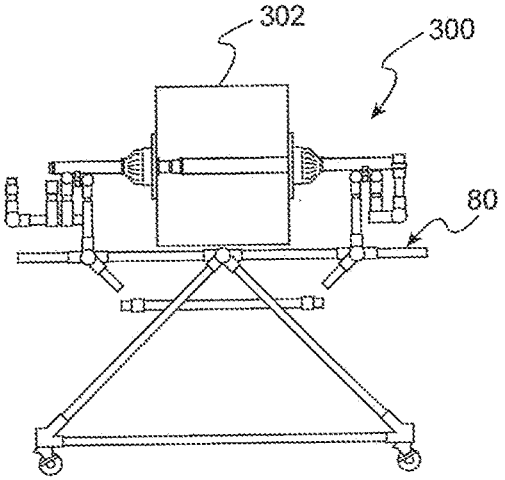
FIGS. 33A and 33B are schematic illustrations of embodiments of a conveyor for use in a workstation, including a stucco coating station as described herein.
Figure 33B:
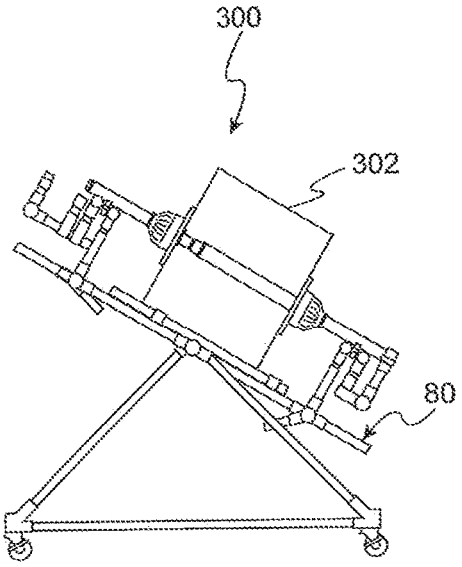
Figure 34A:
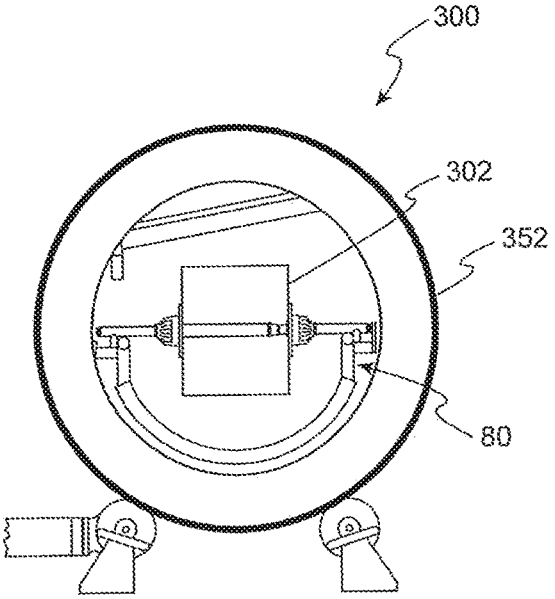
FIGS. 34 A and 34B are schematic illustrations of embodiments of a stucco coating station as described herein.
Figure 34B:
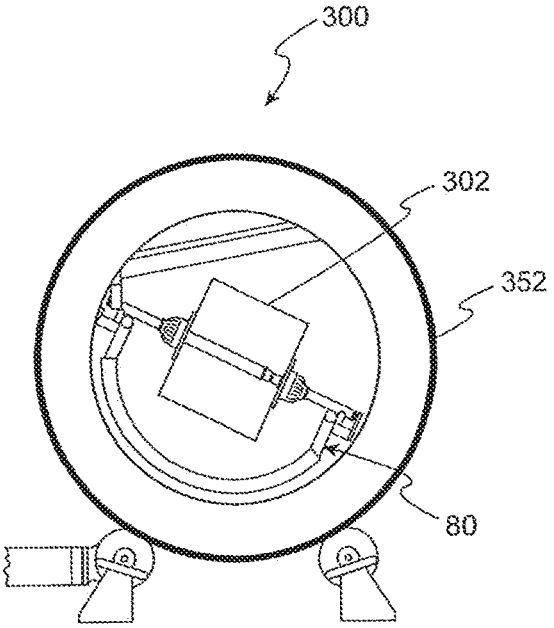

In one embodiment, an investment mold making apparatus 300' includes a slurry coating station 320', the slurry coating station 320' comprising a slurry curtain 12 comprising an aqueous slurry 14, as described herein (FIG. 32). The slurry coating station 320' is configured to rotatably dispose an investment mold pattern assembly 302, including a mold pattern assembly 18 of a removable material 318, under the slurry curtain 12 having a thickness and a length, the length greater than the thickness, to provide a wet slurry coating layer 16 on the mold pattern assembly 18, as described herein. Slurry coating station 320' differs from slurry coating station 320 in that it is not operably connected to a conveyor.

In this embodiment, the investment mold making apparatus 300' also includes a stucco coating station 330'. The stucco coating station 330' includes a plurality of dispersed dry stucco particles 309. The stucco coating station 330' is configured to receive and rotatably dispose the investment mold pattern assembly 302, including the mold pattern assembly 18, within the dispersed dry stucco particles 309 to dispose a stucco coating layer 308 of dry stucco particles 309 on the wet slurry coating layer 16. Stucco coating station 330' differs from stucco coating station 330 in that it is not operably connected to a conveyor.

In this embodiment, the investment mold making apparatus 300' also includes a drying station 340'. The drying station 340' is configured to receive and rotatably dispose the investment mold pattern assembly 302, including the mold pattern assembly 18, from the slurry coating station 320' or the stucco coating station 330' in the drying station 340'. The drying station 340' is configured to dry the wet slurry coating layer 16 and provide a dried slurry coating layer 306. Drying station 340' differs from drying station 340 in that it is not operably connected to a conveyor.

In this embodiment of investment mold making apparatus 300', a conveyor is not utilized to move the investment mold pattern assembly 302 between the respective stations, but rather the stations may be modularized together into a single module such that movement of the assembly out of the module is not required either because the stations are integrated together such that movement is not required, or are movable to the investment mold pattern assembly 302 within the module, or because the module includes a shuttle mechanism to reposition the investment mold pattern assembly 302 under or within a predetermined station for its use.

In this embodiment, the investment mold making apparatus 300' may also optionally further include a storage station 350', cleaning station 360', etchant station 370, etchant rinsing station 380', and pattern removal station 390'. These stations function the same as those having the same numbers without the prime designation described herein, except that they are not operably connected to a conveyor, but rather modularized as described above.

Method of Making a Refractory Shell Mold

The various apparatuses described herein may be used to provide a method of making a refractory shell mold 400. It will be appreciated that the method 400 may be performed using the investment mold making apparatuses 300, 300' and the stations 310, 310' described above. The method 400 described herein may be employed to make a multi-layer refractory shell mold/investment shell mold assembly 600 that includes essentially any combination of dried refractory slurry layers 306 and refractory stucco layers 308 that includes a dried refractory slurry layer 306 as the first or innermost layer. The method of making a refractory shell mold 400 includes providing 410 an investment mold pattern assembly 302. The investment mold pattern assembly 302, including removable mold pattern assembly 18, is as described herein, and includes a longitudinal axis 26, an axially-extending central sprue 312, which may be solid or hollow as described herein, at least one gate 314 extending radially outwardly from the central sprue to at least one pattern 316. The investment mold pattern assembly 302 includes a removable material 318. The axially-extending sprue is disposed on an axially extending rotatable mandrel 322 with the rotatable mandrel and central sprue 312 disposed substantially horizontally. In one embodiment, the rotatable mandrel 322 is rotatable and articulable by a predetermined angle from horizontal, and more particularly an angle of about 0-90 degrees, in one of two opposing directions.

The method 400 also includes rotating 415 the mandrel 322 and investment mold pattern assembly 302 under a first slurry curtain 12 of a first slurry comprising a liquid, a binder and first refractory particles to provide a wet coating layer 16 of first refractory particles 303 on an outer surface of the investment mold pattern assembly 302 and provide a wet slurry coated investment mold pattern assembly. Rotating 415 the mandrel 322, as well as all other rotating performed in method 400 herein, may be performed at any suitable predetermined rotational speed that leaves the deposited layers, including wet slurry layer 16, intact. In one embodiment, the predetermined rotational speed may range from 1 to 50 rpm, and more particularly 5 to 30 rpm. It is generally to preferable to rotate the mandrel 322 during the deposition of the wet slurry coating layer 16 and afterward as the investment mold pattern assembly 302 proceeds during the method 400. The predetermined rotational speed may be varied throughout the method 400, and particularly may be different during deposition steps as compared to intervals where the investment mold pattern assembly 302 is moving between stations 310. The predetermined rotational speed may be either faster or slower during a deposition step as compared to other intervals of method 400.

The method 400 also includes removing 420 the wet slurry coated investment mold pattern assembly from the slurry curtain 12. The wet slurry coating layer 16 is then ready for subsequent processing to develop the mold pattern. The investment mold pattern assembly 302 may be rotated during each of rotating 415 and removing 420 in order to ensure the uniformity of the wet slurry coating layer 16, particularly uniformity of thickness of the layer over the entirety of the surface of investment mold pattern assembly 302. This also may include rotating the investment mold pattern assembly 302 as it is moved between different stations.

In one embodiment, the method 400 further includes rotating 425 the mandrel and wet slurry coated investment mold pattern assembly under a second slurry curtain 12' to provide a second wet slurry coating layer 16' of a second slurry 14' comprising a second liquid, a second binder and second refractory particles on an outer surface of the wet slurry coated investment mold pattern assembly and provide a wet second slurry coated investment mold pattern assembly. The method 400 further includes removing 430 the wet second slurry coated investment mold pattern assembly from the second slurry curtain. Thus, according to method 400 two wet slurry coating layers may be deposited adjacent to one another with one layer deposited directly on the other. This may be employed when depositing the first and second layers of the shell mold build, or may alternately be employed to deposit slurry layers adjacent to one another in internal layers of the shell build, or even when depositing the last layers of the shell build. In one embodiment, the second slurry 14' is the same as the first slurry 14. In another embodiment, the second slurry 14' is different than the first slurry 14. The investment mold pattern assembly 302 may be rotated during each of rotating 425 and removing 430 in order to ensure the uniformity of the wet slurry coating layers 16 and 16', particularly uniformity of thickness of the layer over the entirety of the surface of investment mold pattern assembly 302. This also may include rotating the investment mold pattern assembly 302 as it is moved between different stations.

In another embodiment, the method 400 further includes drying 435 the wet coating layer 16 following removing 420 to provide a dried coating layer 306 of first refractory particles on an outer surface of the investment mold pattern assembly 302 and provide a dried slurry coated investment mold pattern assembly. The method 400 then includes rotating 440 the mandrel 322 and dried slurry coated investment mold pattern assembly under a second slurry curtain 12' to provide a second wet slurry coating layer 16' of a second slurry 14' comprising a second liquid, a second binder and second refractory particles on an outer surface of the dried slurry coated investment mold pattern assembly and provide a wet second slurry coated investment mold pattern assembly. The method 400 then includes removing 445 the wet second slurry coated investment mold pattern assembly from the second slurry curtain 12'. Thus, according to method 400, two slurry coating layers may be deposited adjacent to one another with one layer deposited directly on the other, wherein the first layer is dried prior to application of the second layer. This may be employed when depositing the first and second layers of the shell mold build, or may alternately be employed to deposit slurry layers adjacent to one another in internal layers of the shell build, or even when depositing the last layers of the shell build. In one embodiment, the second slurry 14' is the same as the first slurry 14. In another embodiment, the second slurry 14' is different than the first slurry 14. The investment mold pattern assembly 302 may be rotated during each of drying 435 and rotating 440, and removing 445 in order to ensure the uniformity of the wet slurry coating layer 16 while drying and wet slurry coating layer 16', particularly uniformity of thickness of the layer over the entirety of the surface of investment mold pattern assembly 302. This also may include rotating the investment mold pattern assembly 302 as it is moved between different stations.

In another embodiment, the method 400 further includes applying 450 a layer 308 of dry first refractory stucco particles 309 to the wet slurry coating layer 16 of the first refractory particles to provide a wet stucco coated investment mold pattern assembly. The method 400 then includes drying 455 the wet stucco coated investment mold pattern assembly to remove the liquid from the wet slurry coating layer 16 and provide a dried stucco coated investment mold pattern assembly comprising a dried layer comprising a layer 308 of first refractory stucco particles 309 and a dried slurry layer 306 of first refractory particles. The investment mold pattern assembly 302 may be rotated during each of applying 450 and drying 455 in order to ensure the uniformity of the wet slurry coating layer 16, particularly uniformity of thickness of the layer over the entirety of the surface of investment mold pattern assembly 302. This also may include rotating the investment mold pattern assembly 302 as it is moved between different stations.

In another embodiment, the method 400 further includes repeating rotating 415 the mandrel 322 and investment mold pattern assembly 302 under a first slurry curtain 12, applying 450 a layer of dry first refractory stucco particles, and drying 455 the wet stucco coated investment mold pattern assembly to provide a plurality of dried layers comprising first refractory stucco particles and first refractory particles. In this embodiment, the method 400 may also include at least one cycle of drying 455 including heating the wet stucco coated investment mold pattern assembly in an environment comprising at least one of a predetermined temperature and a predetermined relative humidity, as described herein. This may also include embodiments where a plurality of drying 455, including all drying 455, is performed in a temperature and/or humidity controlled environment as described herein. In one embodiment, the method 400 includes drying at a predetermined temperature in a range of about 75 to about 85° F., and controlling the humidity to a level where the predetermined relative humidity is in a range of about 0 to about 30 percent relative humidity. Following repeating rotating 415 the mandrel 322 and investment mold pattern assembly 302 under a first slurry curtain 12, applying 450 a layer of dry first refractory stucco particles, and drying 455 the wet stucco coated investment mold pattern assembly to provide a plurality of dried layers comprising first refractory stucco particles and first refractory particles, method 400 may also include removing 460 the removable material to provide a refractory shell mold as described herein, including removing 460 that includes heating the removable material using an autoclave or a microwave source.

In one embodiment, where method 400 includes repeating rotating 415 the mandrel 322 and investment mold pattern assembly 302 under a first slurry curtain 12, applying 450 a layer of dry first refractory stucco particles, and drying 455 the wet stucco coated investment mold pattern assembly to provide a plurality of dried layers comprising first refractory stucco particles and first refractory particles, the method 400 may be altered as follows. In this embodiment, in at least one of the plurality of dried layers, dry second refractory stucco particles 309' are substituted for the dry first refractory stucco particles 309 and/or wherein in at least one of the plurality of dried slurry coating layers 306, a second wet coating layer 16' of a second slurry 14' comprising a second liquid, a second binder and second refractory particles is substituted for the first slurry 14, and wherein the plurality of dried layers comprises first refractory stucco particles 309, first refractory particles 305, second refractory stucco particles 309' and/or second refractory particles 305'. In a further embodiment, the method 400 includes repeating rotating 415 the mandrel 322 and investment mold pattern assembly 302 under a first slurry curtain 12, applying 450 a layer of dry first refractory stucco particles, and drying 455 the wet stucco coated investment mold pattern assembly to provide a plurality of dried layers comprising first refractory stucco particles and first refractory particles. The method 400 may be altered as follows. In one embodiment, the method 400 further includes repeating rotating 415, applying 450 a layer of dry first refractory stucco particles, and drying 455, a plurality of times with a plurality of slurries (e.g. 14, 14', 14", 14''') and a plurality of refractory stucco particles (e.g. 309, 309', 309", 309''') to provide a plurality of slurry coating layers and stucco coating layers. In this embodiment, once all of the slurry and stucco layers have been applied, the method 400 may also include removing 460 the removable material to provide a refractory shell mold as described herein, including removing 460 that includes heating the removable material using an autoclave or a microwave source. In this embodiment, all of the slurries and stucco particles may be different, including different refractory particles in the slurries and different refractory stucco particles. Alternately, at least one of the slurries and stucco particles may be different, including at least one of different refractory particles in the slurries and different refractory stucco particles.

In one embodiment, the method 400 also optionally may include cleaning 470 of the investment mold pattern assembly 302, including removable mold pattern assembly 18, by applying a cleaning solution to the surface thereof either prior to rotating 415 or after drying 455 and prior to the deposition of an additional slurry and/or stucco layer. In one embodiment, the cleaning solution may be applied as a cleaning solution curtain as described herein, and cleaning 470 comprises providing a cleaning solution curtain and rotating the rotatable mandrel and investment mold pattern assembly under the cleaning solution curtain.

In one embodiment, the method 400 also optionally may include etching 465 of the investment mold pattern assembly 302, including removable mold pattern assembly 18, by applying an etchant to the surface thereof either prior to rotating 415 or after drying 455 and prior to the deposition of an additional slurry and/or stucco layer as described herein. If cleaning 470 is employed, etching 465 may be performed after cleaning 470. In one embodiment, the etchant may be applied as an etchant curtain as described herein, and etching 465 comprises providing an etchant curtain and rotating the rotatable mandrel and investment mold pattern assembly under the etchant curtain.

In one embodiment, the method 400 also optionally may include rinsing 480 of the investment mold pattern assembly 302, including removable mold pattern assembly 18, by applying a rinse that is configured to remove the etchant to the surface thereof either prior to rotating 415 or after drying 455 and prior to the deposition of an additional slurry and/or stucco layer as described herein. If etching 465 is employed, rinsing 480 may be performed after etching 465. In one embodiment, the rinse may be applied as a rinse curtain as described herein, and rinsing 480 comprises providing a rinse curtain and rotating the rotatable mandrel and investment mold pattern assembly under the rinse curtain.

In an embodiment, method 400 may also be described as including the following sequence of elements (a)-(e). The method 400 includes (a) providing 410 an investment mold pattern assembly 302, as described herein. The method also includes (b) rotating 415 the mandrel and investment mold pattern assembly under a slurry curtain of a slurry fluid as described herein. The method 400 also includes (c) optionally applying 450 a layer of dry refractory stucco particles to the wet coating layer of the first refractory particles to provide a wet stucco coated investment mold pattern assembly. The method 400 also includes (d) drying the wet and optionally stucco coated investment mold pattern assembly to remove the liquid and provide a dried stucco coated investment mold pattern assembly comprising a dried layer comprising refractory stucco particles and refractory particles. The method 400 further includes (e) repeating elements (b) through (d) a plurality of repetitions to provide a refractory shell mold comprising a predetermined plurality of dried layers 306, 308 of refractory stucco particles and refractory particles. The predetermined plurality of layers 306, 308 may include any predetermined number of layers. In one embodiment, the number of layers ranges from 1-20 layers, and more particularly 3-18 layers, and even more particularly 4-16 layers. For example, in one embodiment, the first dried slurry coating layer comprises refractory zirconia particles having a relatively small particle size that are selected to provide a low surface roughness in castings made using the mold, and subsequent dried slurry coating layers comprise refractory alumina silicate particles or fused silica particles, or a combination thereof. In this embodiment of method 400, the element (e) comprising repeating the plurality of repetitions of optional element (c), and in one embodiment the stucco comprises a plurality of different stuccos having different stucco compositions. In this embodiment of method 400 comprising elements (a)-(e), in one further embodiment the mandrel and wet slurry coated investment mold pattern assembly are rotated at a predetermined stucco coating speed and a predetermined drying speed when applying the dry first refractory stucco particles and/or drying the coated investment mold pattern assembly, respectively. Further, during the plurality of repetitions the predetermined stucco coating speed and/or the predetermined drying speed may be different from a rotational speed of the mandrel and investment mold pattern assembly while it is under the slurry curtain, including a predetermined stucco coating speed, predetermined drying speed and rotational speed of the mandrel and investment mold pattern assembly while it is under the slurry curtain that range from about 1 to about 40 rpm.

The method 400 and apparatuses 300, 300' may be used to make all manner of sintered or bonded refractory shell mold assemblies 600, including those that are gas permeable or gas impermeable. In certain embodiments, for example, the bonded refractory shell wall may be relatively thin and gas permeable and be formed using several (e.g., 2-4) layers of slurry and have a thickness of about 1 to about 4 mm, and more particularly about 1 to about 2 mm, and comprise a several layer investment casting (SLIC) refractory shell mold assemblies 600. In certain other embodiments, the bonded refractory shell wall may be relatively thick and gas impermeable (i.e., lower permeability) and be formed using multiple (e.g., 6-10 or more) layers of slurry and have a thickness of about 10 mm or more, and comprise a semi-permeable or gas impermeable refractory shell mold assembly 600. After a desired shell mold wall thickness is built up on the removable mold pattern assembly 18, the pattern assembly may be selectively removed by well-known removal techniques, such as steam autoclave or flash fire pattern elimination, leaving a green shell mold having one or more mold cavities for filling with molten metal or alloy and solidification therein to form a cast article having the shape of the pattern cavity. Alternately, the removable mold pattern assembly 18 can be left inside the bonded refractory mold and removed later during mold heating. The removable mold pattern assembly 18 may include a pattern for a gravity casting mold or a countergravity casting mold.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of items is applied to all of the listed items, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

The method 400 and apparatuses 10, 100, 200, and 300 described herein are very advantageous in that they may be used to build shell molds continuously in a manner that reduces the build time from a plurality of days to a plurality of hours, including less than one day. This affords a significant reduction in cost of the molds and also the investment castings made using the molds, since a molds is required for each casting and becomes a part of the cost of the casting, since the molds are not reusable.

It is to be understood that the use of "comprising" in conjunction with the components or elements described herein specifically discloses and includes the embodiments that "consist essentially of" the named components (i.e., contain the named components and no other components that significantly adversely affect the basic and novel features disclosed), and embodiments that "consist of" the named components (i.e., contain only the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An investment mold slurry curtain apparatus, comprising:

a first plurality of outlets having a longitudinal axis and a latitudinal axis, each of the first plurality of outlets configured to dispense an investment mold slurry fluid and form a slurry curtain of the investment mold slurry fluid, wherein the first plurality of outlets is arranged to form the slurry curtain having a length and a thickness, the length greater than the thickness, wherein at least one of the first plurality of outlets comprises at least one moveable plate that is movable along the longitudinal axis or an axis diagonal to the longitudinal axis of the outlet to define an outlet shape having a length and a thickness, the length and the thickness of the outlet shape is adjustable by moving the at least one moveable plate along the longitudinal axis or the axis diagonal to the longitudinal axis of the outlet so that a shape of the slurry curtain is adjustable with the length of the outlet shape being substantially greater than the thickness of the outlet shape; and a second plurality of outlets, each of the second plurality of outlets configured to dispense a stucco and form a stucco curtain.

2. The apparatus of claim 1, wherein at least one of the first plurality of outlets has an outlet shape to form a flat plane of the slurry curtain.

3. The apparatus of claim 1, wherein at least one of the first plurality of outlets has an outlet shape to form a curved plane of the slurry curtain; and wherein the at least one moveable plate is configured to be movable along the longitudinal axis of at least one of the first plurality of outlets to define an outlet shape having a length, the length of the outlet shape being adjustable by moving the at least one moveable plate along the longitudinal axis of at least one of the first plurality of outlets so that a shape of the slurry curtain is adjustable with the length of the outlet shape being substantially greater than the thickness of the outlet shape.

4. The apparatus of claim 1, wherein the length of the slurry curtain is 5 to 1000 times the thickness of the slurry curtain; and wherein the at least one moveable plate is configured to be movable along the axis diagonal to the longitudinal axis of at least one of the first plurality of outlets to define an outlet shape having a thickness, the thickness of the outlet shape being adjustable by moving the moveable plate along the axis diagonal to the longitudinal axis of at least one of the first plurality of outlets so that a shape of the slurry curtain is adjustable with the length of the outlet shape being substantially greater than the thickness of the outlet shape.

5. The apparatus of claim 1, wherein the length of the slurry curtain is 20 to 500 times the thickness of the slurry curtain; and wherein the at least one moveable plate is configured to be movable along the axis diagonal to the longitudinal axis of at least one of the first plurality of outlets to define an outlet shape having a thickness, the thickness of the outlet shape being adjustable by moving the moveable plate along the axis diagonal to the longitudinal axis of at least one of the first plurality of outlets so that a shape of the slurry curtain is adjustable with the length of the outlet shape being substantially greater than the thickness of the outlet shape.

6. The apparatus of claim 1, wherein the first plurality of outlets forms a plurality of slurry curtains and the second plurality of outlets forms a plurality of stucco curtains.

7. The apparatus of claim 1, wherein the thickness of the slurry curtain is constant.

8. The apparatus of claim 1, wherein the thickness of the slurry curtain varies along the length.

9. The apparatus of claim 1, wherein the outlet shape is adjustable while the slurry curtain is being dispensed.

10. The apparatus of claim 1, wherein at least one of the first plurality of outlets and the second plurality of outlets is movable about at least one axis of three mutually orthogonal axes.

11. The apparatus of claim 1, wherein the first plurality of outlets is configured to receive a slurry fluid from a slurry conduit and the second plurality of outlets is configured to receive a stucco from a stucco conduit.

12. An investment mold slurry coating apparatus, comprising:

a conduit configured to receive a flow of an investment mold slurry fluid;

a first plurality of outlets having a longitudinal axis and an axis diagonal to the longitudinal axis operatively coupled to the conduit and configured to dispense the flow of the investment mold slurry fluid as a slurry curtain, wherein at least one of the first plurality of outlets comprises at least one moveable plate that is movable along the longitudinal axis or the axis diagonal to the longitudinal axis of the outlet to define an outlet shape having a length and thickness, the length and the thickness of the outlet shape is adjustable by moving the moveable plate along the longitudinal axis or the axis diagonal to the longitudinal axis of the outlet so that a shape of the slurry curtain is adjustable wherein the length of the outlet shape is substantially greater than the thickness of the outlet shape; and a second plurality of outlets, each of the second plurality of outlets configured to dispense a stucco and form a stucco coating.

13. The apparatus of claim 12, wherein at least one of the first plurality of outlets is configured to dispense the slurry curtain as a gravity fluid flow and the second plurality of outlets is configured to dispense a stucco curtain as a gravity flow.

14. The apparatus of claim 12, wherein at least one of the outlets is configured to dispense the slurry curtain as a pressurized fluid flow.

15. The apparatus of claim 12, wherein: the conduit comprises a plurality of conduits in fluid communication of the investment mold slurry fluid; and the first plurality of outlets corresponding to the conduits are configured to receive a corresponding plurality of flows of the investment mold slurry fluid to dispense the flows of the investment mold slurry fluid as corresponding slurry curtains.

16. The apparatus of claim 12, wherein at least one of the first plurality of outlets has an elongated opening having a length and a width, the length substantially greater than the width such that the flow of the investment mold slurry fluid through the first plurality of outlets provides the first slurry curtain.

17. The apparatus of claim 12, wherein: at least one of the first plurality of outlets has an outlet opening; the conduit is movable; and the flow of the investment mold slurry fluid through the outlet opening and a movement of the conduit provide the slurry curtain.

18. The apparatus of claim 12, wherein at least one of the first plurality of outlets and the second plurality of outlets is movable about at least one axis of three mutually orthogonal axes.

19. An investment mold slurry coating manifold apparatus, comprising:

a plurality of slurry manifolds, each having a slurry chamber configured to receive a flow of investment mold slurry fluid, and an inlet conduit disposed on the slurry manifold, the inlet conduit having an inlet opening into the slurry chamber, the inlet conduit configured to provide the flow of the investment mold slurry fluid into the slurry chamber;

a first plurality of outlets having a longitudinal axis and an axis diagonal to the longitudinal axis configured to dispense the flow of investment mold slurry fluid as a first slurry curtain;

wherein at least one of the first plurality of outlets comprises at least one moveable plate that is movable along the longitudinal axis or the axis diagonal to the longitudinal axis of the outlet to define an outlet shape having a length and a thickness, the length and the thickness of the outlet shape is adjustable by moving the moveable plate along the longitudinal axis or the axis diagonal to the longitudinal axis of the outlet so that a shape of the first slurry curtain is adjustable wherein the length of the outlet shape is substantially greater than the thickness of the outlet shape; and a second plurality of outlets configured to dispense the flow of stucco as a stucco curtain.

20. The apparatus of claim 19, wherein each of the plurality of slurry manifolds includes an inlet conduit disposed on the slurry manifold, the inlet conduit having inlet openings into the slurry chamber and configured to provide corresponding flows of the investment mold slurry fluid into the slurry chamber.

21. The apparatus of claim 19, wherein the plurality of slurry manifolds is configured to dispense the slurry curtain through at least one of the first plurality of outlets as a gravity slurry flow.

22. The apparatus of claim 19, wherein slurry manifold is configured to dispense the slurry curtain through at least one of the outlets as a pressurized slurry flow.

23. The apparatus of claim 19, wherein the inlet conduit is configured to receive a plurality of flows of slurry fluid.

24. The apparatus of claim 19, wherein the inlet conduit comprises a plurality of inlet conduits.

25. The apparatus of claim 24, wherein the plurality of inlet conduits is configured to provide at least one flow of slurry fluid, a second slurry fluid different than the at least one flow of slurry fluid, water, a cleaning solution, an etchant, or an etchant rinse.

26. The apparatus of claim 19, wherein the slurry curtain has a plane having a width and a length, and wherein the length is 20 to 500 times the width.

27. The apparatus of claim 19, wherein the first plurality of outlets and the second plurality of outlets comprises a plurality of orifices.

28. The apparatus of claim 27, wherein the orifices are arranged in a pattern that defines the slurry curtain.

29. The apparatus of claim 19, wherein at least one of the first plurality of outlets and the second plurality of outlets comprises a slot.

30. The apparatus of claim 29, wherein the first and the second plurality of outlets comprises a plurality of slots.

31. The apparatus of claim 29, wherein at least one of the first and the second plurality of outlets comprises a rectangular slot.

32. The apparatus of claim 29, wherein at least one of the first and the second plurality of outlets comprises an arcuate slot.

33. The apparatus of claim 29, wherein the slot comprises a plurality of rectangular segments disposed proximate to one another.

34. The apparatus of claim 29, wherein: the slot has a length and a width; and the length is 20 to 500 times the width.

35. The apparatus of claim 29, wherein: the slot has a length and a width; and the width is variable along the length.

36. The apparatus of claim 29, wherein: the slot has a length and a width; and the slot comprises at least one rib extending across the width or the length of the slot.

37. The apparatus of claim 19, wherein at least one of the first plurality of outlets is configured to form the slurry curtain having adjacent rectangular segments.

38. The apparatus of claim 19, wherein: the second plurality of outlets has an outlet shape; and the outlet shape is adjustable.

39. The apparatus of claim 19, wherein at least one of the first plurality of outlets and the second plurality of outlets is movable about at least one axis of three mutually orthogonal axes.

* * * * *